US012582232B2

(12) United States Patent
Collier et al.

(10) Patent No.: US 12,582,232 B2
(45) Date of Patent: Mar. 24, 2026

(54) ERGONOMIC MOTION CHAIR

(71) Applicants: Michael David Collier, Lake Oswego, OR (US); Michael David Collier, Lake Oswego, OR (US)

(72) Inventors: Michael David Collier, Lake Oswego, OR (US); James Collias, Milwaukie, OR (US)

(73) Assignee: MOOVLAB INC., Lake Oswego, OR (US)

( * ) Notice: Subject to any disclaimer, the term of this patent is extended or adjusted under 35 U.S.C. 154(b) by 59 days.

(21) Appl. No.: 18/383,027

(22) Filed: Oct. 23, 2023

(65) Prior Publication Data

US 2024/0049881 A1 Feb. 15, 2024

Related U.S. Application Data

(63) Continuation-in-part of application No. 17/551,129, filed on Dec. 14, 2021, now Pat. No. 11,825,949,
(Continued)

(51) Int. Cl.
*A47C 1/032* (2006.01)

(52) U.S. Cl.
CPC ..... *A47C 1/03294* (2013.01); *A47C 1/032* (2013.01); *A47C 1/03255* (2013.01); *A47C 1/03266* (2013.01); *A47C 1/03205* (2013.01)

(58) Field of Classification Search
CPC . A47C 1/032; A47C 1/03255; A47C 1/03266; A47C 7/029
(Continued)

(56) References Cited

U.S. PATENT DOCUMENTS 3,466,089 A 9/1969 Stueckle
3,567,280 A 3/1971 Bradshaw
(Continued)

FOREIGN PATENT DOCUMENTS

CA 2816224 C 5/2012
DE 202009004382 8/2009
(Continued)

OTHER PUBLICATIONS

Internet Web Page: https://www.youtube.com/watch?v=7suPTql6EqA&ab_channel=QOR360 Posted: Apr. 25, 2019.
(Continued)

*Primary Examiner* — Rodney B White

(57) ABSTRACT

A chair that provides movement of a seat about an axis of rotation above the seat plane with the seat having a sensor in communication with a computer system that tracks movement. The seat may be simultaneously pivotable about a second axis of rotation defining a range of motion for the seat about the two axes. An actuation system in communication with the computer system can move the seat to desired positions and/or prevent the seat from being positioned at certain locations within the range of motion. The computer system may also include an application that can promote user movement within the seat and allow movement of the seat to be used for gaming, health monitoring and treatment, activity tracking, and the like. The chair may include a mechanism that has one or more glides operably received in curved structures to provide the movement about the axes.

20 Claims, 46 Drawing Sheets

Related U.S. Application Data which is a continuation-in-part of application No. 17/307,942, filed on May 4, 2021, now Pat. No. 11,229,291.

(60) Provisional application No. 63/463,047, filed on Apr. 30, 2023.

(58) Field of Classification Search
USPC ..... 297/314
See application file for complete search history.

(56) References Cited

U.S. PATENT DOCUMENTS

| | | | | |
|---|---|---|---|---|
| 3,632,076 | A | 1/1972 | Rogers | |
| 3,711,152 | A | 1/1973 | Sirpak et al. | |
| 4,183,492 | A | 1/1980 | Meiller | |
| 4,575,151 | A | 3/1986 | Edstrom | |
| 4,988,145 | A | 1/1991 | Engel | |
| 5,261,723 | A | 11/1993 | Hosoe | |
| 5,522,106 | A | 6/1996 | Harrison et al. | |
| 6,283,551 | B1 | 9/2001 | Bergin | |
| 6,609,755 | B2 | 8/2003 | Koepke et al. | |
| 6,866,340 | B1 | 3/2005 | Robertshaw | |
| 7,100,983 | B1 | 9/2006 | Gant | |
| 7,234,768 | B2 | 6/2007 | Manning | |
| 7,281,764 | B2 | 10/2007 | Thole | |
| 7,413,250 | B2 | 8/2008 | Connolly et al. | |
| 7,789,463 | B2 | 9/2010 | Gang | |
| 8,087,724 | B2 | 1/2012 | Kosik et al. | |
| 8,182,036 | B2 | 5/2012 | Nishino | |
| 8,534,758 | B2 | 9/2013 | Rivera | |
| 8,662,586 | B2 | 3/2014 | Serber | |
| 8,919,881 | B2 | 12/2014 | Bay | |
| 8,926,017 | B2 | 1/2015 | Grove et al. | |
| 8,944,507 | B2 | 2/2015 | Goetz | |
| 9,211,013 | B2 | 12/2015 | Harrison et al. | |
| 9,498,066 | B2 | 11/2016 | Christianson et al. | |
| 9,717,340 | B2 | 8/2017 | Rivera | |
| D815,218 | S | 4/2018 | Osler | |
| 9,975,458 | B2 | 5/2018 | Takeuchi et al. | |
| 9,981,158 | B2 * | 5/2018 | Melnik | A63B 21/4047 |
| 10,010,758 | B2 | 7/2018 | Osler et al. | |
| 10,226,127 | B2 | 3/2019 | Harrison et al. | |
| 10,272,282 | B2 | 4/2019 | Harlow | |
| 10,314,400 | B2 | 6/2019 | Colonello et al. | |
| 10,383,445 | B2 | 8/2019 | Serber | |
| 10,398,233 | B2 * | 9/2019 | Hoyt | A47C 7/56 |
| 10,499,742 | B2 | 12/2019 | Bock et al. | |
| 10,667,612 | B2 | 6/2020 | Matlin et al. | |
| 10,750,873 | B2 * | 8/2020 | Hoyt | A47C 7/62 |
| 10,820,704 | B2 | 11/2020 | Sugano et al. | |
| 10,842,276 | B2 | 11/2020 | Sugano et al. | |
| 10,912,385 | B2 * | 2/2021 | Kelley | A47C 7/72 |
| 10,986,924 | B2 | 4/2021 | Shibamoto et al. | |
| 11,204,296 | B2 | 12/2021 | Wang et al. | |
| 11,229,291 | B1 | 1/2022 | Collier | |
| 11,517,113 | B2 * | 12/2022 | Hoyt | A47C 7/62 |
| 11,533,998 | B2 | 12/2022 | Kinoshita et al. | |
| 11,825,949 | B2 | 11/2023 | Collier | |
| 12,004,662 | B2 * | 6/2024 | Hoyt | A61B 5/4561 |
| 2003/0164638 | A1 | 9/2003 | Funk et al. | |
| 2008/0290712 | A1 | 11/2008 | Parker et al. | |
| 2011/0089733 | A1 | 4/2011 | Nishino | |
| 2016/0081478 | A1 | 3/2016 | Ehrenleitner | |
| 2016/0081483 | A1 | 3/2016 | Harrison et al. | |
| 2016/0367027 | A1 | 12/2016 | Voigt et al. | |
| 2018/0272191 | A1 | 9/2018 | Osler et al. | |
| 2019/0045928 | A1 | 2/2019 | Yajima et al. | |
| 2019/0254430 | A1 | 8/2019 | Colonello et al. | |
| 2019/0281985 | A1 | 9/2019 | Kinoshita et al. | |
| 2019/0281986 | A1 | 9/2019 | Sugano et al. | |
| 2019/0290006 | A1 | 9/2019 | Kinoshita et al. | |
| 2019/0298070 | A1 | 10/2019 | Lawson | |
| 2019/0343286 | A1 | 11/2019 | Sugano et al. | |
| 2020/0085195 | A1 | 3/2020 | Shibamoto et al. | |

FOREIGN PATENT DOCUMENTS

| | | | |
|---|---|---|---|
| DE | 102013010279 | A1 | 1/2014 |
| EP | 1090568 | | 4/2001 |
| EP | 1090568 | B1 | 4/2001 |
| EP | 1163865 | A2 | 12/2001 |
| EP | 1698254 | A1 | 9/2006 |
| EP | 2381816 | B1 | 12/2009 |
| EP | 1911374 | B1 | 8/2010 |
| EP | 2387913 | B1 | 11/2011 |
| EP | 2830464 | B1 | 6/2013 |
| GB | 755171 | | 8/1956 |
| GB | 2348124 | A | 9/2000 |
| KR | 101492896 | B1 | 2/2015 |
| NL | 1017456 | C | 8/2002 |
| RU | 2437605 | C2 | 6/2008 |
| WO | WO1996014041 | A1 | 5/1996 |
| WO | WO2010066409 | A1 | 6/2010 |
| WO | WO2020010468 | A1 | 1/2020 |

OTHER PUBLICATIONS

Internet Web Page: https://www.youtube.com/watch?v=cymh6eUViF4&ab_channel=VermontPBS Posted: Nov. 17, 2016.

Internet Web Page : https://www.youtube.com/watch?v=DhH5mbZ9j5c&ab_channel=DavidZhang Posted: Jul. 6, 2018.

PCT Application No. PCT/US21/64019, International Search Report, Completed Apr. 18, 2022, Mailed May 18, 2022.

PCT Application No. PCT/US21/64019, Written Opinion of the International Search Authority, Mailed May 18, 2022.

* cited by examiner

ERGONOMIC MOTION CHAIR

CROSS REFERENCE TO RELATED APPLICATIONS

This is a continuation-in-part of and claims priority to U.S. patent application Ser. No. 17/551,129 filed on Dec. 14, 2021, which issued as U.S. Pat. No. 11,825,949 B2 on Nov. 28, 2023, which is a continuation-in-part of and claims priority to U.S. patent application Ser. No. 17/307,942 filed on May 4, 2021, which issued as U.S. Pat. No. 11,229,291 on Jan. 25, 2022. This application also claims the benefit of, and priority to, U.S. provisional patent application Ser. No. 63/463,047, filed on Apr. 30, 2023. The disclosures of all of these applications are hereby incorporated by reference.

FIELD OF THE INVENTION

This invention relates to an ergonomic motion chair with an assembly that allows a user to easily optimize and adjust their sitting position. In particular, the chair includes a mechanism connecting the seat of the chair to a frame that includes a arcuate structure with a mating elongate slide within, or under, the actuate structure to allow the seat to pivot about a first axis of rotation relative to the frame. Other disclosed features include a second pivot between the seat and frame with both the first and second pivots being located above the seat plane, an improved seatback that supports the user's back without limiting the user's ability to move their shoulder blades, an improved biasing structure for biasing the seat to a neutral position, an imbedded controller or imbedded sensor operably connected to a computer system for allowing the seat's position to be used as a computer controller, or the gathering of the users motion data, an actuation system for allowing the computer system to actively control movement of the seat, and computer applications aimed at optimizing the movement features of the seat.

BACKGROUND

Stationary sitting for long periods of time can be dangerous to one's health. Studies have shown that it can shorten one's lifespan due to health risks such as heart disease, obesity, diabetes, depression, and an array of orthopedic injuries and muscle degeneration. Moreover, bio-mechanical injuries and muscular-skeletal challenges can result from the restriction of movement, prolonged joint compression, and poor blood circulation of long-term sitting.

The human body can move at a multitude of joints in wide degrees of angles in all axes. Allowing the body to move along its range of motion while seated can reduce or mitigate the harmful effects of long-term sitting.

To date, designers have made many attempts to provide ergonomic improvements to chairs aimed at allowing increased user movement while sitting. For example, chair designers have attempted to tilt and toggle the seat of a chair by either having the user sit on a large movable ball or have them perched on a seat connected to a base by a ball joint or resilient structure. Examples of these latter designs can be found in U.S. Pat. No. 6,866,340 to Robertshaw, U.S. Pat. No. U.S. Pat. No. 8,919,881 to Bay, and U.S. Pat. No. 9,211,013 to Harrison et al. These types of chairs allow the seat to tilt and toggle in all directions usually about a toggle point, thereby requiring the user to take affirmative action such as using one's legs and stomach muscles to balance and hold the seat in a desired position while seated. This action provides a form of exercise while seated, but it usually comes at the expense of providing no or limited back support. Moreover, teetering on a ball, ball joint, universal hinge, or the like while seated can become tedious, uncomfortable and increase fatigue for a user during long-term sitting.

Some designers have attempted to improve the ergonomics of a chair by allowing the seat to slide within the frame relative to a seatback. An example of these types of designs can be found in U.S. Pat. No. 8,662,586 to Serber. These designs include structures that allow the seat to move, usually forward and backward, independently of a separate seatback to allow a user to tilt forward or recline in the chair. These types of chairs usually include an adjustment structure that allows the seatback to be preset to an optimal position when the user is seated normally in the chair, however, the sliding movement of the seat relative to the preset position of the seatback typically changes the user's position relative to the seatback, thereby compromising the comfort, chair fit and health benefits of the chair while the user is tilted forward or reclined in the chair.

More recently, inventors have attempted to improve seat comfort while still allowing for some body movement by requiring the user to sit in a bucket that rotates front-to-back about a fixed pivot point in a seat frame. Examples of this type of design can be found in U.S. Pat. No. 3,711,152 to Sirpak et al. and U.S. Pat. No. 10,314,400 to Colonello et al. The pivoting movement of the bucket front-to-back requires the user to use their legs and arms to hold a seated position, thereby reducing slouching and the like. Like sitting on a ball, these types of designs require affirmative action on the part of the user to hold a desired position, thereby providing a form of exercise for the user. However, these types of designs limit movement to allowing only forward-and-back tilting while cradling the user in the bucket in all other directions. This restriction of allowable movement of the bucket adversely limits the range of movement of the user while seated, thereby compromising and limiting chair fit, user comfort, and the health benefits of the chair.

In addition, inventors have provided structures that allow a seat to "teeter" or "wobble" side-to-side or front to back while a user is seated. An example of this type of structure can be found in U.S. Pat. No. 10,010,758 to Osler et al. It rests the seat on a "half-pipe" or "hemispheric- or dome-shaped rocking mechanism" upon which the user is required to balance the seat. Maintaining balance on the seat requires affirmative action on the part of the user, thereby providing some exercise for the user. However, the total range of movement of the user's body that this structure provides is limited. Moreover, as with sitting on a ball or teetering structure, maintaining a seated position on this seat can increase fatigue and become unsteady, tedious and uncomfortable for the user over time.

Moreover, traditional office chairs have seatbacks that engage the users back while leaning back, or reclining, in the seat simultaneously engage the spinal column and upper left and right sections of the back within the same plane, thereby constraining and restricting the ability of the user to stretch out their back shoulder scapula areas independently relative to their spinal column, especially in the reclining position where the user can take advantage of their body weight and arms and gravity to achieve a greater stretch of their front chest area and shoulder area.

In addition, attempts to integrate seats with computer systems to improve movement, health, fitness and/or entertainment of a user have had limited success.

SUMMARY

Thus, despite the known structures for improving the ergonomics of a chair and its fit, there remains a need for an ergonomic motion chair that provides movement of a seat about an axis of rotation above the seat plane with the seat having a sensor in communication with a computer system that tracks movement. The seat may be simultaneously pivotable about a second axis of rotation defining a range of motion for the seat about the two axes. An actuation system in communication with the computer system can move the seat to desired positions and/or prevent the seat from being positioned at certain locations within the range of motion. The computer system may also include an application that can promote user movement within the seat and allow movement of the seat to be used for gaming, health monitoring and treatment, activity tracking, and the like. The present invention fulfills this and other needs as set forth here.

In one disclosed embodiment, the seat is substantially pivotable about a first axis of rotation, defining a first pivot axis, using a mechanism operably connecting the seat to a frame where the mechanism has an arcuate structure such as a slot and an elongate slide operably received therein such that movement of the elongated slide within or under the arcuate structure allows the seat to move about the first axis of rotation.

The chair may also include a structure that allows the seat to be easily positioned and adjusted side-to-side from a neutral position along the first pivot axis that is positioned above a seat plane. This side-to-side swinging movement of the seat below the defined first pivot axis allows a user to dynamically select, adjust and hold a desired side-to-side seat position. Moreover, gravity can urge the seat to balance to a central side-to-side neutral position and a biasing structure may also be provided to further urge the seat to return to this side-to-side neutral position. In addition, by the weight of the user combined with this geometry helps naturally urge the seat to return to the neutral position and requires the user to exert significantly less effort to return to a side-to-side neutral position unlike any other chair constructions.

In addition and concurrently thereto, the second axis of rotation, defining a second pivot, may also be positioned above the seat plane and may include a structure that provides forward-and-back movement of the seat. The seat and seatback may be joined together to a central spine that moves about the second pivot, thereby maintaining the seatback position and seat position relative to each other during forward-and-back movement of the spine along the second pivot. A second biasing structure operably secured to the spine can hold and maintain the forward-and-back position of the seat in a desired forward-and-back neutral position.

If desired, the location of this forward-and-back neutral position may be statically adjusted as desired by a user, and the second biasing structure can hold this forward-and-back neutral position at a desired tension level thereby allowing a user to select the amount of force required to move the seat out of this defined forward-and-back neutral position. Moreover, an adjustment structure may be provided that allows for static adjustment of the seatback's position on the spine, which once selected by a user will hold that position relative to the seat as the spine moves about the second pivot.

In disclosed alternative possible embodiments, the structure may include an improved seatback that supports a user's back without limiting the user's ability to move their shoulder blades, a monolithic alternative possible resilient biasing structure for simultaneously biasing the seat to a neutral position in both the forward-to-back and side-to-side movement directions, an imbedded controller or sensor for allowing the seat's position to be used as a computer controller or for gathering or collection of motion data when the chair is in use, and an adjustable tilt locking system to allow the forward-and-back movement of the seat to be held in a desired position.

In addition, the dual pivots may be provided in a mechanism enclosed within a mechanism frame that allows the seat, base and seatback to be operably secured thereto, thereby allowing a plurality of different ornamentally designed seatbacks, seats, and bases to be easily secured to the mechanism frame.

Other disclosed features include an actuation system in communication with a computer system that allows the computer system to actively move the about its respective pivot axes and computer applications aimed at optimizing the movement features of the seat.

By allowing the seat plane to rotate, swing and adjust side-to-side with the forward-and-back simultaneously, and synchronic together, about the first and second pivot axes, a user's body can move to many more, infinite positions during the seating period than by any other chair construction. The chair mechanism of the current invention will unlock the hip swing, relative to a human body, about an axis whereby said first axis is critically located above the seat plane structure, and located in approximate and adjacent area of the center of the pelvis, whereby the user can rotate, or swing the pelvis side-to-side with full control and not having the sensation of "tipping off" and/or "teetering" and/or "balancing" the seat plane as found in all other designs where the axis of rotation is located below the user's body.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

Figure 19:
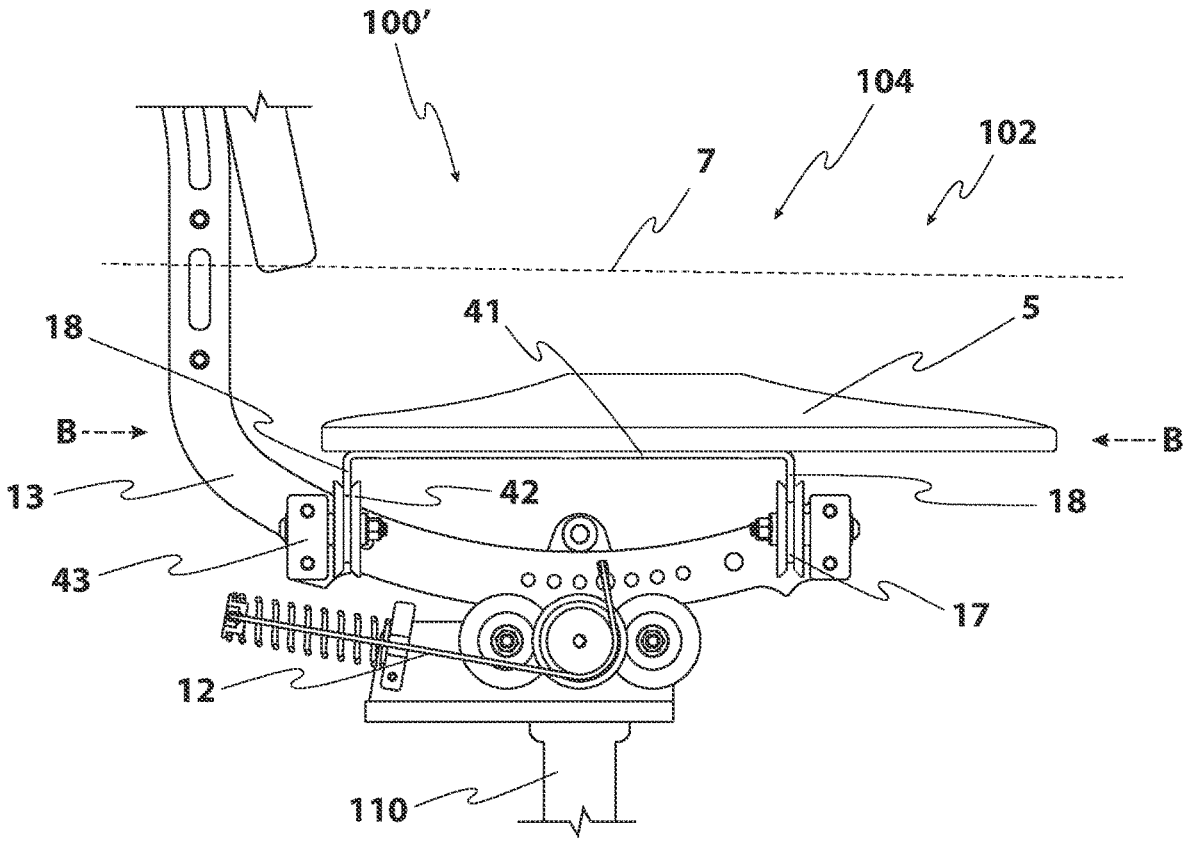
FIG. 19 is an enlarged, fragmentary, left side view cut along arrows B-B, similar to the cut along arrow A-A of FIGS. 6 & 9, of a possible ergonomic motion chair with an alternative structure for providing side-to-side movement about a pivot axis positioned above a seat plane in accordance with an alternative second embodiment of the present invention.
Figure 20:
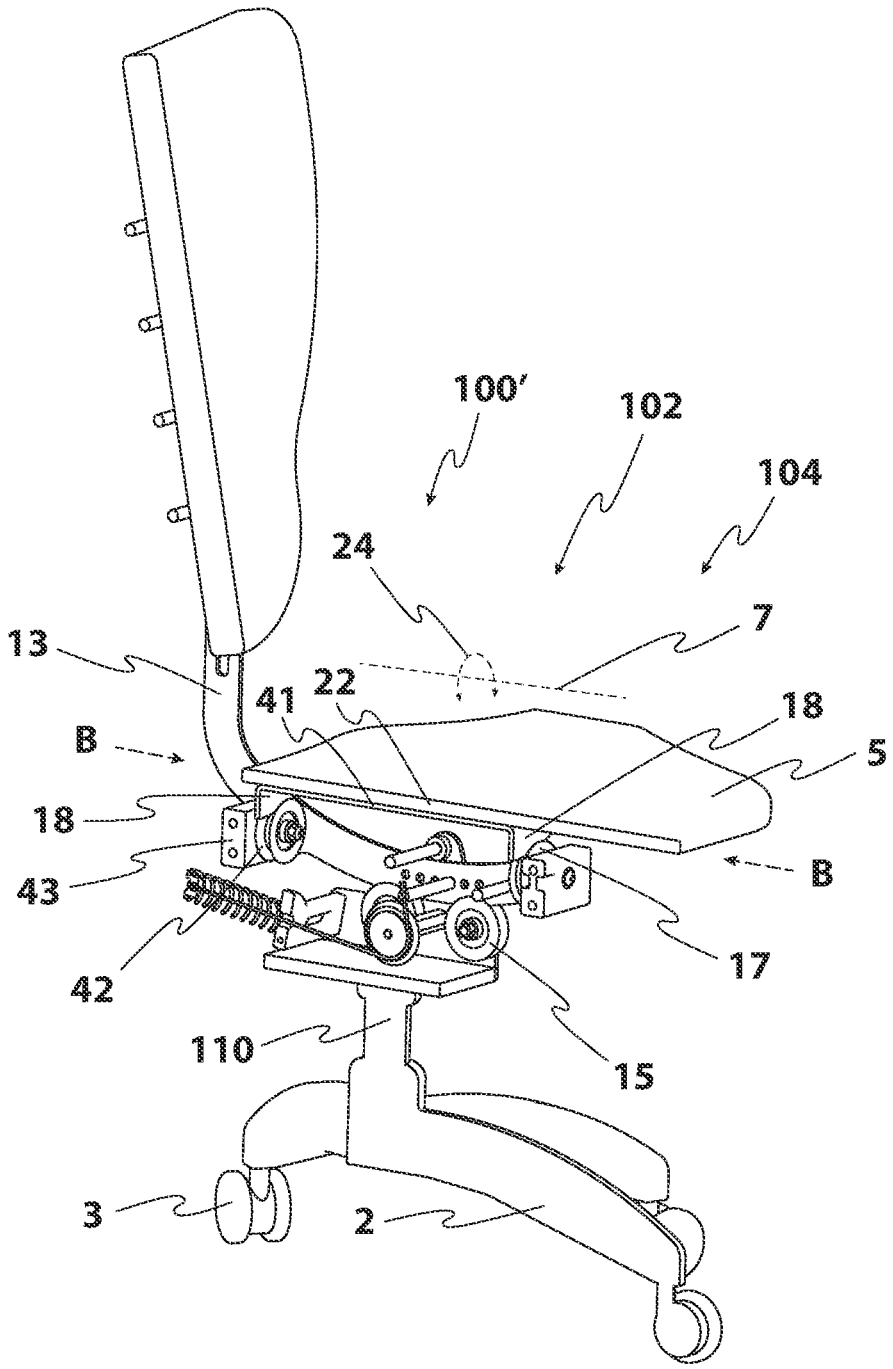
FIG. 20 is a cross-sectional, isometric view of the ergonomic motion chair of FIG. 19.
Figure 21:
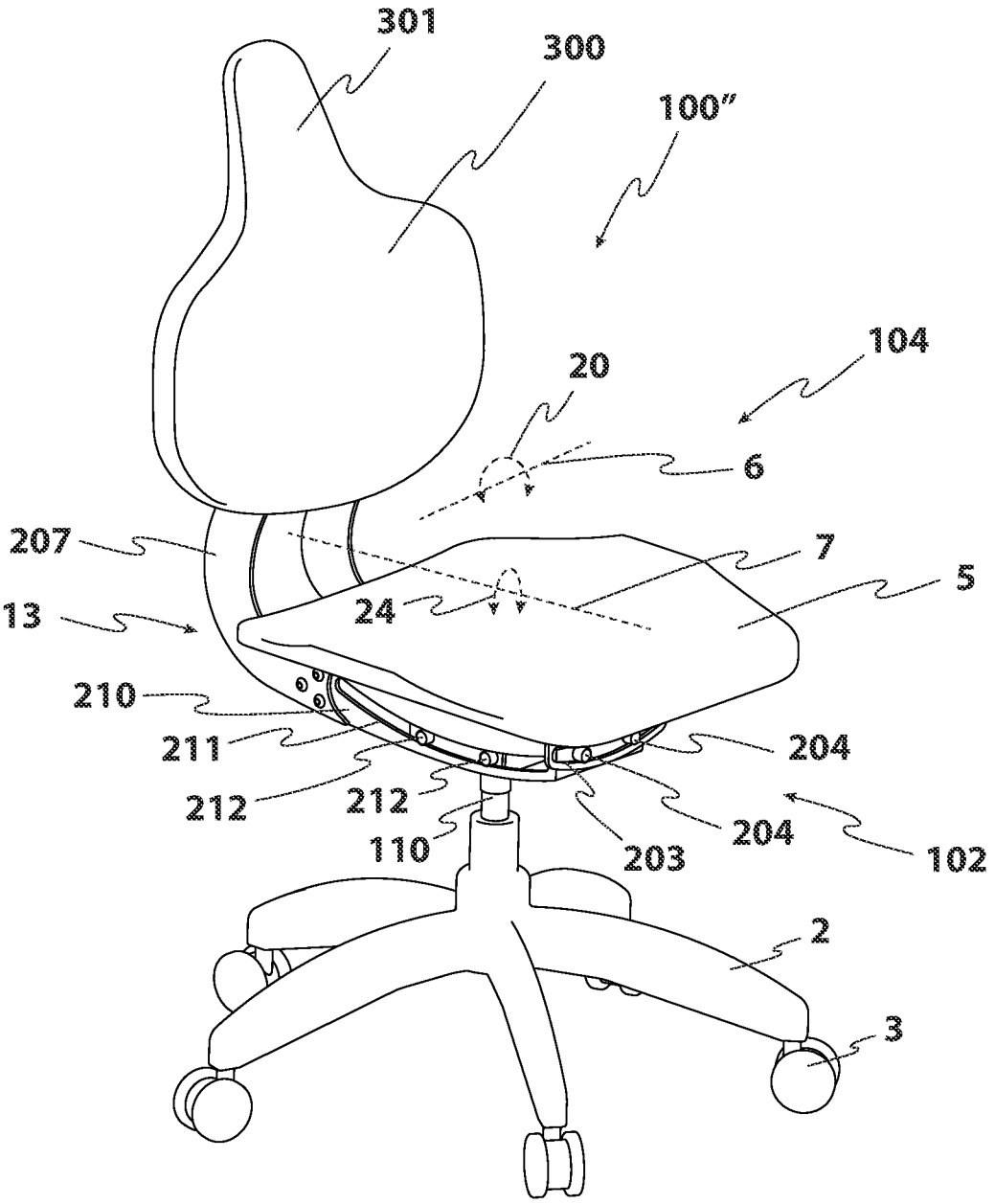
FIG. 21 is a left, front isometric view of an ergonomic motion chair in accordance with an exemplar third embodiment of the present invention.

An ergonomic motion chair 100 (FIGS. 1-18), 100' (FIG. 19-20), 100" (FIGS. 21-27 & 33), 100'"(FIG. 29), 100"" (FIGS. 34-40), 100""" (FIGS. 44-48) that provides a wide range of dynamic movement for the user while seated in it but does not require constant or excessive action on the part of the user to maintain a desired position is shown in FIGS. 1-40. Six exemplar embodiments of the ergonomic motion chair are shown. A first possible embodiment is shown in FIGS. 1-18, a second possible embodiment is shown in FIGS. 19-20, a third possible embodiment is shown in FIGS. 21-27, a fourth possible embodiment is shown in FIG. 29, a fifth possible embodiment is shown in FIGS. 34-40, and a sixth possible embodiment is shown in FIGS. 44-48.

Other disclosed features include a possible computer controller system with possible user interface for operably engaging with the ergonomic motion chair as shown in FIGS. 28 and 41-47, and an exemplar actuation system for moving the seat of the ergonomic motion chair in response to inputs from the computer controller system as shown in FIGS. 37-40. Alternative possible seat biasing structures are also disclosed in FIGS. 12-17, 19, 20, 23, 25, 29, 39, 40, and 49-51.

The features of these embodiments and additional features are set forth below. In order to limit undue repetition, like elements between the embodiments and features have like element numbers.

Exemplar Embodiment 1

Figure 2:
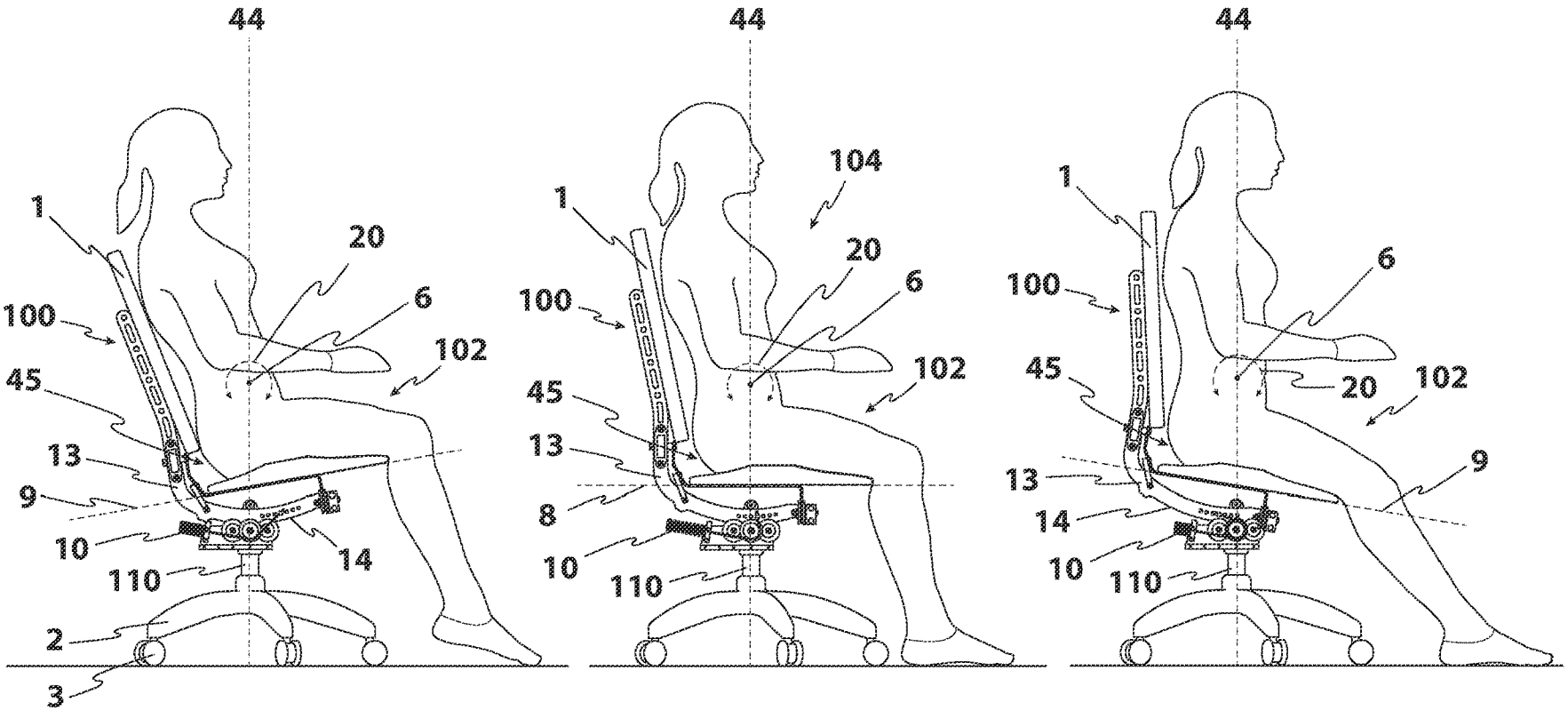
FIG. 2 is a left side plan view of the ergonomic motion chair of FIG. 1 showing possible forward-and-back movement defining a back position, a forward-and-back neutral position, and a forward position of the chair with a person shown sitting in the chair for orientation.
Figure 3:
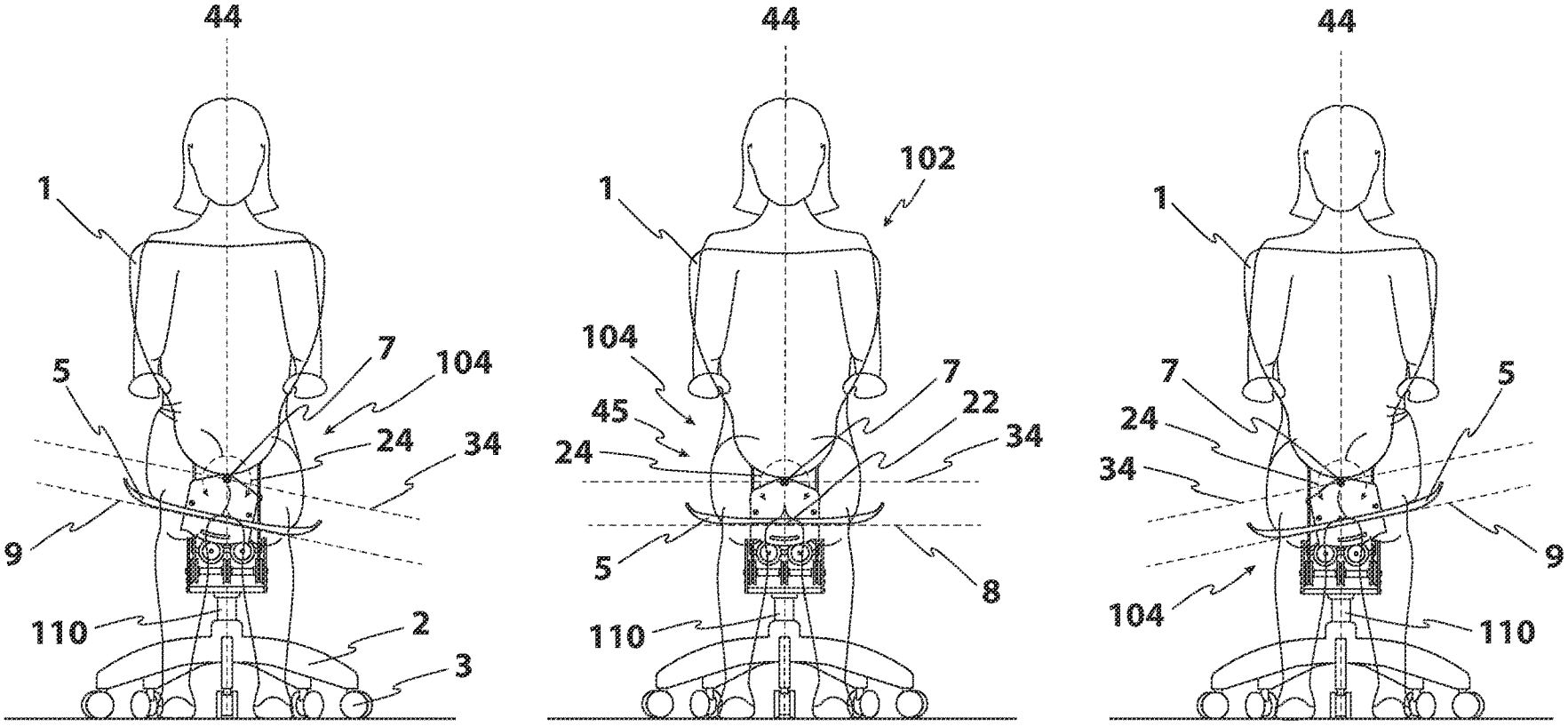
FIG. 3 is a front plan view, cut away of the ergonomic motion chair of FIG. 2 showing possible side-to-side movement defining a right swing position, a side-to-side neutral position, and left swing position of the chair with the chair in the forward-and-back neutral position of FIG. 2 and with a person shown sitting in the ergonomic motion chair for orientation.
Figure 4:
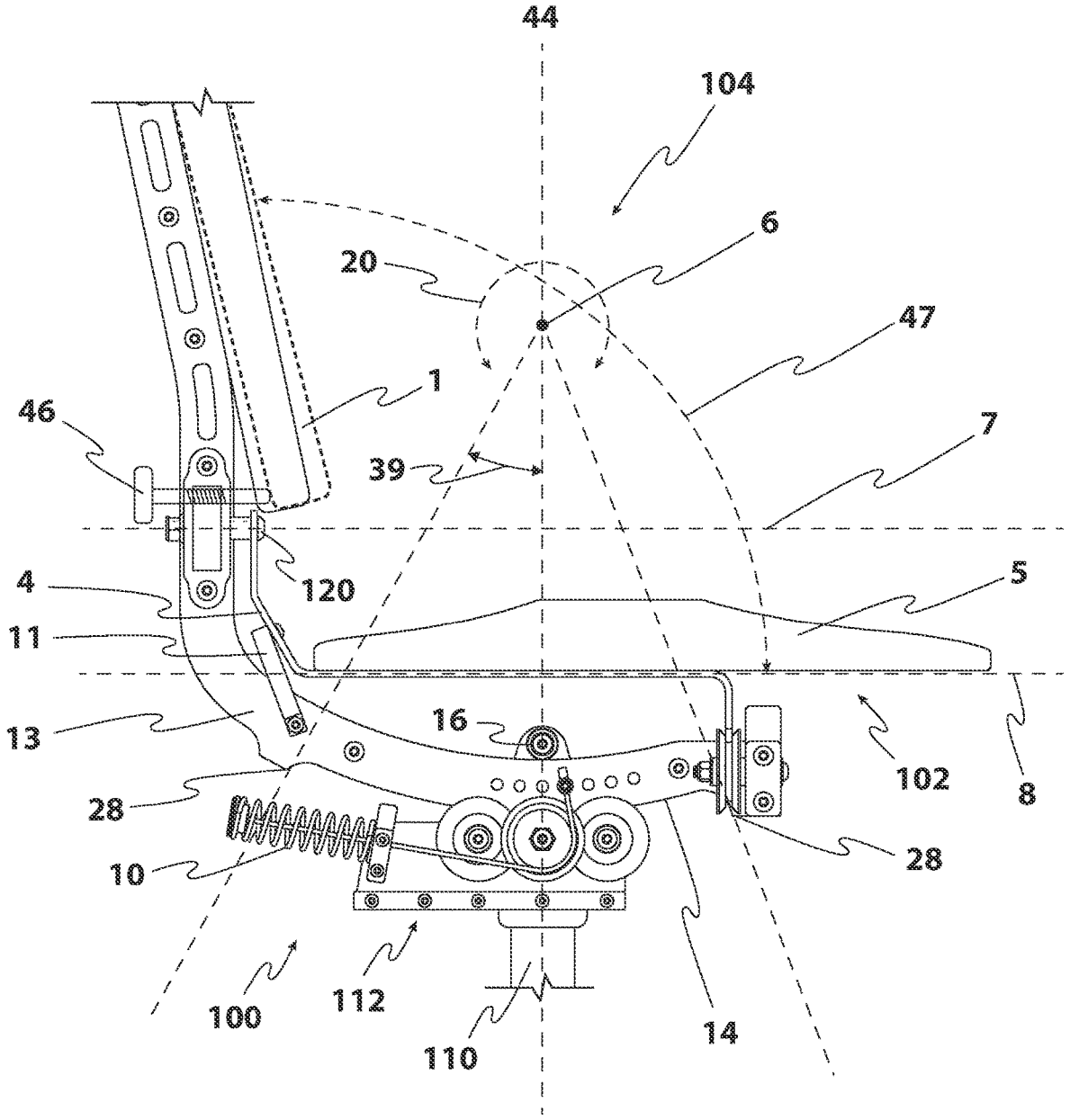
FIG. 4 is an enlarged partial, left side view, cut away of the ergonomic motion chair of FIG. 1 showing a possible forward-and-back pivot axis positioned above a seat plane.

As best shown in FIG. 3, the ergonomic motion chair 100 may include a seat 5 defining a seating surface, the seat operably secured to a frame with a structure that allows the seat plane 8 to be easily and dynamically positioned and adjusted side-to-side 9 from a side-to-side neutral position 102 along a defined pivot axis 7 that is positioned above the seat plane 8. Preferably and as best shown in FIGS. 2 & 4, the ergonomic motion chair 100 may also include a second pivot 6 that is also positioned above the seat plane 8 that allows the seat plane 8 to be easily and dynamically positioned and adjusted about it forward-and-back from a forward-and-back neutral position 104 to provide forward-and-back movement of the seat. A side-to-side biasing structure 11 (FIGS. 4, 9, 14) and a forward-and-back biasing structure 10 (FIGS. 1, 2, 4, 11-13) may also be provided to control and regulate movement of the seat 5 about the second pivot axis 6. Exemplar structures for providing an ergonomic motion chair 100 with this range of controlled, dynamic, regulated and adjustable movement are discussed in greater detail below.

General Construction

Figure 1:
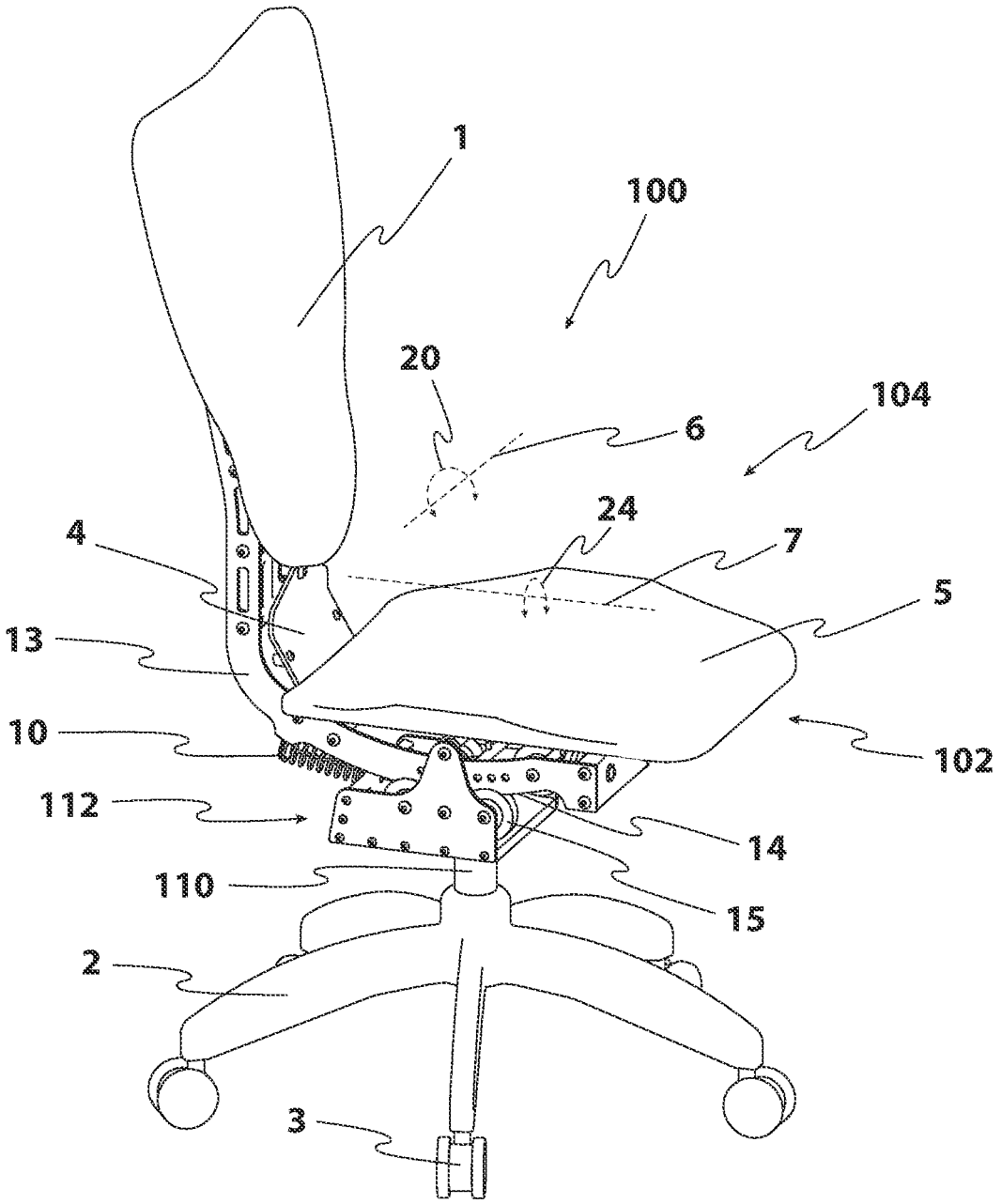
FIG. 1 is a left, front isometric view of an ergonomic motion chair in accordance with an exemplar first embodiment of the present invention.

Referring to FIG. 1, the ergonomic motion chair 100 may include a base 2 that supports an upwardly extending pole 110 or the like. Conventional wheels 3 or casters, with or without locking structures, may be attached to the base for engaging the floor upon which the ergonomic motion chair 100 rests. The pole 110 generally defines a longitudinal centerline 44 (FIGS. 2-5) extending upward therefrom. The seat 5 and seatback 1 operably engage an elongated seat spine frame 13, and the spine frame 13 operably engages a base mount 112 secured to the pole of the base.

Side-to-Side Swinging Structure

The seat 5 is moveable relative to the spine frame 13 and seatback 1 and may be padded and/or contoured as desired to comfortably fit a user. The seat 5 may have a left side and a right side that defines a left-to-right center 22 (FIGS. 5, 6, 15 & 20). The seat 5 provides a generally flat seating surface that defines the seat plane 8 as being aligned substantially parallel to the generally flat seating surface and positioned along a lower most surface of the seat 5, when in use and/or when not in use by a user, as best shown in FIGS. 4 & 6 when the ergonomic motion chair 100 is in its forward-and back neutral position 104 and side-to-side neutral position 102.

Figure 6:
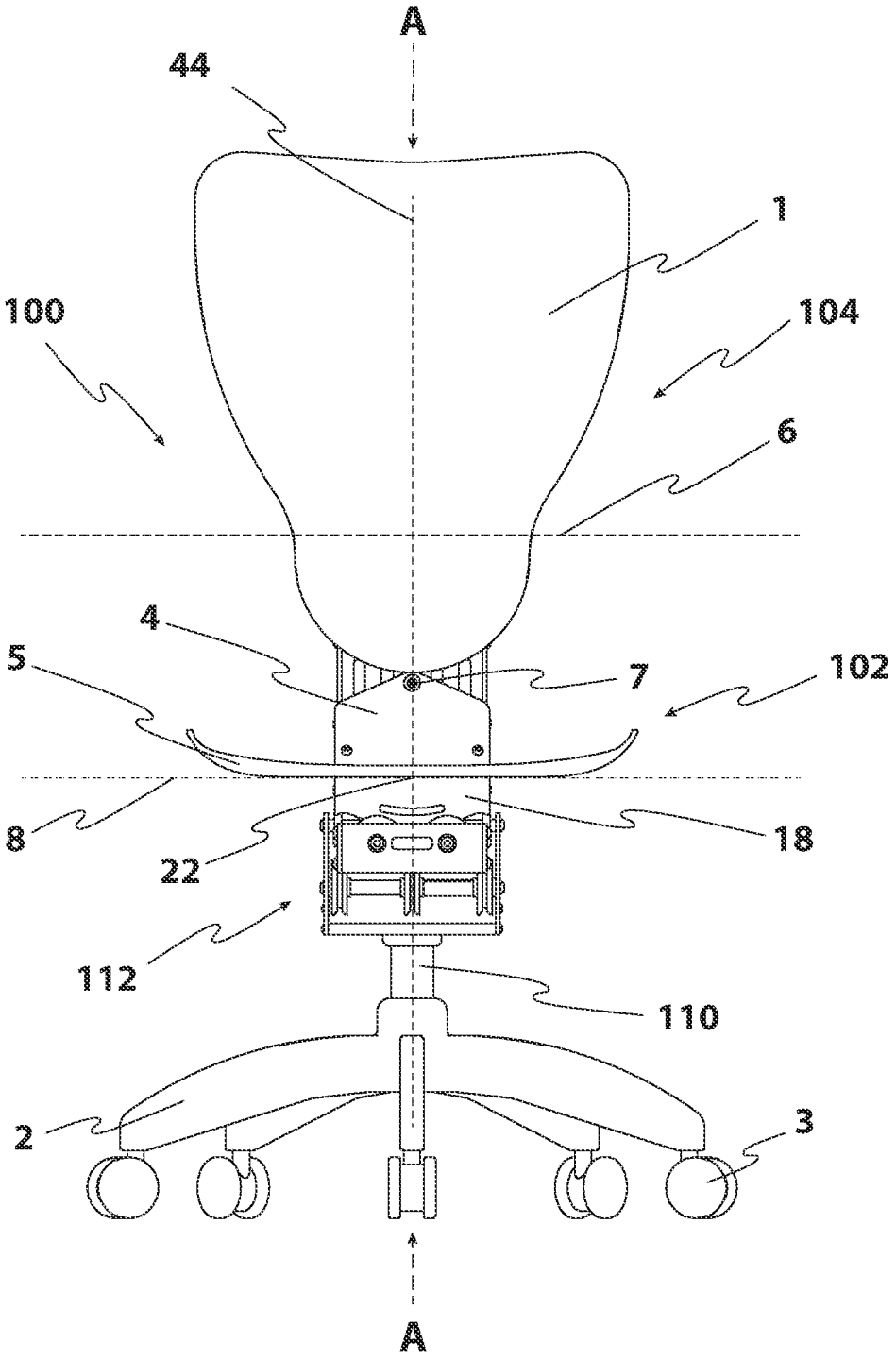
FIG. 6 is a front, plan view of the ergonomic motion chair of FIG. 1 with the ergonomic motion chair in the forward-and-back neutral position of FIG. 2 and the side-to-side neutral position of FIG. 3.
Figure 7:
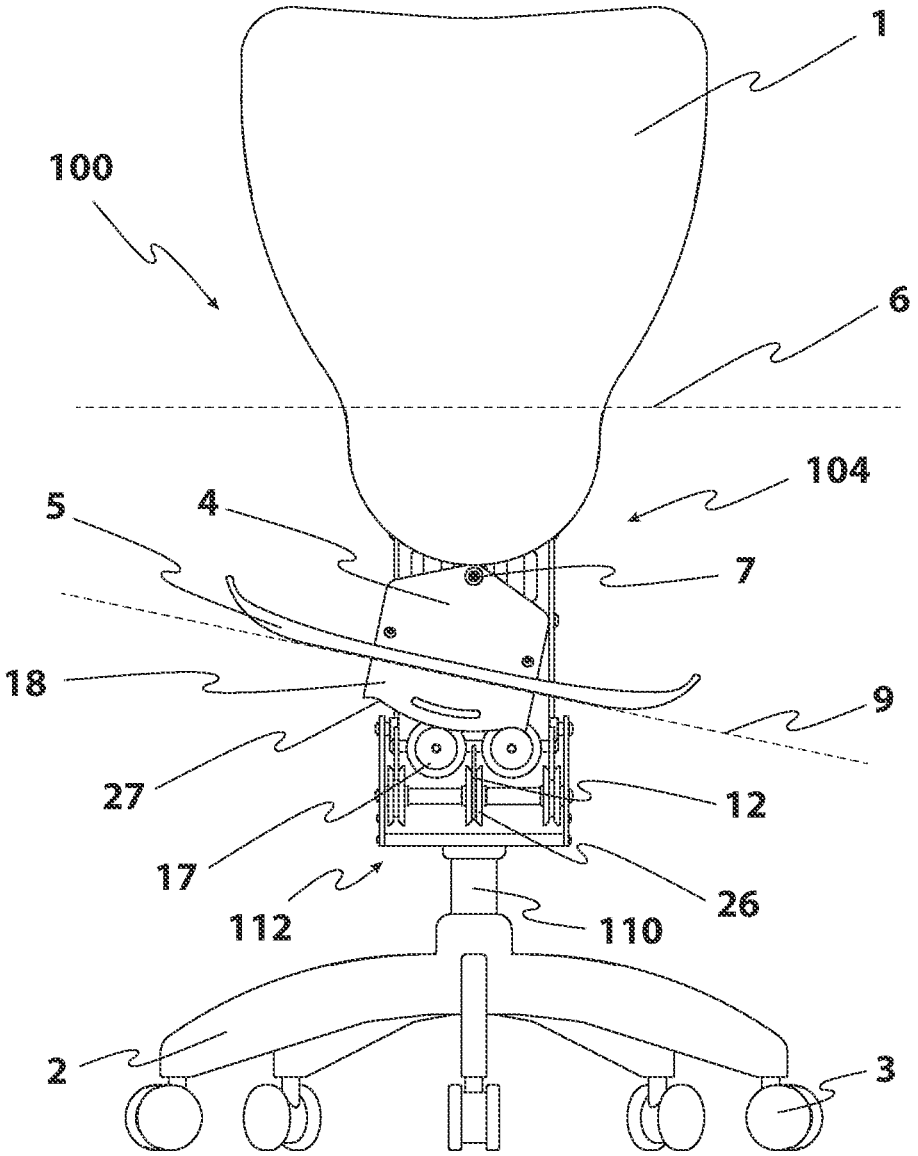
FIG. 7 is a front, plan view, cut away, of the ergonomic motion chair of FIG. 1 with the ergonomic motion chair in the forward-and-back neutral position of FIG. 2 and the right swing position of FIG. 3.
Figure 8:
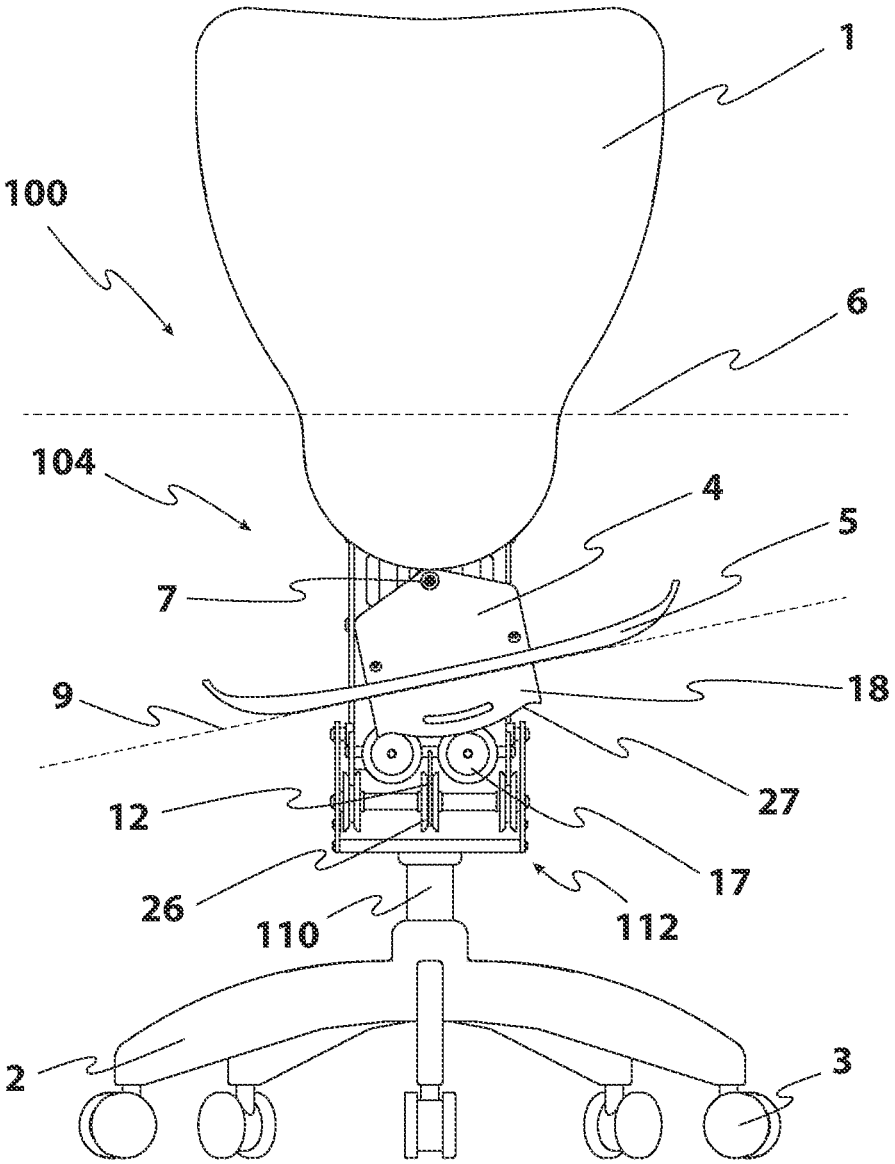
FIG. 8 is a front, plan view, cut away, of the ergonomic motion chair of FIG. 1 with the ergonomic motion chair in the forward-and-back neutral position of FIG. 2 and the left swing position of FIG. 3.

In one embodiment, the seat 5 is operably secured to a seat plate 4 that is pivotably secured to the spine frame 13 as best shown in FIGS. 4 and 6-9. The seat plate 4 is pivotally secured at one end at the spine frame 13 with a pin 120 (FIG. 14, 15) or the like. The opposite end of the plate 4 includes a downwardly extending edge 18 that defines an arcuate rail 14 for operably engaging wheels 17 operably secured to the spine frame to define a swing arc structure 27 as best shown in FIGS. 7 & 8.

Exemplar Embodiment 2

Alternatively and as best shown in FIGS. 19 and 20, a second possible embodiment of the ergonomic motion chair 100' may have a seat plate 41 that includes forward and back arcuate cams 18, or the like, extending downward therefrom, and the swing arc structure 27 can include both forward and aft wheels 17, 42 for operably engaging the forward and back cams, thereby allowing the seat to pivot side-to-side along side-to-side pivot axis 7 without requiring a physical pivot pin at the axis 7. It is appreciated that the seat plate 41 may be operably secured to be aligned and side-to-side swing operable with the fore and aft wheels 17, 42, which may be operably secured to the spine frame 13 via operable securing structures 43. Of course, the location of the wheels and engaging frame elements may be reversed with the wheel's operably secured to the seat plate and the cam embedded in the frame.

Figure 9:
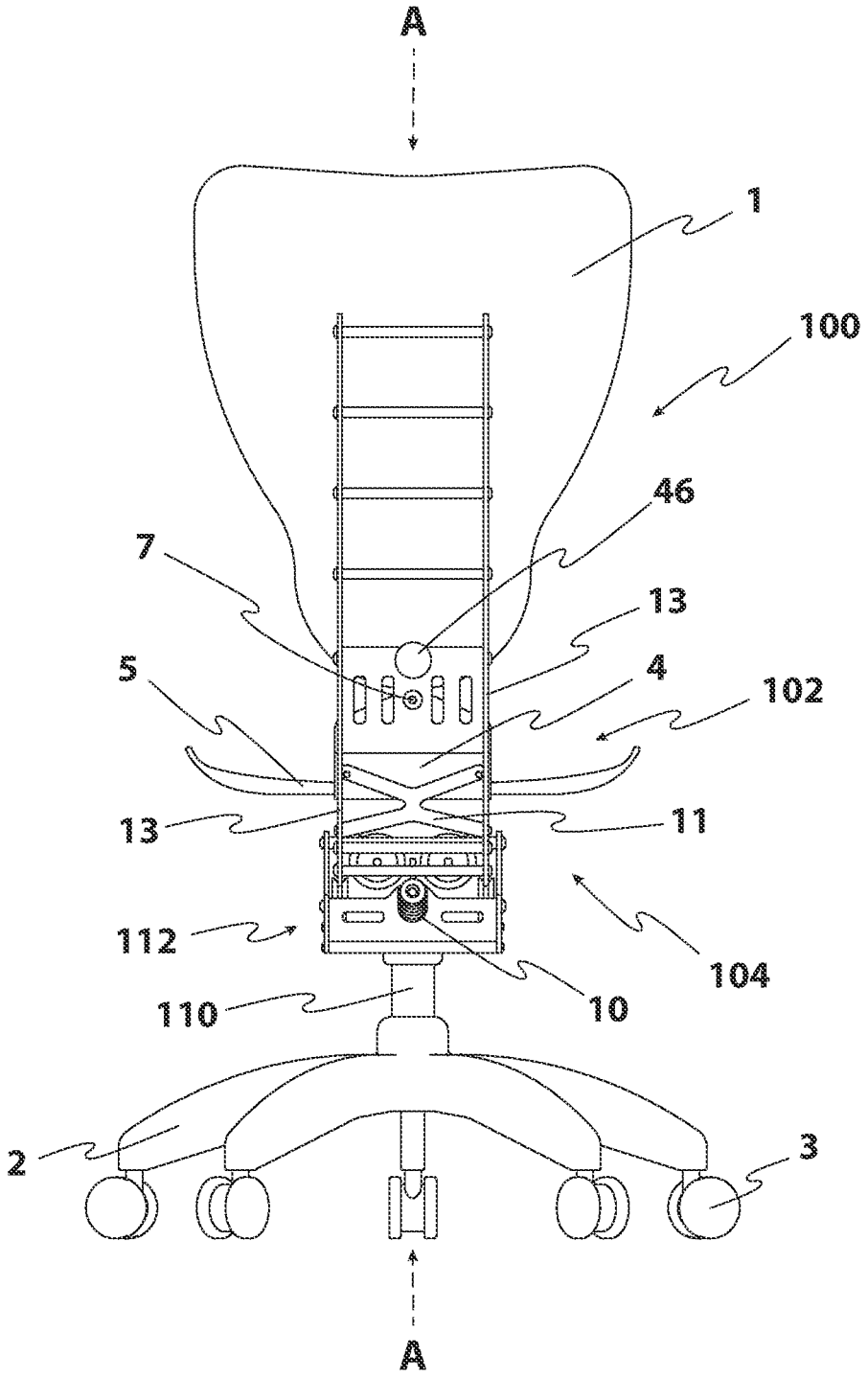
FIG. 9 is a back view of the ergonomic motion chair of FIG. 1 with the ergonomic motion chair in the forward-and-back neutral position of FIG. 2 and the side-to-side neutral position of FIG. 3.

It can be appreciated that the structures of the disclosed embodiments allow the seat 5 to pivot or swing about side-to-side pivot axis 7 in the direction of arrow 24 (FIGS. 1, 2, 5 & 20) with fewer structures interfering with a user's ability to sit in the seat. Moreover, because the left-to-right center 22 of seat 5 is positioned below the side-to-side pivot axis 7, gravity will urge the seat 5 to return and rebalance to its side-to-side neutral position 102. Preferably, a resilient biasing structure 11 extends between the spine frame 13 and seat plate 4 as shown in FIGS. 4 & 9, and described above for alternative seat plate 41 (FIG. 19, 20), thereby further urging the seat to its side-to-side neutral position 102 (FIG. 3) and providing a selectable and defined resistance to motion away from the side-to-side neutral position 102 (FIG. 3). Alternative resilient members 11, each having a unique resistance quality, may be provided to allow a user to adjust the biasing force as desired. An adjustable alternative biasing force structure may also be provided.

Figure 5:
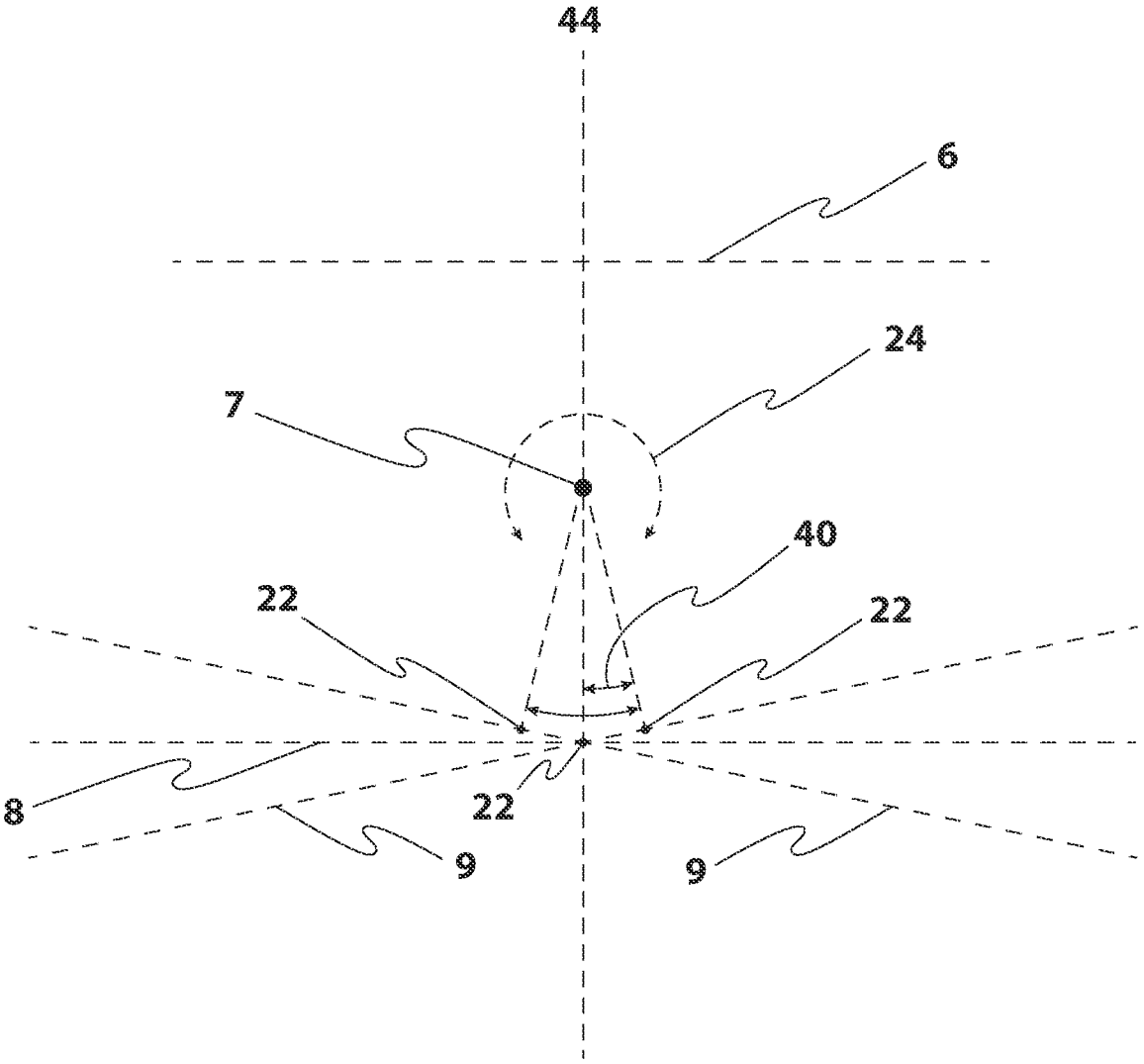
FIG. 5 is a schematic front view of the geometry of the ergonomic motion chair of FIG. 1 showing a possible side-to-side pivot axis positioned above the seat plane of FIG. 3 and FIG. 4.

Referring to FIG. 5, the side-to-side swinging of the seat plane 8 relative to the side-to-side pivot 7 is shown schematically. The side-to-side pivot axis is positioned above the seat plane 8, when in the neutral position and above the left-to-right center 22, and the structure preferably allows the side-to-side pivot angle 40 to be about 10 degrees or between 5 and 15 degrees in either direction to allow the activated side-to-side swung seat plane 9 and travel of left-to-right center 22 to be achieved as shown.

Forward-and-Back Gliding Motion Structure

Figure 10:
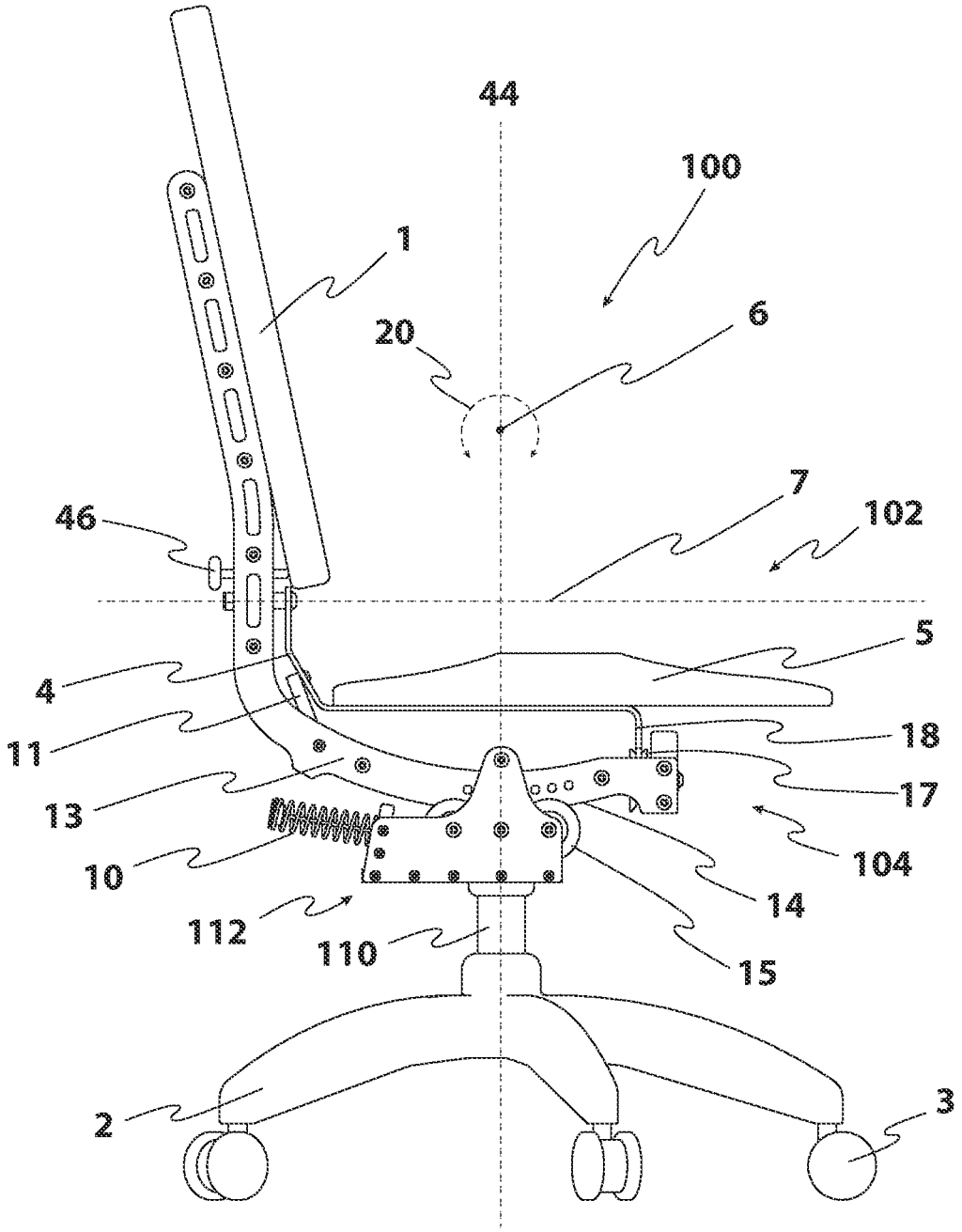
FIG. 10 is a left side plan view of the ergonomic motion chair of FIG. 1 in the forward-and-back neutral position of FIG. 2 and the side-to-side neutral position of FIG. 3.
Figure 13:
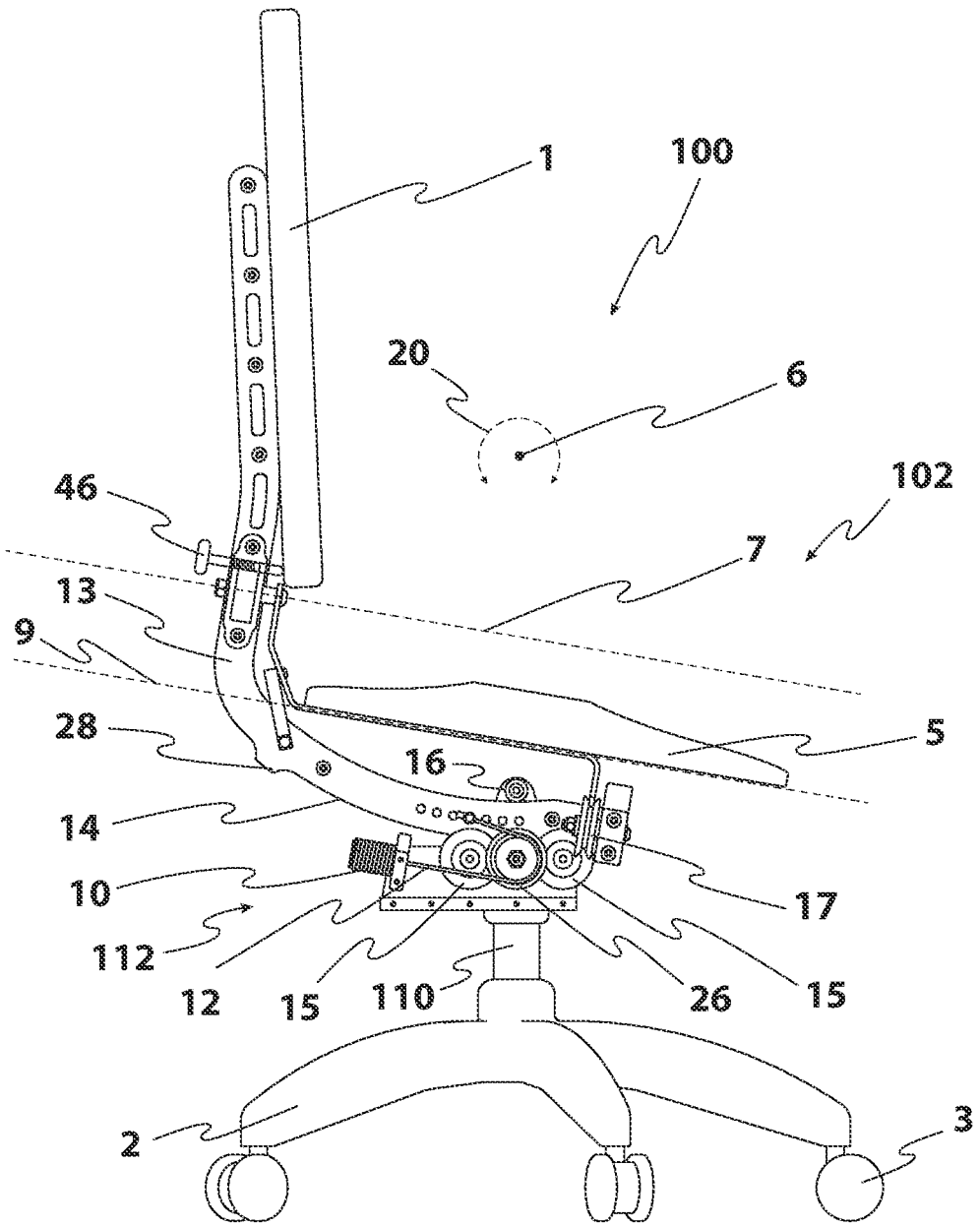
FIG. 13 is the left side plan view of the cut-away view of the ergonomic motion chair of FIG. 11 with the ergonomic motion chair in the forward position of FIG. 2 and the side-to-side neutral position of FIG. 3.
Figure 14:
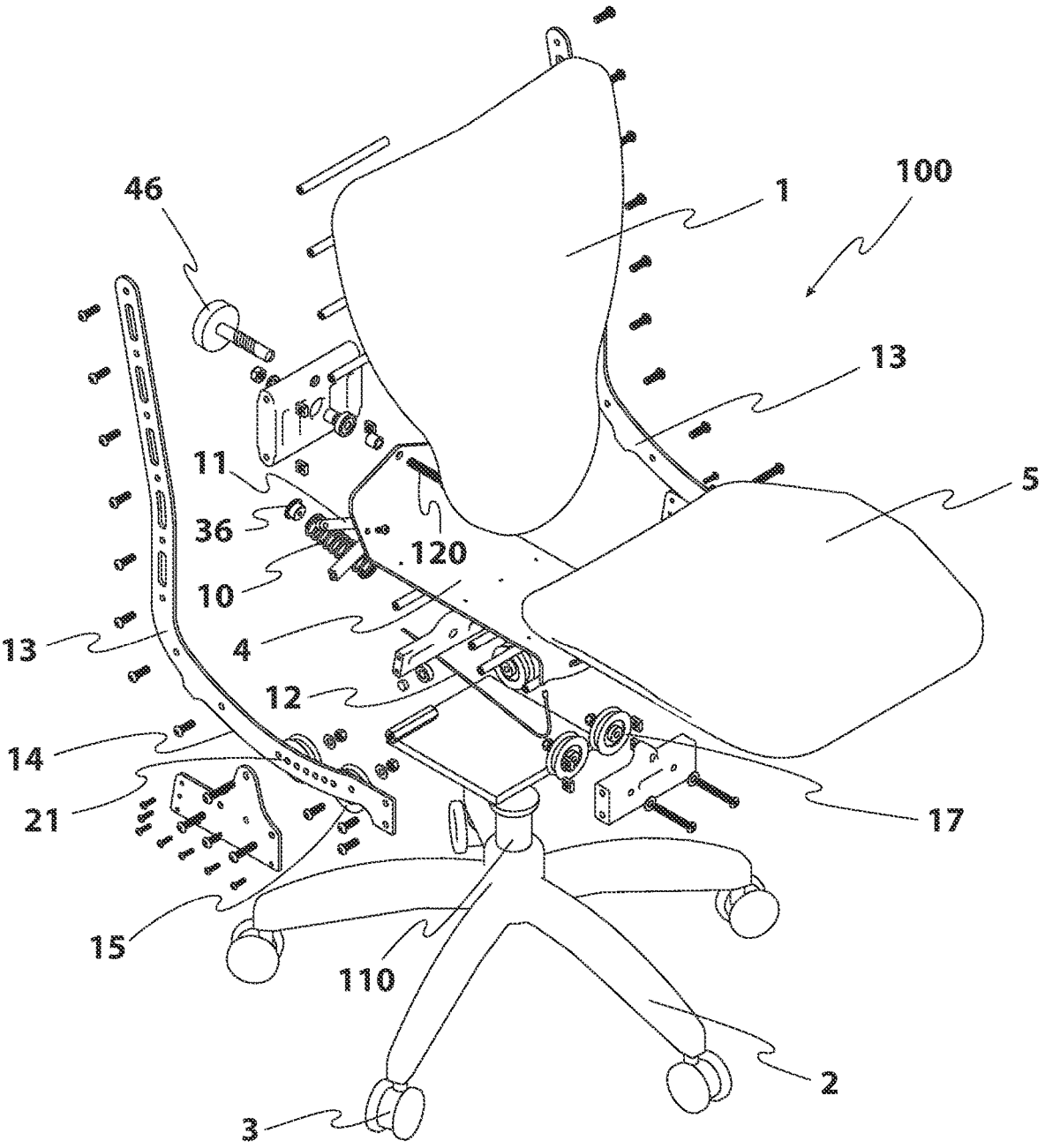
FIG. 14 is a left, front exploded view of the ergonomic motion chair of FIG. 1.
Figure 15:
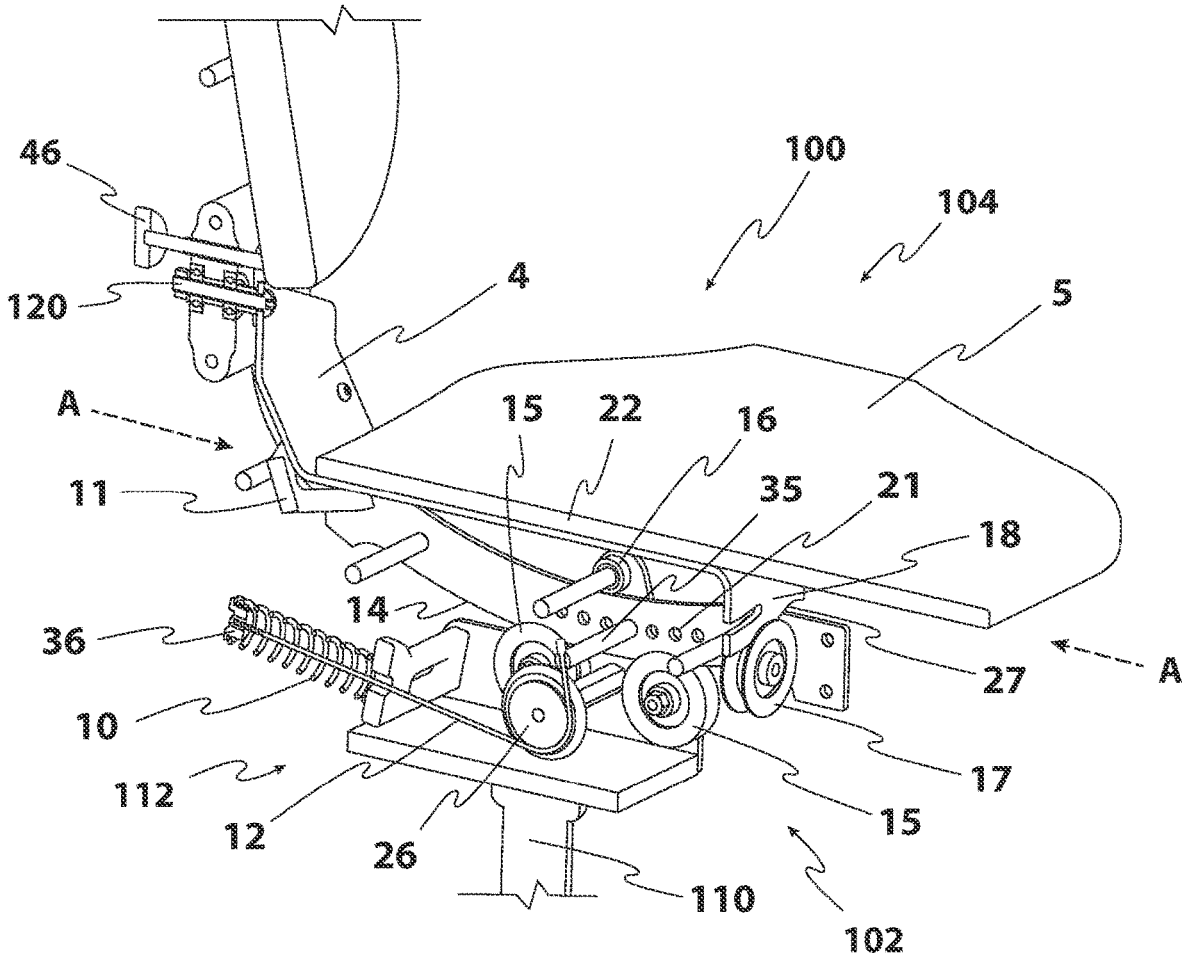
FIG. 15 is an enlarged, cut-away, isometric view of a portion of the ergonomic motion chair of FIG. 1 taken along arrow A-A of FIGS. 6 & 9 with the ergonomic motion chair in the front-and-back neutral position of FIG. 2 and the side-to-side neutral position of FIG. 3.
Figure 16:
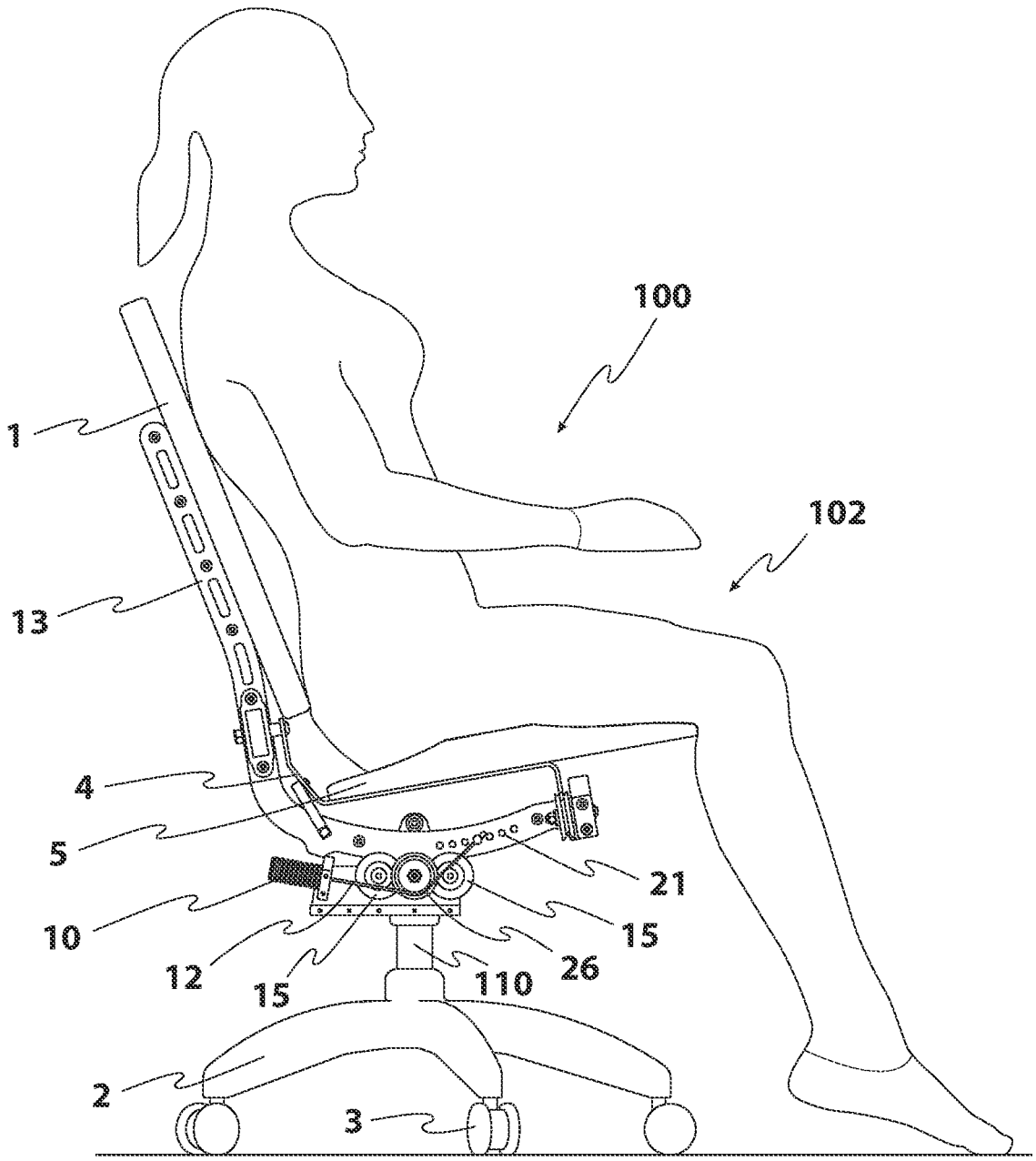
FIG. 16 is the left, side plan view of the cut-away view of the ergonomic motion chair of FIG. 12 with a user shown sitting in the ergonomic motion chair to demonstrate possible fit and orientation.
Figure 17:
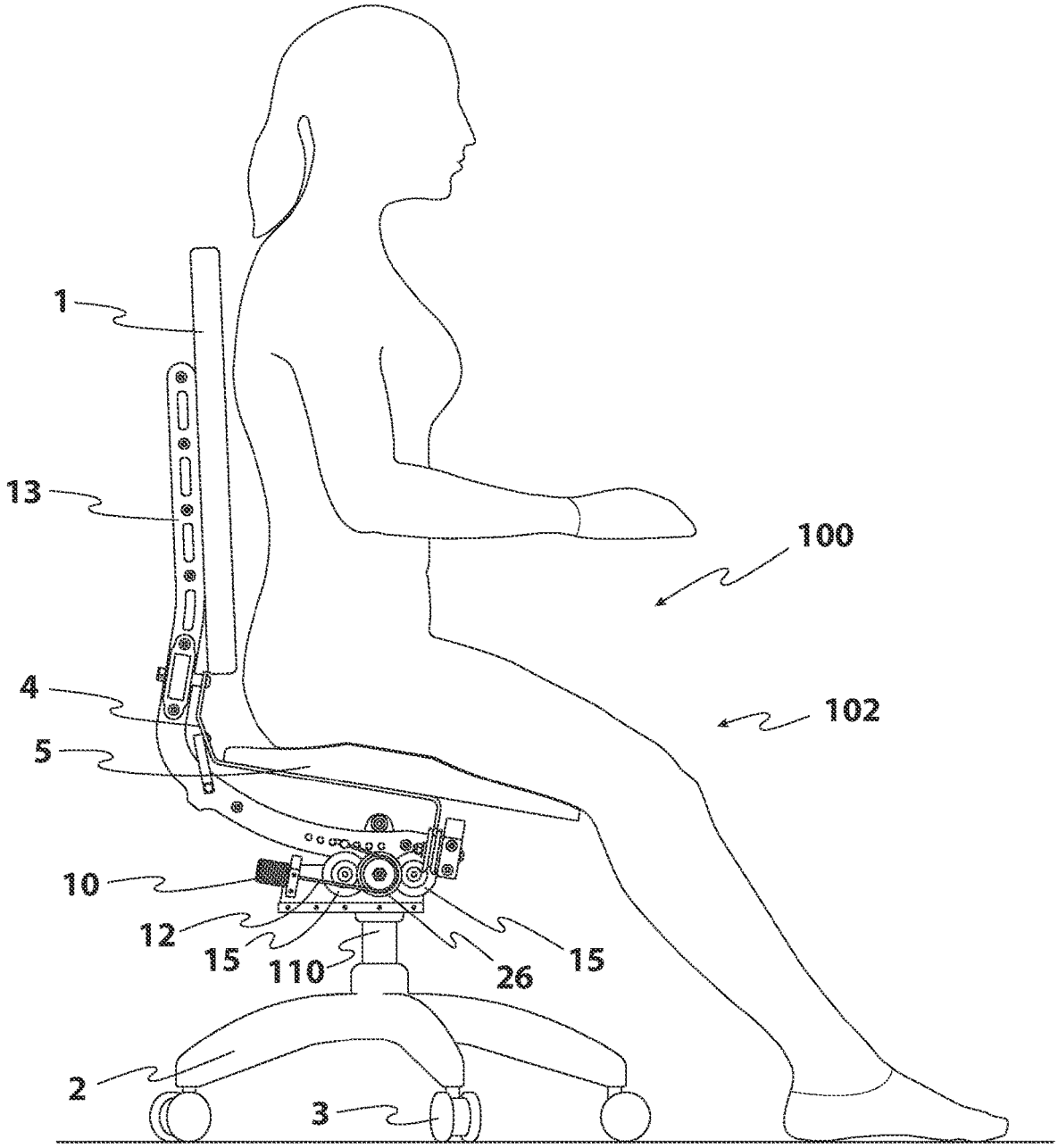
FIG. 17 is the left, side plan view of the cut-away view of the ergonomic motion chair of FIG. 13 with a user shown sitting in the ergonomic motion chair to demonstrate possible fit and orientation.

As best shown in FIGS. 9 & 14, the spine frame 13 may be formed by two parallelly-aligned curved rails joined together. The edges of the rails extend downward to define an arcuate rail 14 that operably engage wheels 15 operably secured to the base mount 112 as best shown in FIGS. 10, 13 & 15. A guide structure, or wheel 16 (FIGS. 11-13 & 15) or other control structure or control assembly may engage a portion of the rail to operably hold the spine frame 13 in place on the base mount 112, while still allowing the spine frame 13 to glide forward-and-back along the forward-and-back pivot axis 6. It is appreciated that the location of the wheels and engaging arcuate rail elements may be reversed with the wheels operably secured to the spine frame and the arcuate rails 14 secured to the base.

As best shown in FIG. 4, it can be appreciated that the section of the part having the contour of the edges of the arcuate rails 14 (FIG. 4) can be shaped to provide movement of the spine frame 13 about a virtual or projected axis of rotation such as the forward-and-back pivot axis 6. It can be appreciated that the contour or of the edges or of the arcuate rails 14 (FIG. 4) may be shaped to deliver the exact location of the virtual, projected pivot axis 6 above the seat plane 8 depending on the arcuate rail radius or the like. This contour shaping can also be applied to the side-to-side axis 7 delivered by swing arc structure 27 (FIG. 7, 8). Preferably, pivot axis 6 is aligned with the longitudinal centerline 44 of the frame and allows the seat plane 8 to move about the axis 6 in the direction of arrow 20 (FIGS. 1, 2, 4, 10-13 & 20) as shown, and as shown operably with the activated seat plane 9 (FIGS. 2,3,5,7,8,12,13). More preferably, the arcuate rails 14 of the spine frame 13 are shaped so as to allow for, and optimize for, a glide angle 39 of about 18 degrees or between 10-25 degrees backward from the forward-and-back neutral position and about 10 degrees or between 5 to 12 degrees forward from the forward-and back neutral position. The degrees of freedom along the arcuate rails 14 may be controlled by stopping features or structures such as 28 or the like. For example, a user may alternatively position the arcuate rail at a desired position and engage a structure that holds the arcuate rail at that desired position.

Referring to FIG. 15, the forward-and-back biasing structure 10 may include a cable 12 extending from the base mounting portion 112, around a roller or cable pully 26 (FIG. 7,8 11-13), to the spine frame 13. Spaced apart holes 21, or other fixing structures, along the rails of the spine frame allow a user to pre-select a desired forward-and-back neutral position of the ergonomic motion chair 100 simply by adjusting the attachment point of the cable 12 to a different hole, or desired location, along the spine frame 35. A resilient member such as a spring 10 or the like urges tension of the cable 12, thereby urging the selected hole, or location of the spine frame mount 35, to its lowest most point thereby defining a neutral position.

It can be appreciated that this configuration increases the tension when the seat is moved throughout the range of motion both forward or backward from the neutral position as shown in FIGS. 2, 11-13, 16 & 17. Moreover, an adjustment structure 36 (FIG. 15), or the like, such as a screw and nut operably secured between the spring 10 and cable 12 allows the tension on the cable to be adjusted as desired or pre-set as desired to the user's weight and preference.

Figure 11:
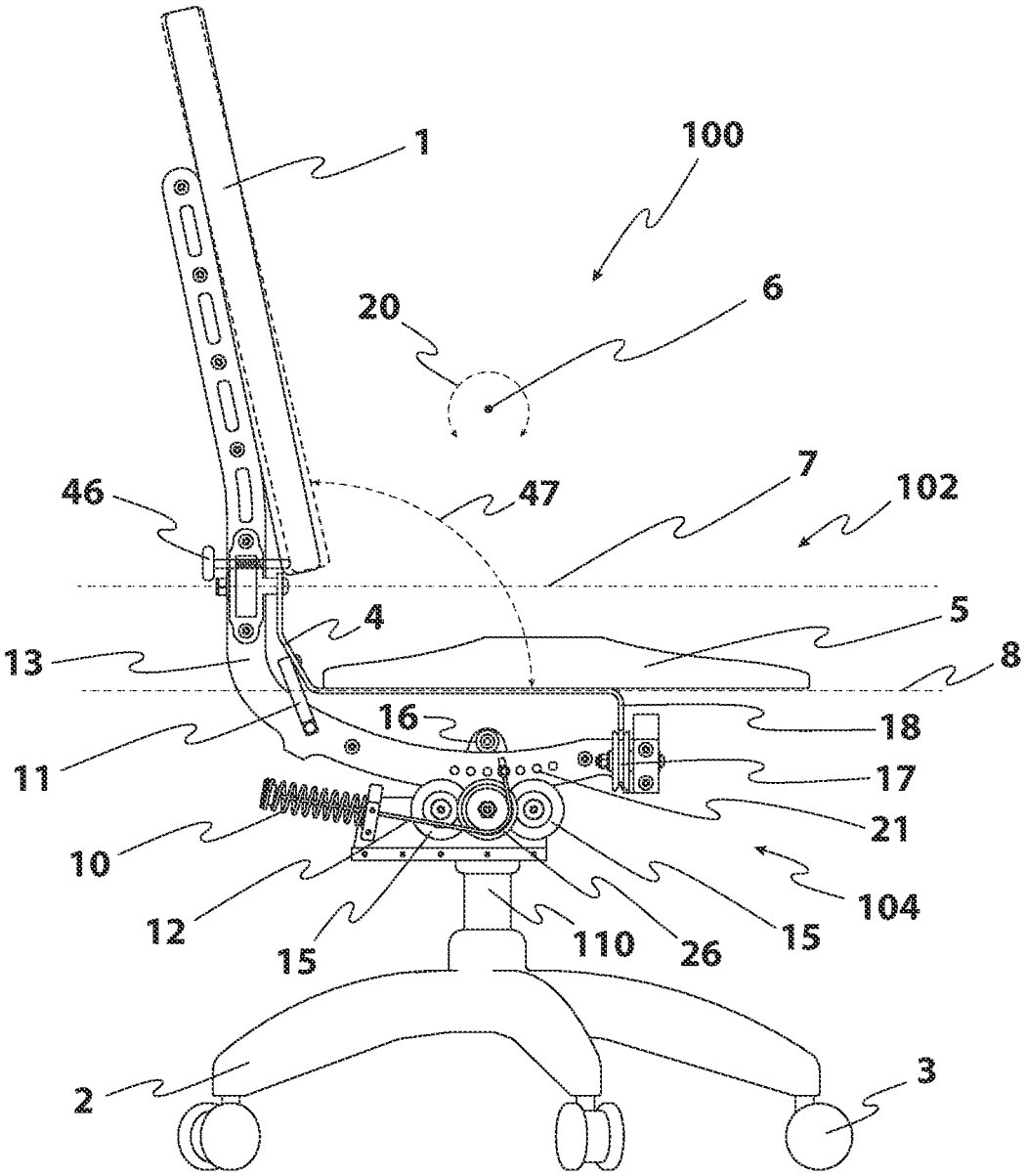
FIG. 11 is the left side plan view of the ergonomic motion chair of FIG. 10, cut away along arrows A-A in FIGS. 6 & 9 to show internal detail.
Figure 12:
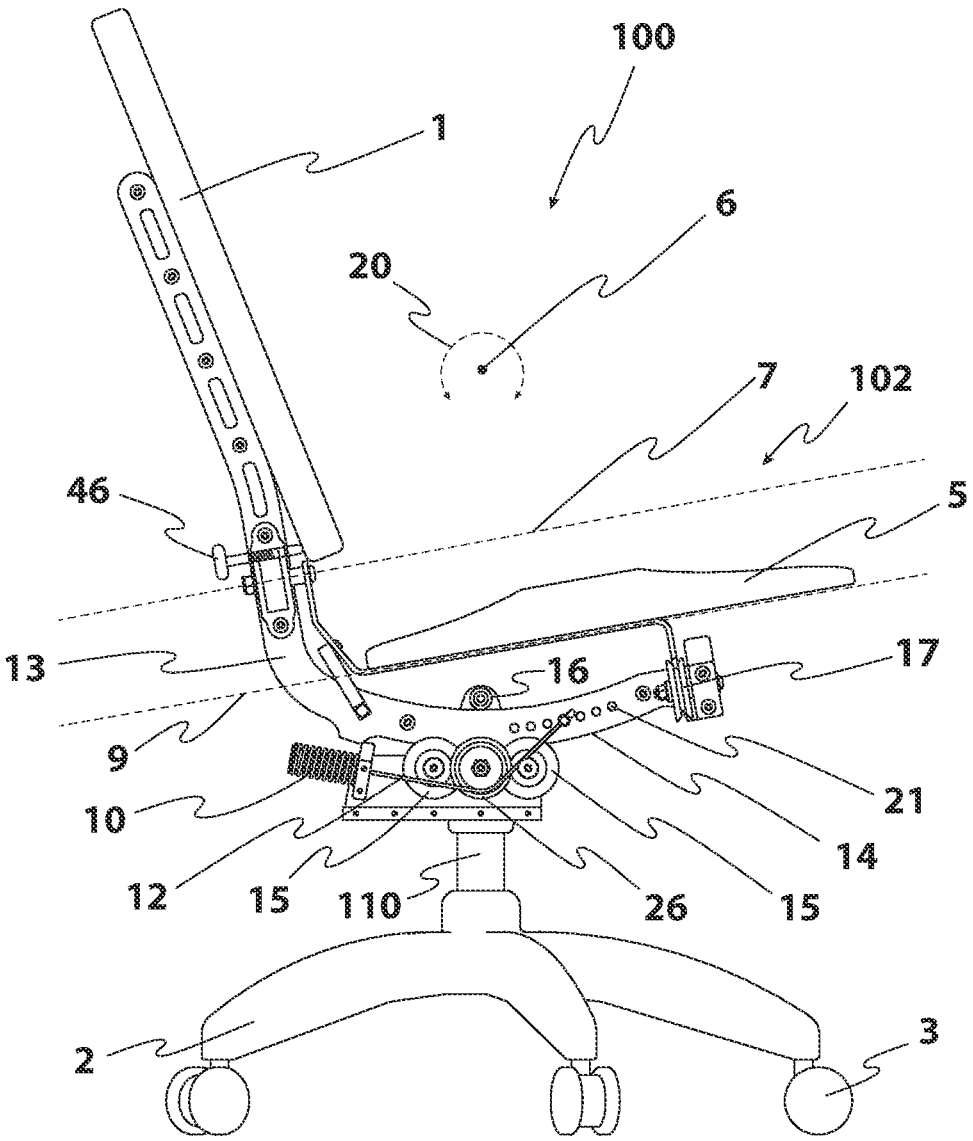
FIG. 12 is the left side plan view of the cut-away view of the ergonomic motion chair of FIG. 11 with the ergonomic motion chair in the back position of FIG. 2 and the side-to-side neutral position of FIG. 3.

If desired, the seatback 1 may be pivotably secured to the spine frame as shown in FIG. 11. An adjustment structure 46, or the like, such as a screw or of the like extending from the spine frame to the seatback can be used to move and hold the seat at a pre-selected, desired position 47 (FIGS. 4 & 11) about its pivot axes thereby further improving comfort and fit of the ergonomic motion chair 100. This preselected position of the seatback may remain in place throughout the entire range of dynamic motion of the ergonomic motion chair 100.

Fit, Use & Operation

Having fully described mechanical aspects of a preferred embodiment of the invention, the improved fit and function of the ergonomic motion chair 100 become apparent. For example, a user resting on the seat may swing side-to-side about a pivot axes located above the seat plane while still offered the ability to move around on the seat, rather than being constrained within a bucket that only pivots forward-and-back.

Moreover, consistent and predictable back support may be provided by an adjustable-position seatback that, once adjusted into a proper fit and position, may move forward-and-back with the seat to maintain the same position relative to the seat throughout this forward-and-back range of motion of the seat. This consistent position of the seat relative to the seatback throughout the forward-and-back range of motion of the ergonomic motion chair, allows the user to maintain optimal fit, comfort and back support throughout the entire range of motion of the ergonomic motion chair 100.

In addition, suspending the seat below a front-to-back pivot axis and a side-to-side pivot axes allows the position of the seat to be infinitely adjustable in any desired position while not forcing a user to balance on the seat to hold a desired neutral position. Rather, gravity, the user's weight and the biasing structures urge the seat into its neutral position. In contrast, seats and buckets resting on balls, universal joints, or other structures that position the pivot axes below the seat require constant action on the part of the user to balance the seat into a desired position.

Figure 18:
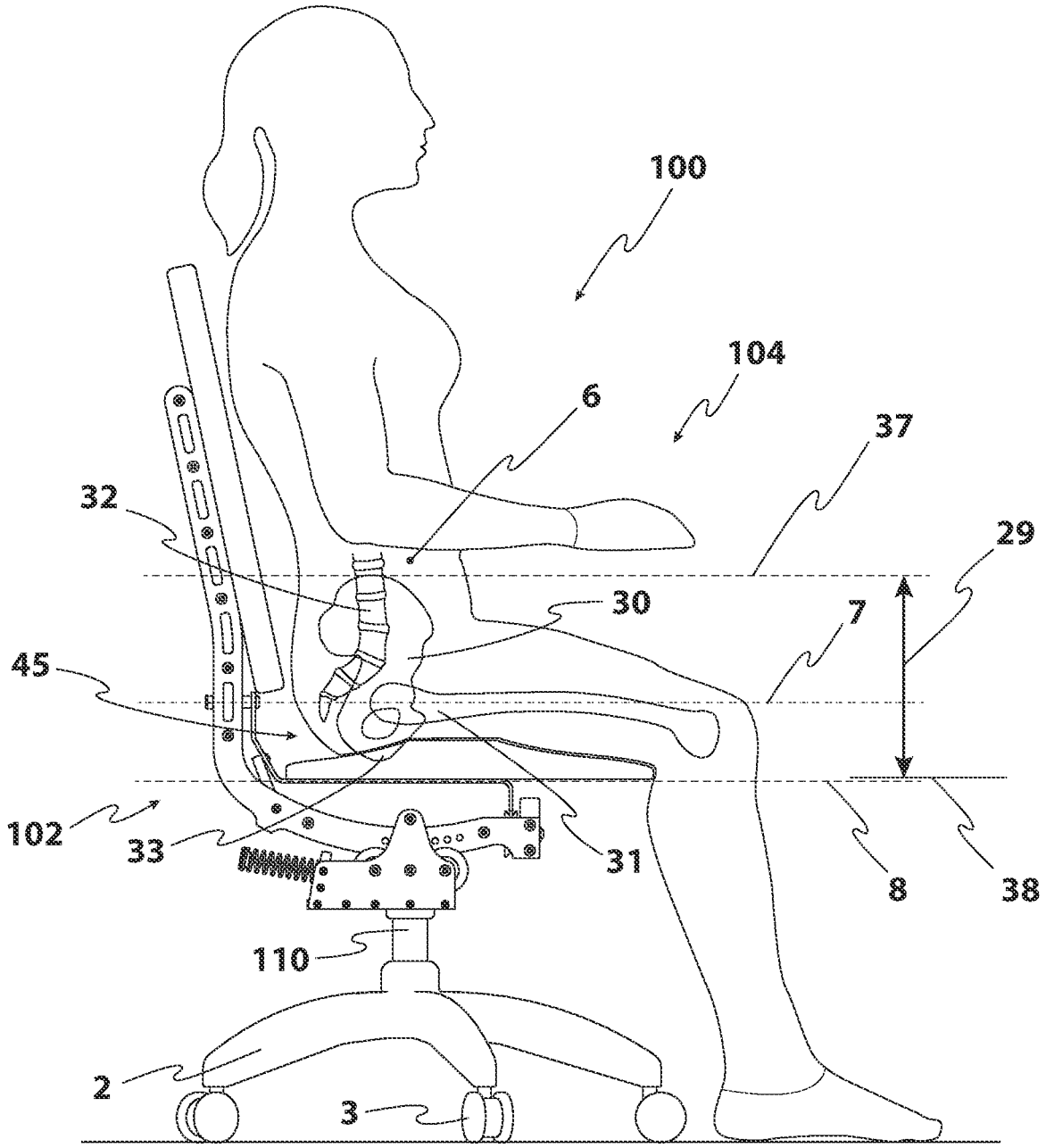
FIG. 18 is the left, side plan view of the ergonomic motion chair of FIG. 10 with a cut away of the user shown sitting in the chair to demonstrate possible fit, orientation, and possible pivot locations relative to a human body anatomy.

Referring to FIG. 18, the optimal location of the first axis of rotation may be in the approximate area where the spine of a human user 32 intersect with the pelvic bone 30 and the possible locations of the first axes of rotation 7 relative to a user are shown. In a preferred embodiment, the optimal range of possible locations 29 of the first axes of rotation 7 may be between the approximate top at of the pelvic bone 30 contained in a human body 37 and the lower most portion 38 of the human body's torso and buttocks 45 (FIGS. 2, 3 & 18) when seated but ideally slightly above the seat plane 8. The axes of rotation may be at or below the Femur bone 31 and the lowest most part of the Ischial Turbosities bone 33 when seated and still above the seat plane 8 to take into consideration the muscle and fat of a user's anatomy and still achieve the benefits of the invention. The user's body may extend below the seat plane 8 as shown, thereby pushing the relative seat plane 8 downward when the chair is in use with some alternative hammock style, or mesh, seat surface covering designs.

The advanced improvements with this design can be more fully understood in FIG. 3 whereby the user is able to move seat plane 8 into the left and right swing positions 9 and release their hip angle 34, and lower torso 45, while maintaining the upper body and upper spine 32 generally in the upright position about the longitudinal centerline 44. This is appreciated because the first axes of rotation 7 is above the seat plane 8 and generally aligned and more closely adjacent to the human spine in the areas of desired mobility and flexibility, along with the side-to-side swing movement can be achieved quickly with low effort and movement of the upper body thereby providing stability in the upper body whereby the arms can maintain freedom with reduced or no restrictions to perform other efforts such as typing simultaneously while moving.

It can be fully appreciated and understood that with the combined pivots and synchronous swinging motions of the first and second axes of movement in tandem together, an infinite number of angles about two axes simultaneously can be achieved that are more fully linked to the natural, intuitive human body movements, in a wide degree of angles, with minimal effort of the user.

Additional Embodiments and Features

Having fully described some of the essential features and benefits of the invention, it can be appreciated that these concepts can be further optimized.

Exemplar Embodiment 3

For example, and referring to FIG. 21-27, an exemplar third possible ergonomic motion chair 100" may include a base 2 that supports an upwardly extending pole 110 or the like. Conventional wheels 3 or casters, with or without locking structures, may be attached to the base for engaging the floor upon which the ergonomic motion chair 100" rests. The pole 110 generally defines a longitudinal centerline 44 extending upward therefrom. Seatback 300 operably engage an elongated seat spine frame 13, and the spine frame 13 operably engages a chair frame 210 operably secured to the pole 110 of the base with pole mount 230.

Figure 24:
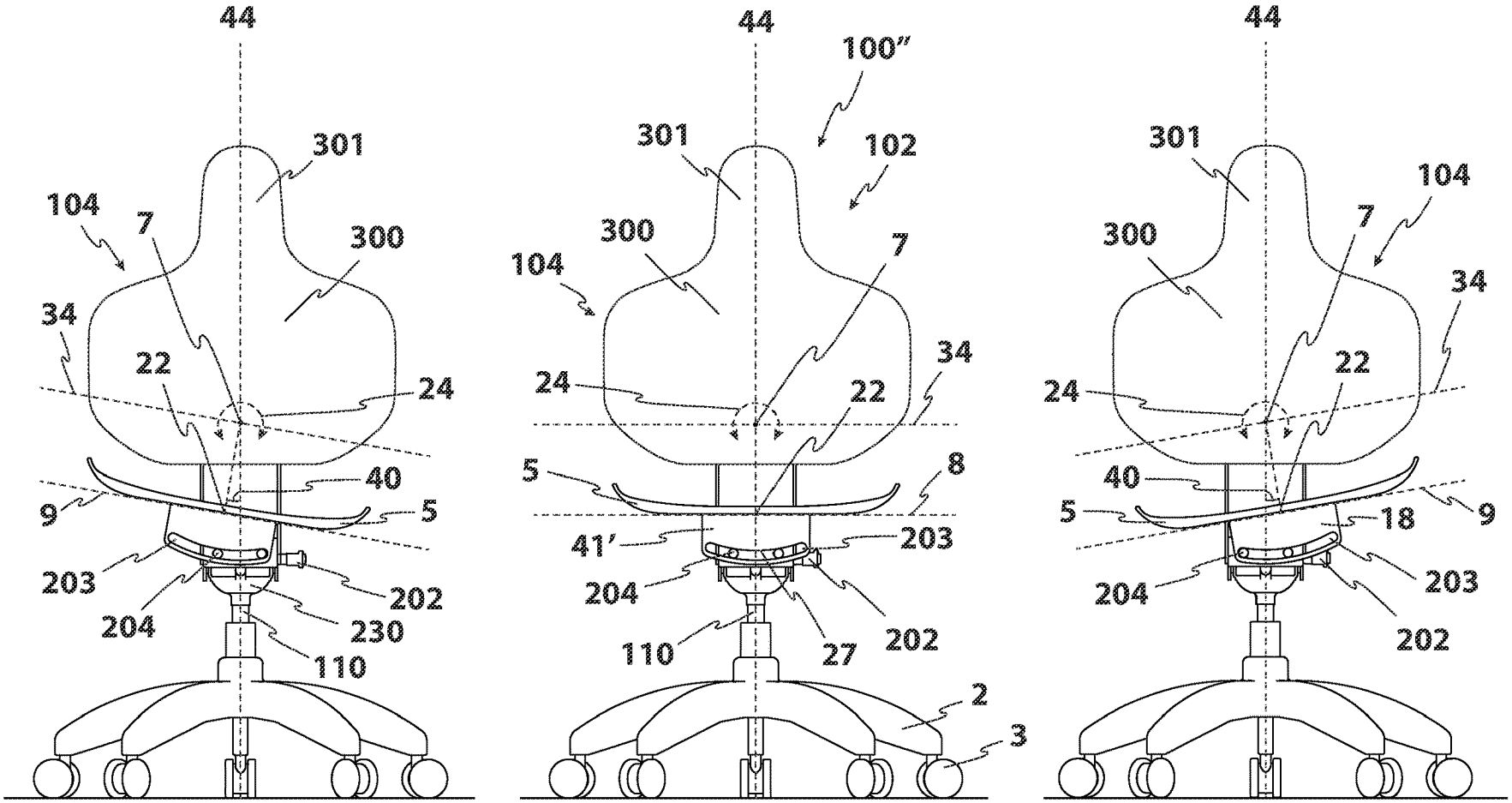
FIG. 24 is a front, plan view of the ergonomic motion chair of FIG. 21 showing possible side-to-side movement defining a right swing position, a side-to-side neutral position, and left swing position of the chair.

The seat 5 is moveable relative to the spine frame 13 and seatback 300 and may be padded and/or contoured as desired to comfortably fit a user. The seat 5 may have a left side and a right side that defines a left-to-right center 22 (FIGS. 24 & 26). The seat 5 provides a generally flat seating surface that defines the seat plane 8 as being aligned substantially parallel to the generally flat seating surface and positioned along a lower most surface of the seat 5, when in use and/or when not in use by a user, when the ergonomic motion chair 100" is in its forward-and back neutral position 104 (FIG. 25) and side-to-side neutral position 102 (FIG. 24).

Figure 22:
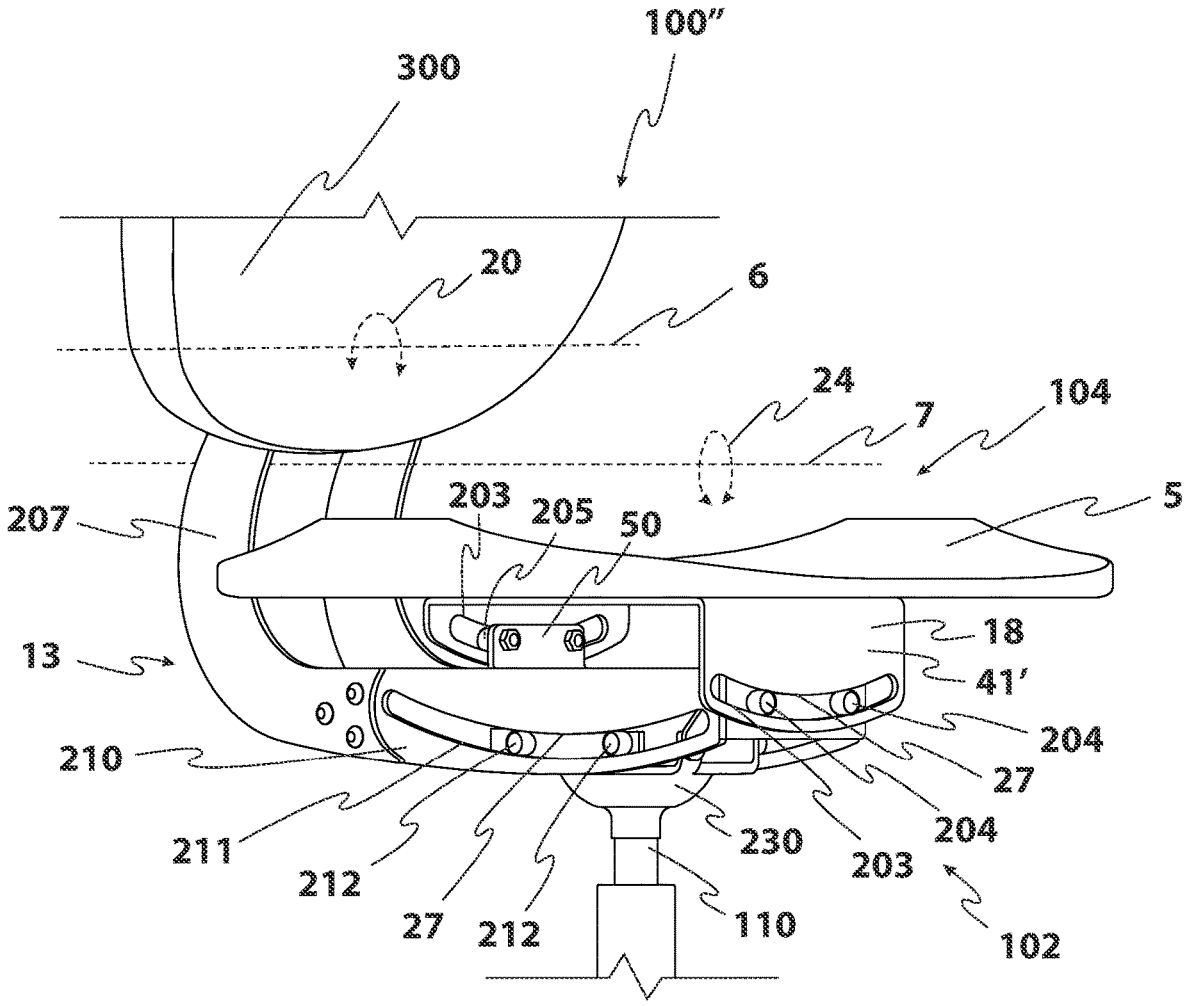
FIG. 22 is an enlarged left, front isometric partial view of the ergonomic motion chair of FIG. 21.
Figure 23:
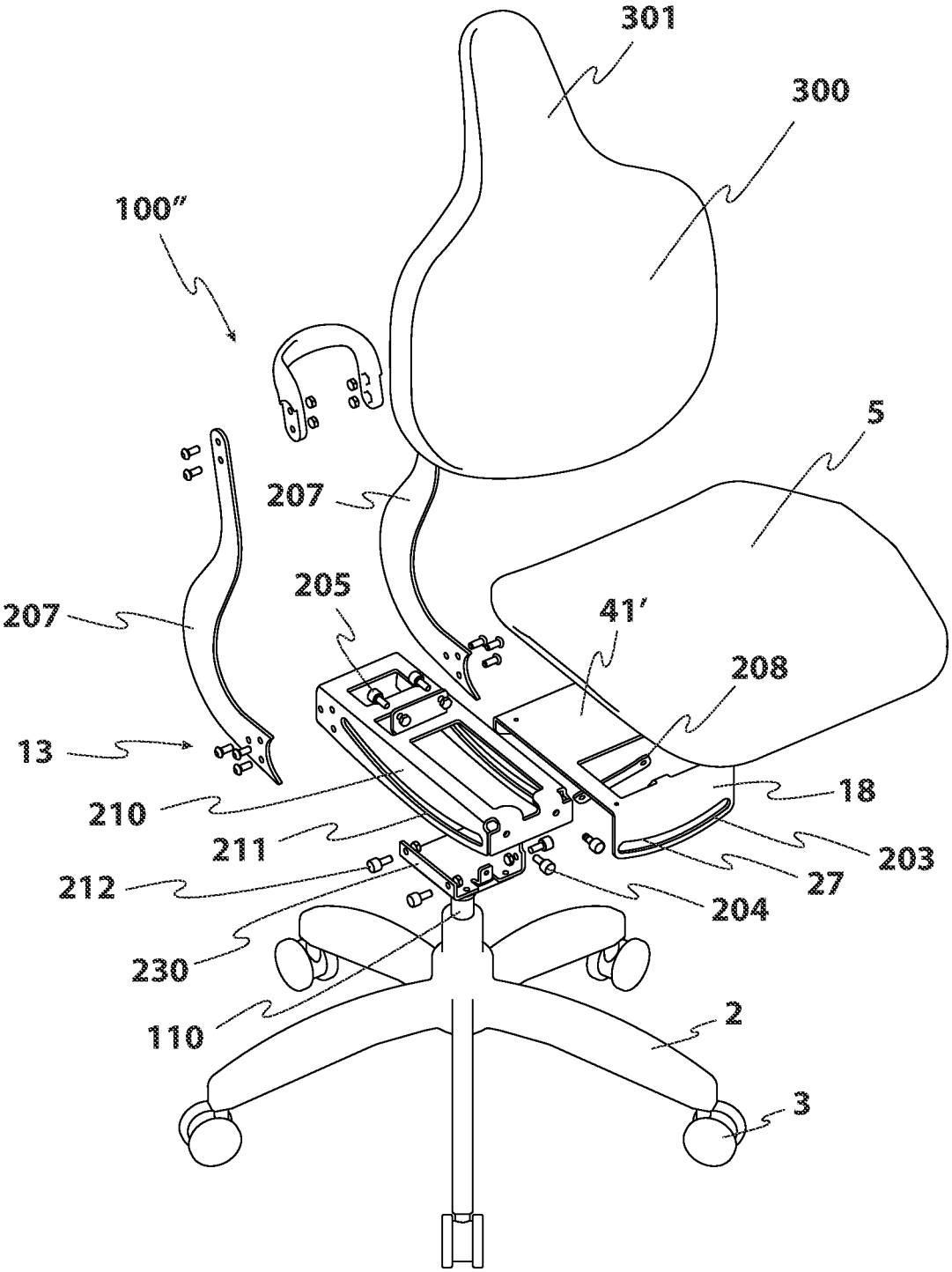
FIG. 23 is an exploded, isometric view of the ergonomic motion chair of FIG. 21.

The seat 5 may be operably secured to a seat plate 41' that is pivotably secured to the chair frame 210 as best shown in FIGS. 22, 23 & 24. The seat plate 41' can include forward and back arcuate cams 18, or the like, extending downward therefrom, and the swing arc structure 27 can include forward and back arcuate structure 203 such bearing slots or the like whereby the arcuate swing structure 27 projects the axis of rotation above seat 5. Front roller bearings 204 and rear roller bearings 205 extend from the chair frame 210 via mounting structures 50, or the like, to align the respective forward and back arcuate structure 203 in the seat plate 41' to allow the seat plate to pivot side-to-side in the direction of arrow 24 about the projected axis 7.

As best shown in FIG. 22, the chair frame 210 may include side arcuate structures 211 such as bearing slots that operably engage front-to-back roller bearings 212 extending from the pole base 230 to glide forward and backwards about axis 6 as with the first preferred embodiment. If desired, a front-to-back movement stop mechanism 202 (FIG. 24, 25, 26) may be provided to allow a user to select and hold a desired forward-to-back position thereby temporarily stopping chair frame 210. The stop mechanism 202 may include a locking pin 206 (FIG. 26) that operably engages mating pin receptors 213. A plurality of spaced apart pin receptors 213 may be provided in pole base 230 (FIG. 25) to allow chair frame 210 a variety of positions to be selected and held.

Figure 25:
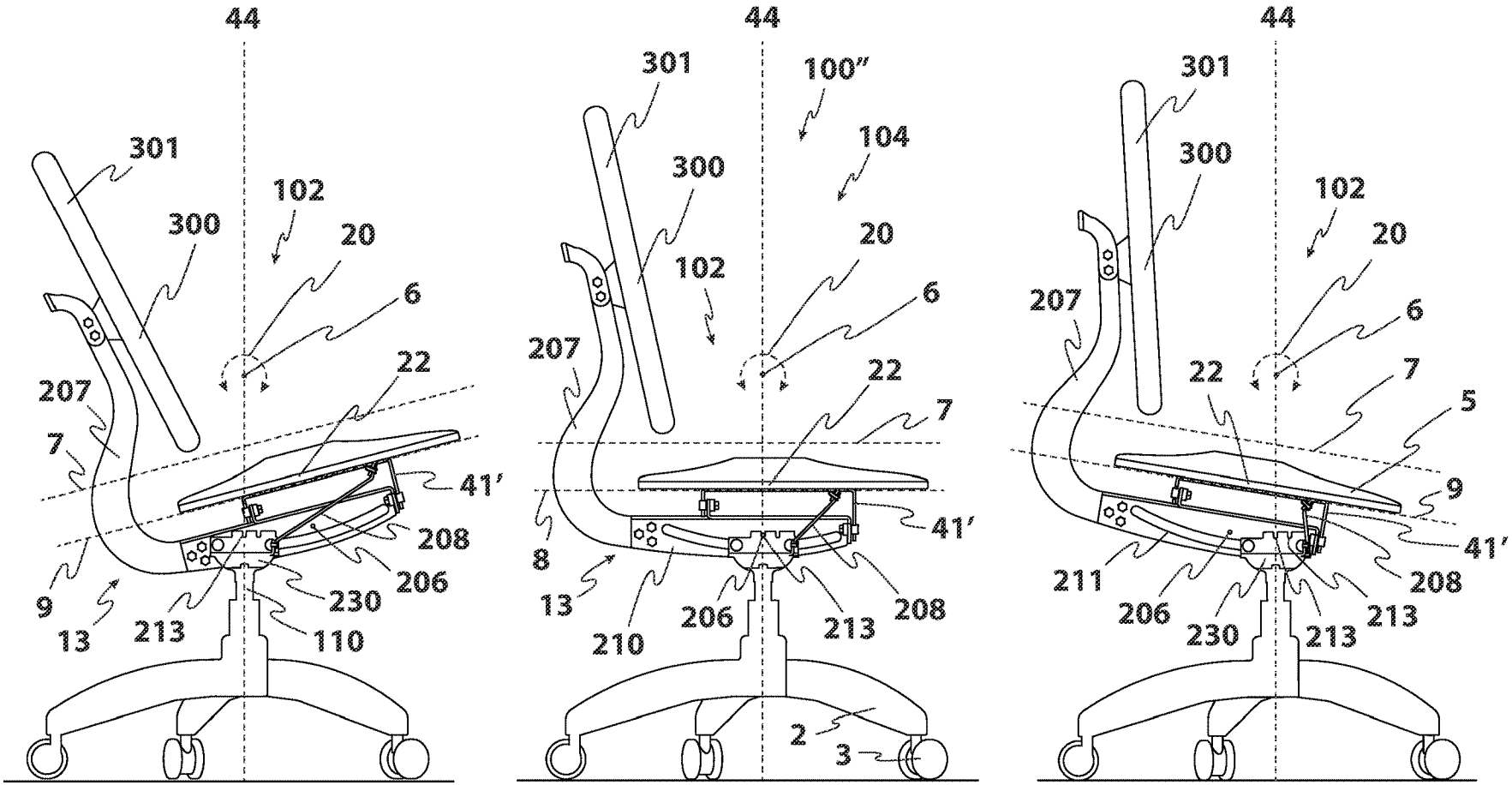
FIG. 25 is a left side, cut-away view of the ergonomic motion chair of FIG. 21 showing possible back-to-front movement defining a reclining back position, a neutral position, and a tilted forward position of the ergonomic motion chair and showing activation of a possible monolithic biasing structure in various positions.
Figure 26:
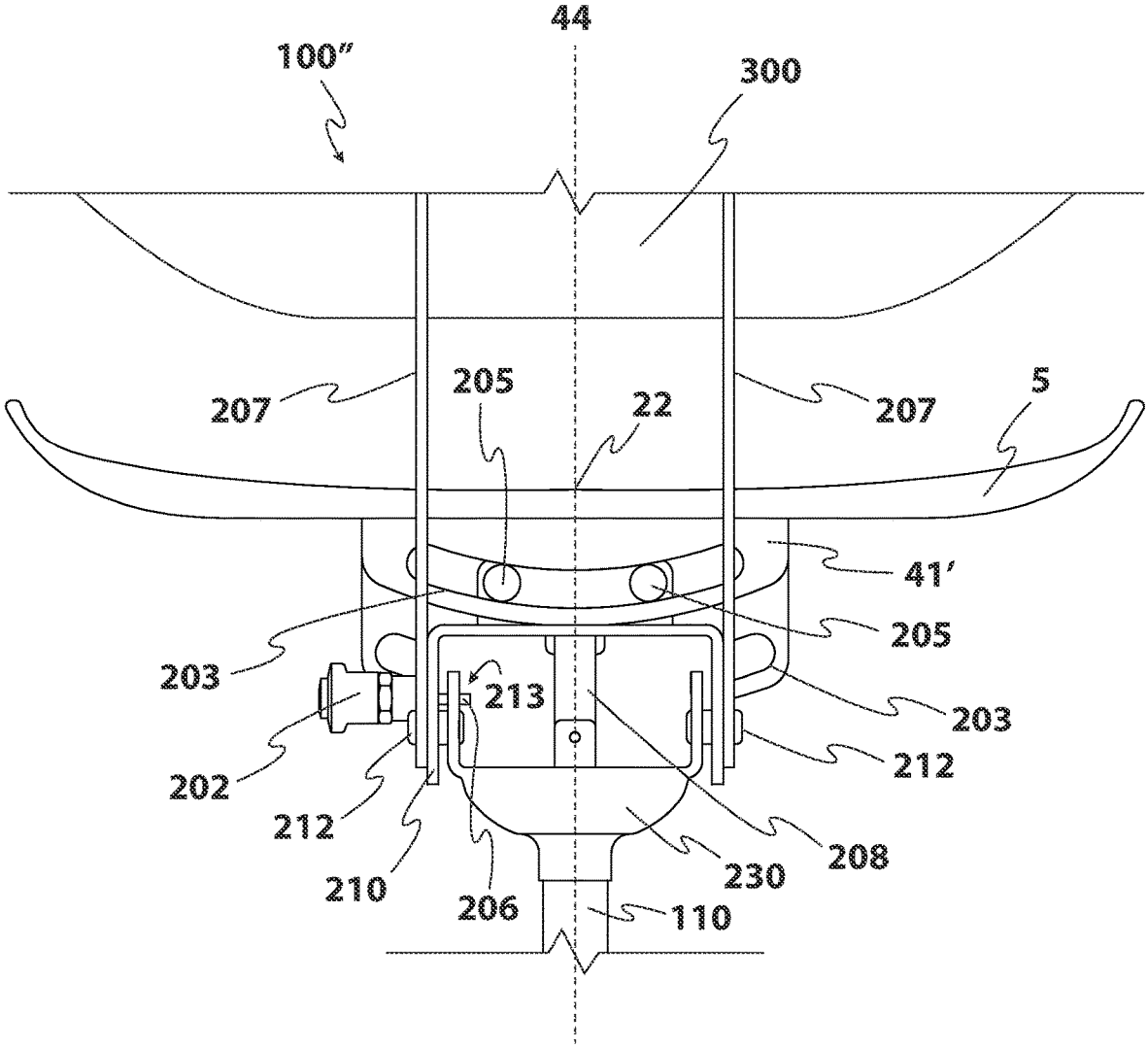
FIG. 26 is a partial, enlarged, back view of the ergonomic motion chair of FIG. 21.
Figure 27:
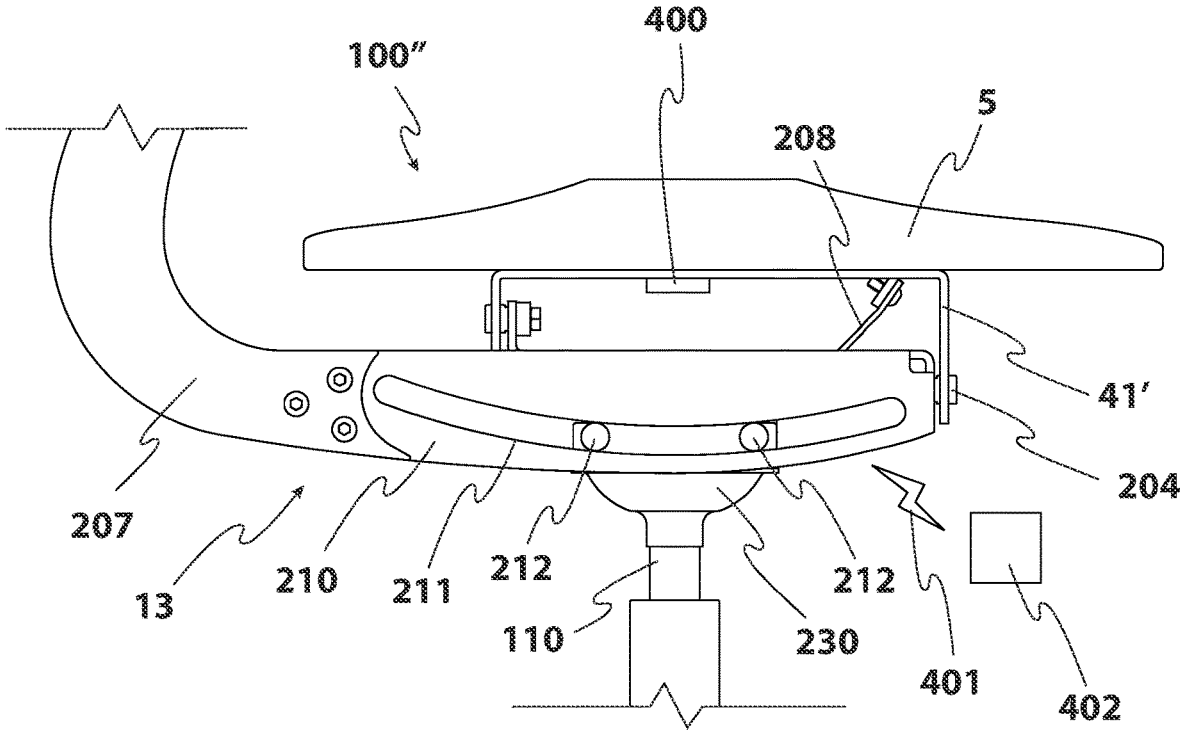
FIG. 27 is a partial, enlarged, left side view of the ergonomic motion chair of FIG. 21.

Referring to FIGS. 23, 25 & 26, an alternative preferred biasing structure 208 is shown. The biasing structure 208 is preferably a monolithic resilient member that extends from the left to right center of the pole mount 230 to the left to right center of the seat plate 4. It can be appreciated that with this orientation, tension on the resilient member urges the seat to return to both its left-to-right neutral position and its front-to-back neutral position. The thickness and resiliency of the resilient member can be optimized to adjust the biasing force applied to return the seat to its neutral positions. If desired, a plurality of resilient members, each having its own reliant properties can be provided to allow a user to select one that provides the desired biasing properties for that user. It is appreciated that an adjustable resilient member, or a resilient member with multiple parts but mounted in the approximate same orientation, may be supplied for the user to select the desired biasing tension properties.

As best shown in FIGS. 22 and 23, the spine frame 13 may include an upper spine frame 207 that is detachably secured to the chair frame 210 with bolts or the like. A seatback 300 is operably secured to the upper spine frame 207, thereby allowing the seatback to be changed as desired without requiring the purchase of a completely new chair, and/or allowing the seatback to be separated and easily reinstalled for easier storage and shipping.

Figure 28:
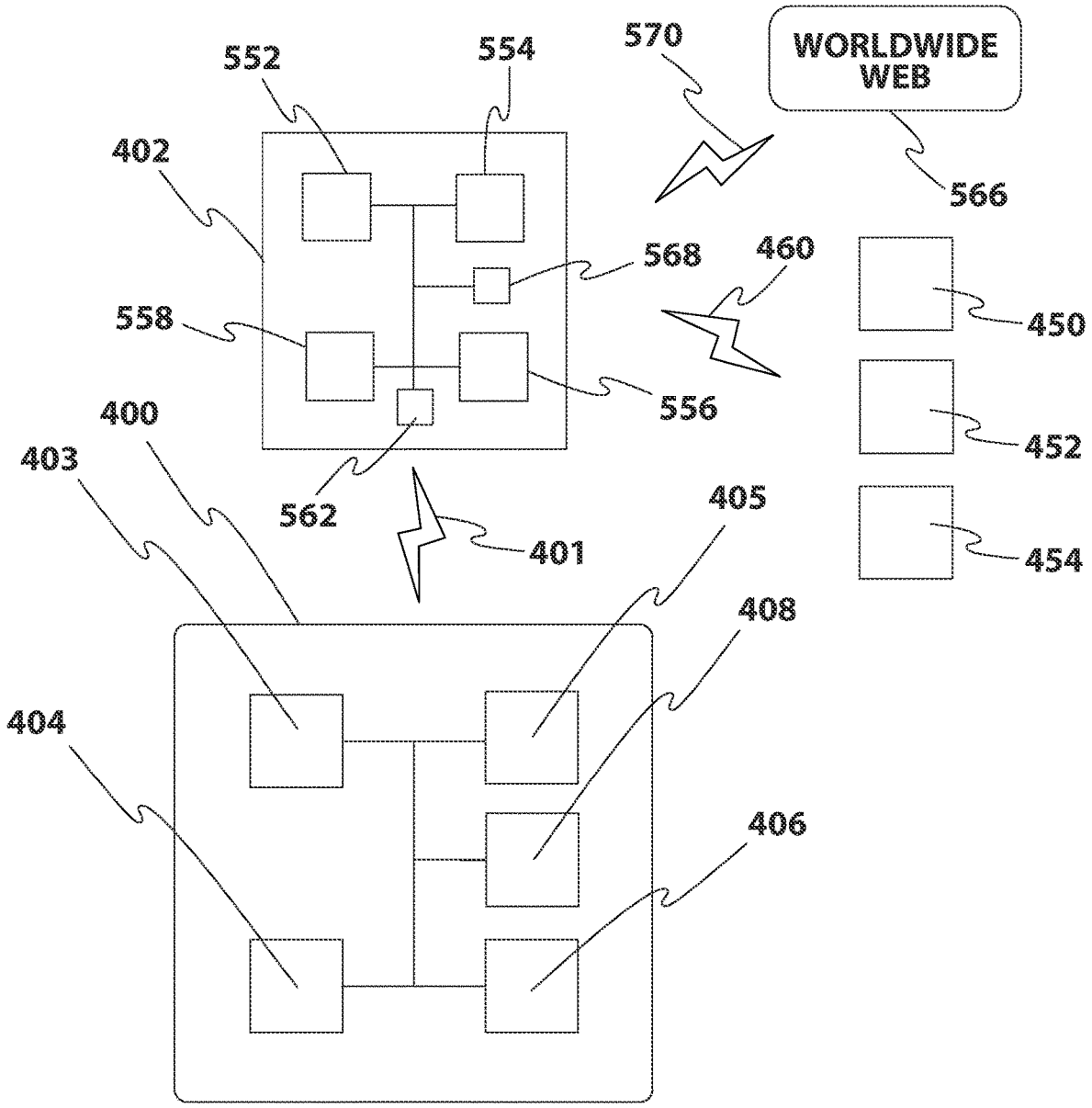
FIG. 28 is a schematic diagram of a computer controller operably secured to the ergonomic motion chair of FIG. 21 and in communication with a computer system.
Figure 29:
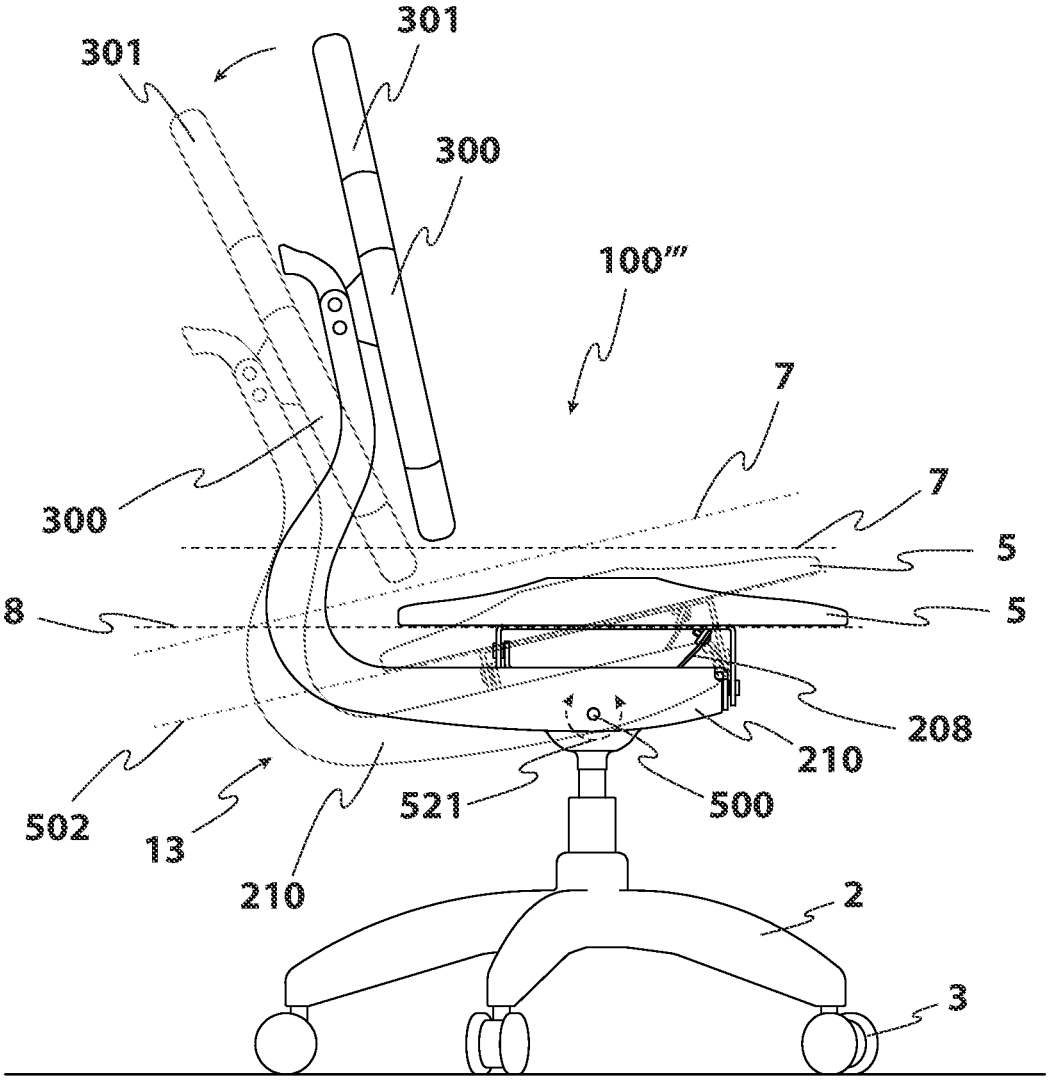
FIG. 29 is a left, side view of an ergonomic motion chair in accordance with an exemplar fourth embodiment of the present invention.
Figure 30:
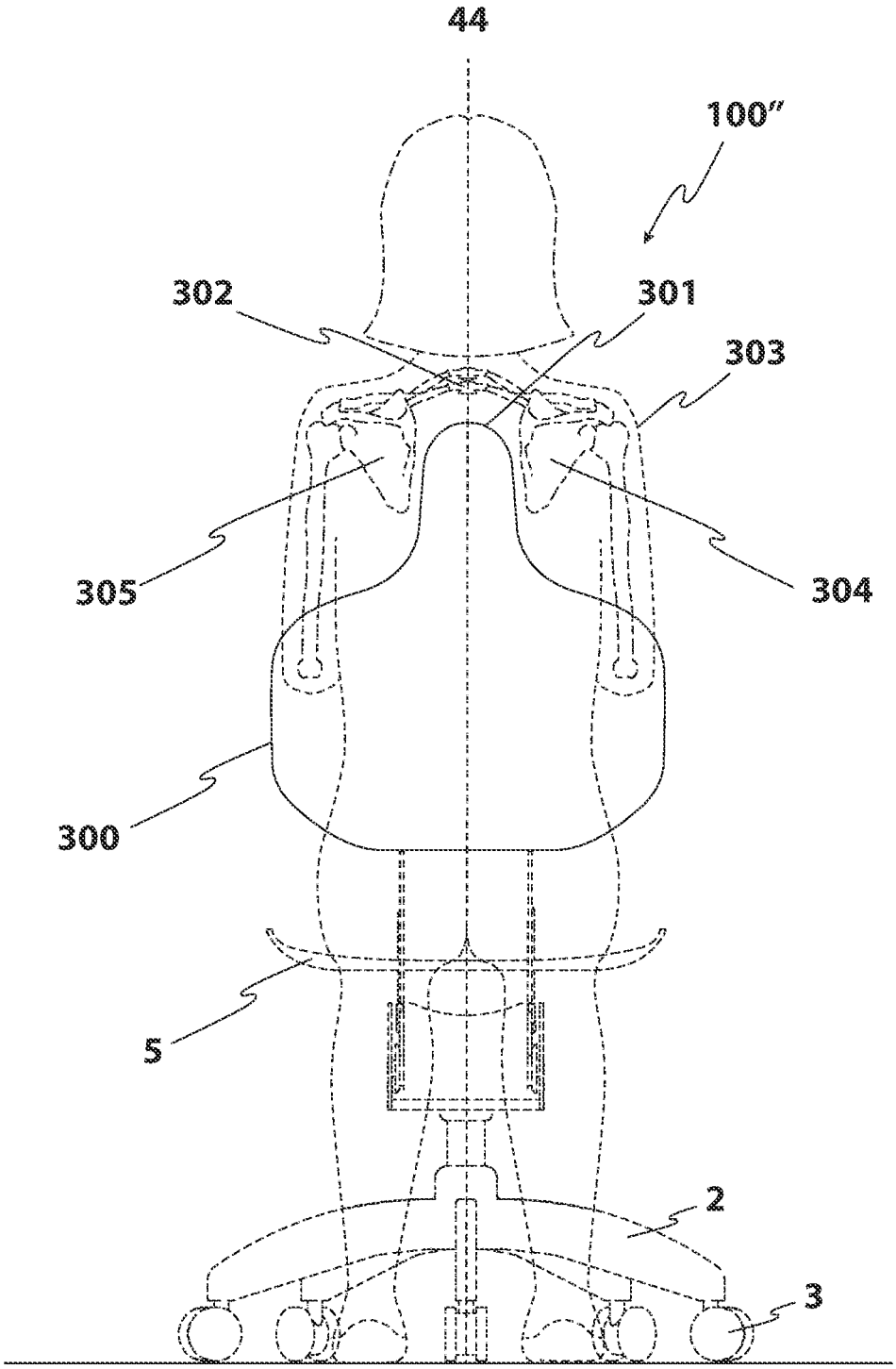
FIG. 30 is a back view of the ergonomic motion chair of FIG. 21 showing a possible orientation of the seatback relative to a user.

The ergonomic motion chair may include a controller tilt meter 400 (FIGS. 27 & 28) in communication with a computer system 402 (FIG. 28). The controller tilt meter 400 can be rigidity or detachably secured to the chair with known attachment structures, thereby allowing the controller tilt meter 400 to be easily replaced or upgraded as needed, and/or added to an existing chair to provide the benefits disclosed herein.

Figure 41:
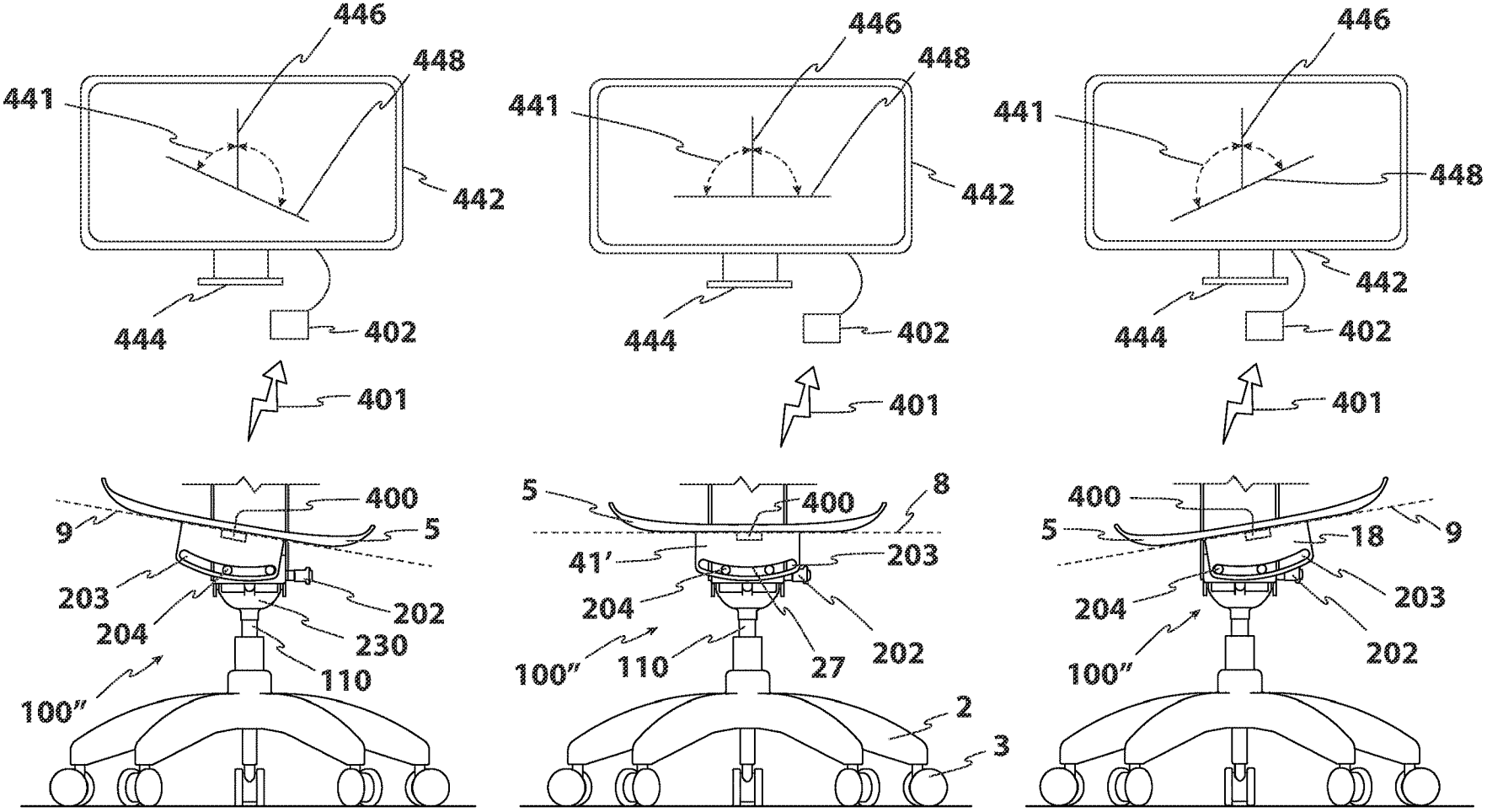
FIG. 41 is a schematic diagram of the ergonomic motion chair of FIGS. 21-28 showing possible movement of the chair to control displayed images on a computer operably secured thereto.

The controller tilt meter 400 can detect and use the simultaneous side-to-side and front-to-back movement of the seat 5 to control the computer system 402 such as by moving a cursor on a computer screen as shown in FIG. 41, commanding features or a computer program or the like, or collect data on the users activities when the chair is in use for understanding and analyzing motion, posture control or the related and informing the users of recommended movements for improved health and body performance.

Referring to FIG. 28, in one possible controller 400 embodiment, the controller includes a power source 403, a processor 404, a transmitter 405 and sensor 406 in communication with each other to detect and collect motion and the position of the seat 5 and transmit that information to the computer system 402. The sensor 406 can include a two or a three-dimensional tilt sensor or the like. The power source 403 can be an internal battery, a wired auxiliary power source, a small internal power generator such as a piezoelectric generator, weight-based generator, bezel winding generator system, other motion-based energy harvesting system, and the like. Similarly, the transmitter 405 can be wired or wireless as desired. Preferably, information from the controller 400 is transmitted via signal 401, which is preferably wireless, to the computer system 402.

Preferably, the computer system 402 includes a processor 552, a user interface 554, a power source 556, a software module 558, memory 560, and a receiver 562 all operably in communication with each other for receiving the signal 401 from the tilt sensor 400 and processing that information. More preferably, the computer system 200 is connected to an external communication system 566, such as the worldwide web or internet, and includes a transceiver 568 for transmitting and receiving information via external signal 570 between the computer system 402 and the external communication system 566 and/or transmitting information and instructions to the tilt sensor itself. In such case, the tilt sensor 400 also may also include a receiver 408 for receiving information from computer system 402.

Figure 31:
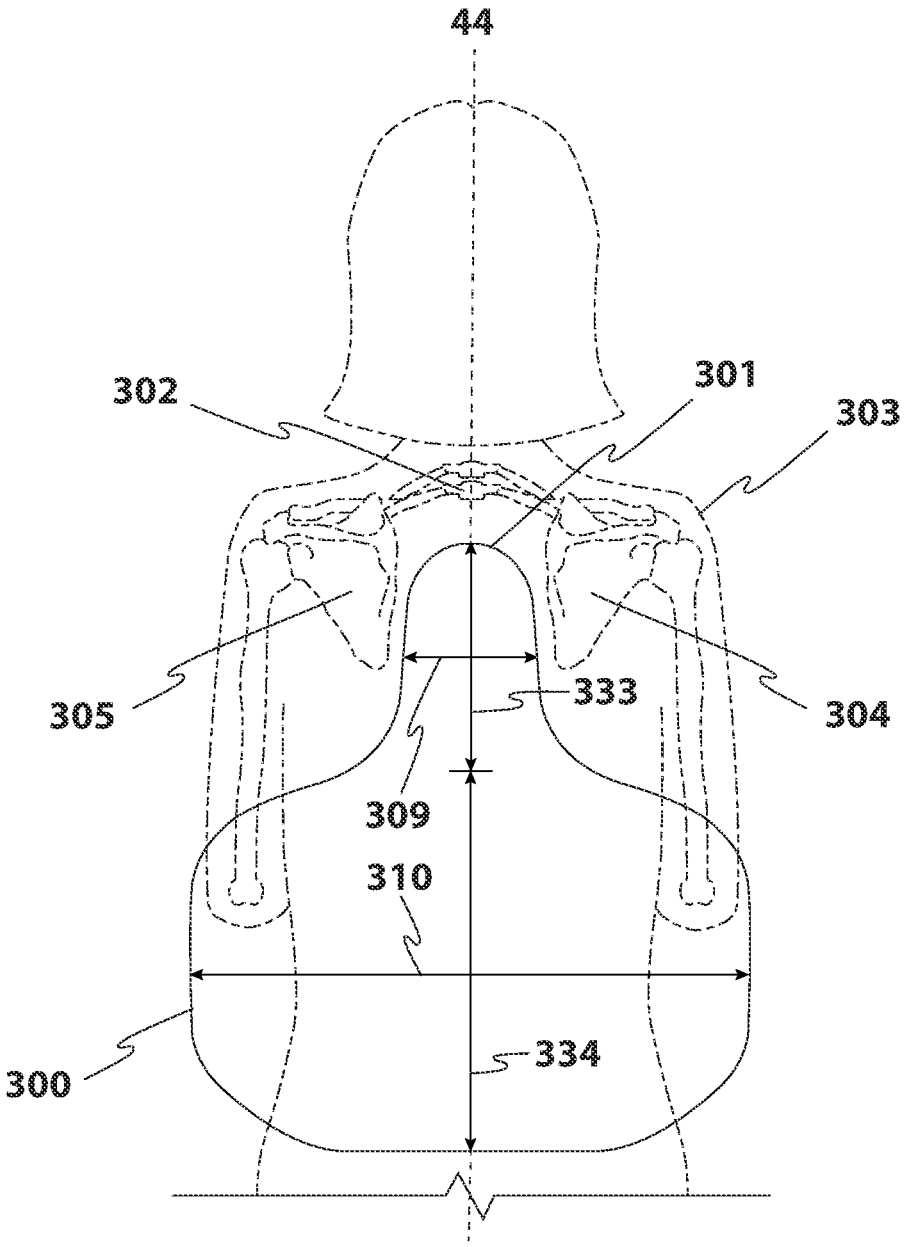
FIG. 31 is an enlarged view of the seatback of FIG. 30 relative to a user.

The seatback 300 can be optimized to provide an ergonomic engagement with the user's back as best shown in FIGS. 30-33. Preferably, the seatback 300 has an elongated narrow upper section 301 can be operably secured to the ergonomic motion chairs of the present invention, but it may also provide benefits when installed on conventional office and other chairs. The seatback 300 preferably has a first defined thickness 309 that supports the spinal column 302 of the user 303 when seated in the chair 100" with their back resting on the seatback 300, but the first defined thickness 309 is optimally less than the distance between the user's left scapula bone 305 and right scapula bone 304. The range of the first defined thickness of 309 is approximately 3" to 7" with the preferred thickness being between 3.5" to 5". The geometry and contouring of the surface between the thickness of 309 may contain an arc or dome of material between the end points of 309 protruding forward towards the user 303 spinal column 302 so the first engagement with the spinal column 302 as the user reclines will be centered and aligned on the spinal column firstly to maximize support in that area. The seatback 300 may have a second wider defined thickness 310 to support the user's lower torso, and the second defined thickness transitions in the range of 334 toward the seat 5 from the first defined thickness 309 toward the distal lower end 334 of the seatback 300 as shown in FIG. 31. The range of thickness of 310 may be 16" to 23" where the preferred range is 18"-22". The dimensional vertical range 333 of the elongated upper seatback section 301 is approximately 5"-9" with the preferred range of 6"-8". The dimensional vertical range 334 of or the lower seatback 300 is 8"-13" with the preferred range of 9"-12". It is appreciated that multiple sizes of the seatback 300 with elongated section 301 can be provided, or customized, to fit various body types and body dimensions of users.

Figure 32:
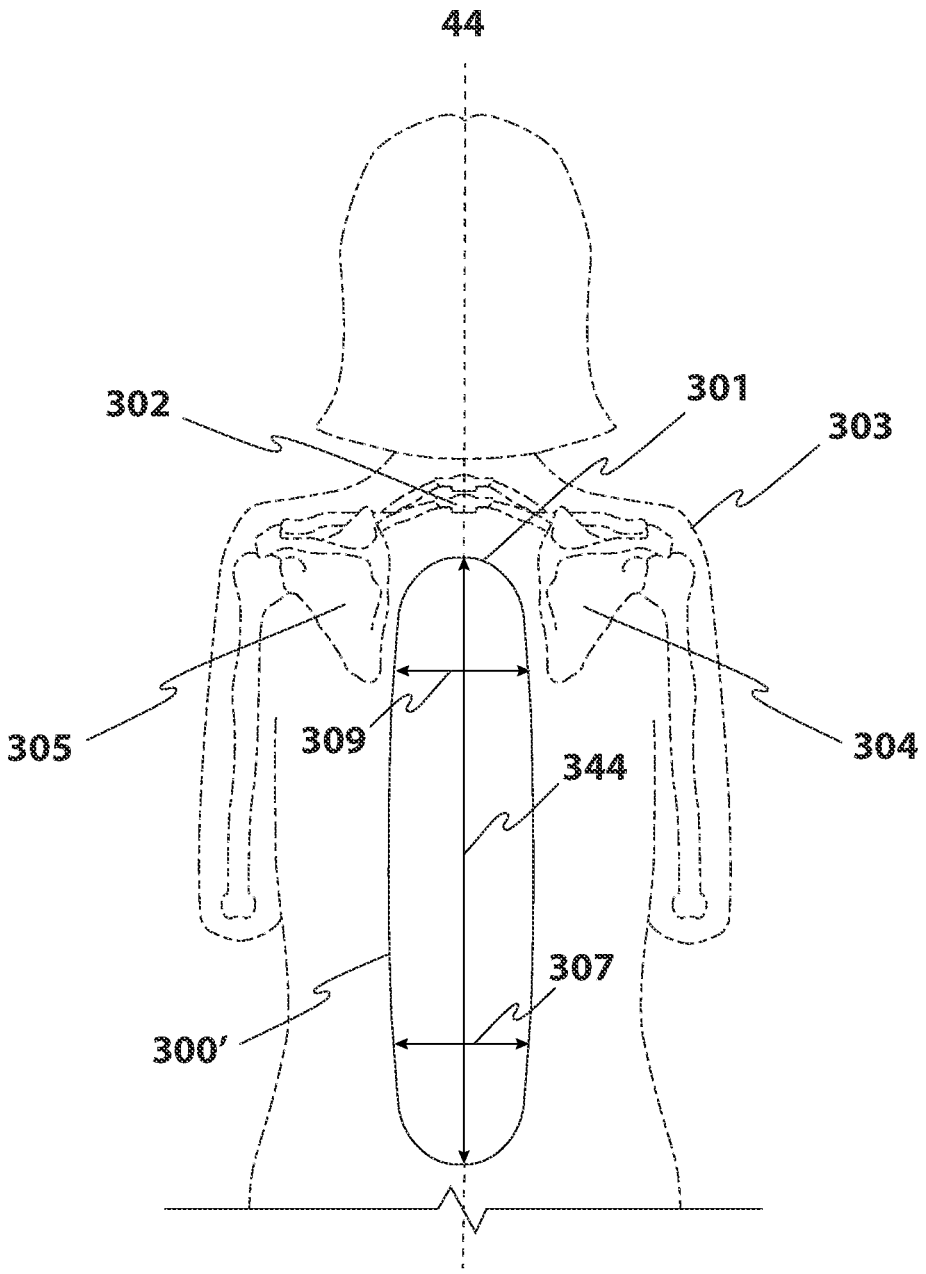
FIG. 32 is an enlarged view of an alternative possible seatback showing possible orientation relative to a user.

Referring to FIG. 32, the seatback 300 may be an elongate panel having a substantially uniform first defined thickness 309 throughout the entire length 344 of the seatback 300.

Figure 33:
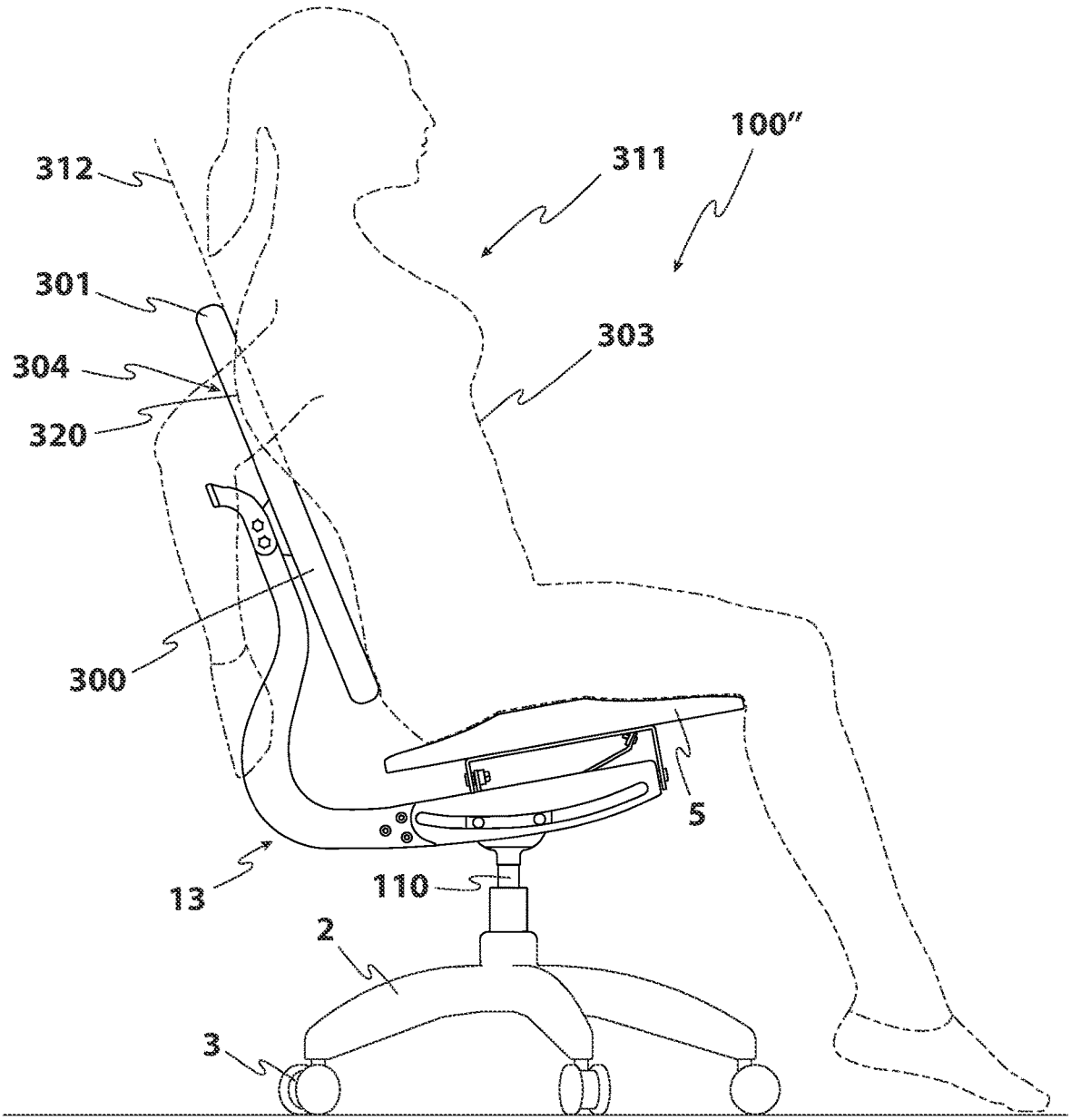
FIG. 33 is a side view of the ergonomic chair of FIG. 21 showing possible range of movement of a user engaging a seatback.
Figure 34:
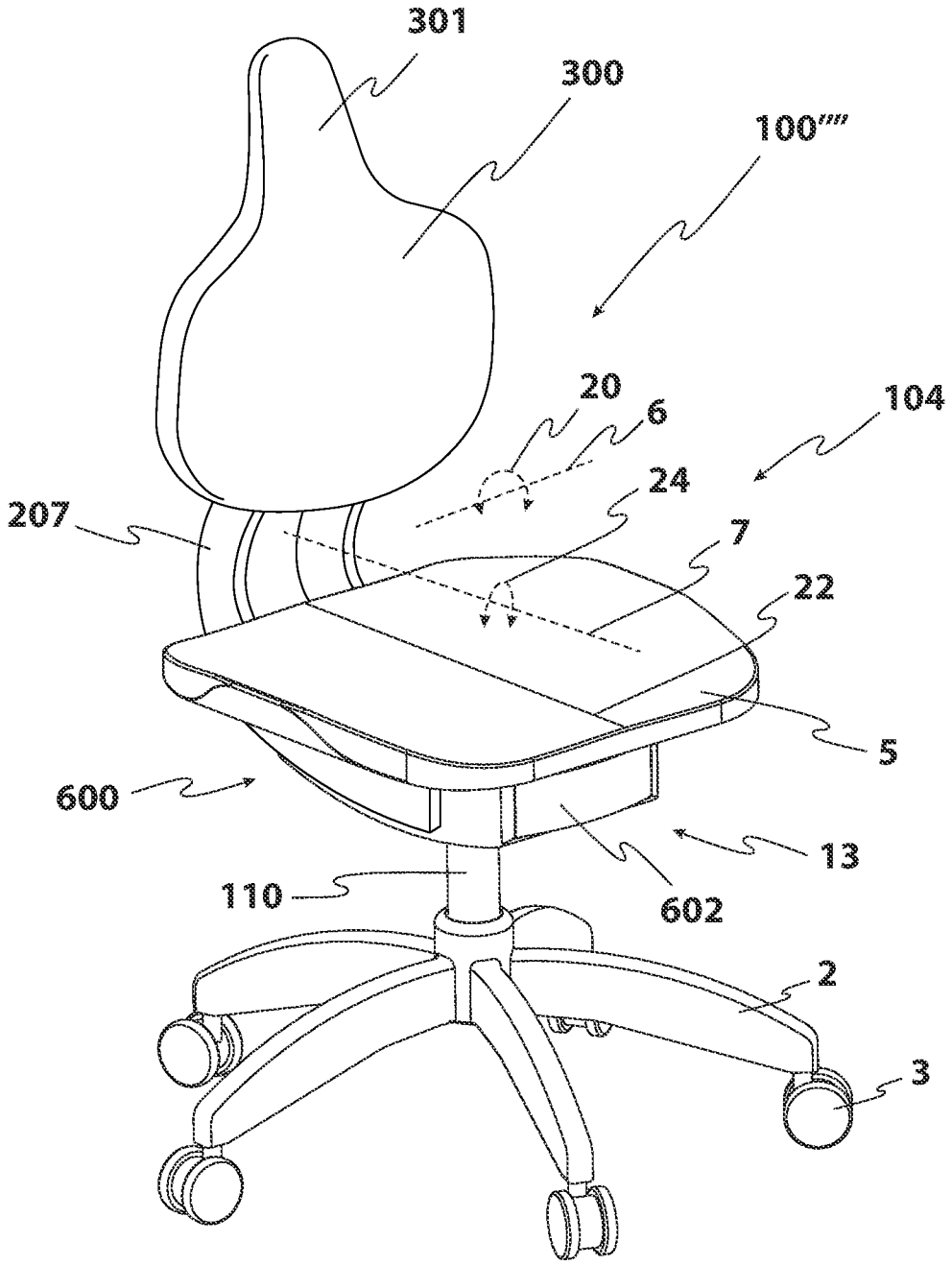
FIG. 34 is a left, front isometric view of an ergonomic motion chair in accordance with an exemplar fifth embodiment of the present invention.
Figure 35:
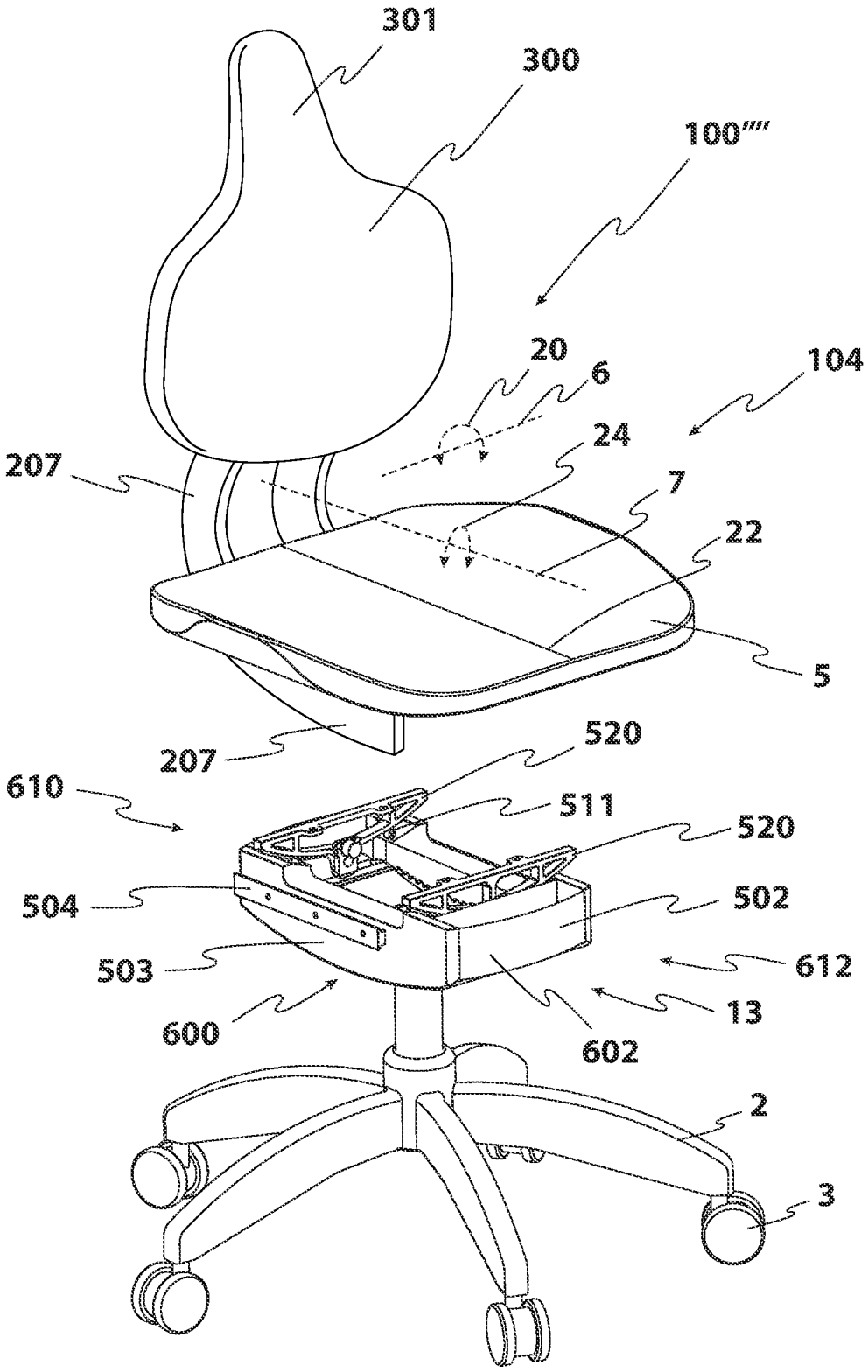
FIG. 35 is a left, front partially exploded isometric view of the ergonomic motion chair of FIG. 34.

Referring to FIG. 33, providing a seatback 300 that supports the user's back without interfering with the scapular bones 304, 305, and the user's shoulder area, allows a user to recline in the chair 100" and stretch their scapulars 304, 305 and shoulder area backwards behind their spinal column 302 and arc about their spinal column 302 as shown in FIG. 33. This motion allows a user to release their shoulder and scapula areas 320 to move behind the seatback plane 312 in order to stretch out the front side chest area 311 of the user while remaining reclined in the chair 100". The user can recline and take advantage of gravity and the non-restricted space in the scapular and shoulder areas to maximize the stretching of the front side chest area simultaneously or independently.

Exemplar Embodiment 4

Many of these disclosed features can be used to improve existing chair designs. For example, as shown in FIG. 29, a fourth possible ergonomic chair 100'" embodiment is shown. In this embodiment, the left-to-right moment structure that provides left-to-right pivoting of the seat 5 at a pivot axis 7 located above the seat plane can be operably secured to a conventional seat base 521 that provides front-to-back pivoting of the seat at a pivot axis 500 located below the seat plane.

Exemplar Embodiment 5

In addition and referring to FIGS. 34-39, a fifth embodiment of the ergonomic motion chair 100"" is disclosed. It includes a mechanism 600 for providing the first and second axes of rotation above the seat plane as previously described with that mechanism 600 received within a mechanism frame 602 that allows a seatback 300, seat 5 and base 2 to be operably secured thereto thereby defining a core of the chair that may be detachably secured to a plurality of different seats, bases and/or seatbacks. In one possible embodiment, the mechanism frame 602 includes a main front-to-back frame 502 that provides openings that serve as bearing guides. The upper portion of the main front-to-back frame 502 supports the side-to-side pivoting mechanism 610 and the lower portion of the main front-to-back frame 502 operably engages the front-to-back mechanism 612 as shown.

Figure 36:
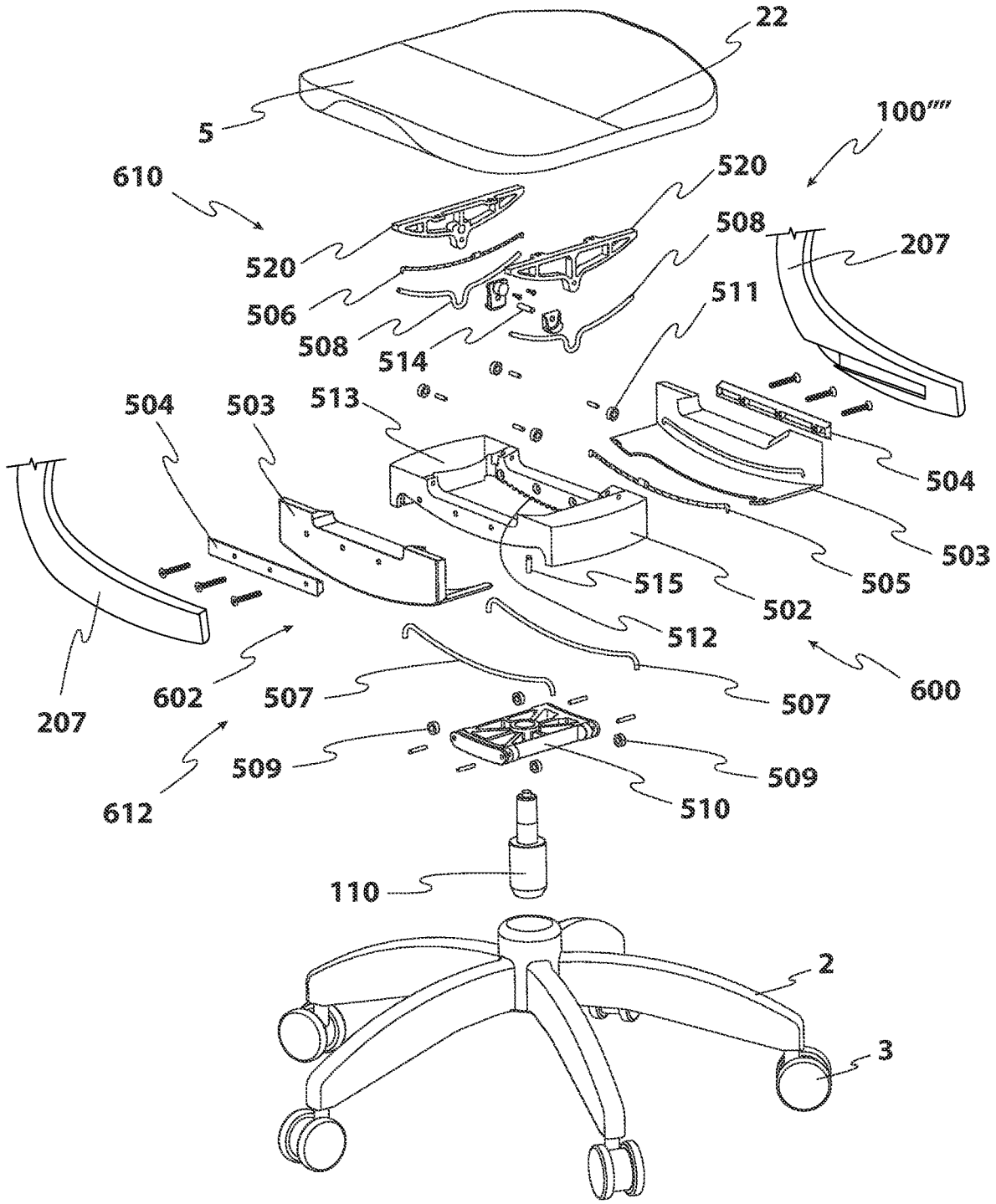
FIG. 36 is a left, front exploded view of a portion of the ergonomic motion chair of FIG. 34 showing a mechanism providing dual axis in accordance with an embodiment of the invention, the mechanism is contained within a housing that allows a seatback, base, and seat to be operably secured thereto.

The front-to-back mechanism 612 may include a front-to-back bearing mount 510 or trolly that may be pivotally secured to a base mounting pole 110. Front-to-back bearings 509 are pivotally secured to the front-to-back bearing mount 510 as shown to operably engaging the front-to-back bearing rails 507 received within curved portions of the main front-to-back frame. The curved portions are shaped to project the front-to-back pivot axes above the seat plane as previously described. More preferably, the curved portions have a primary radius at the center potion defining the main movement of the seat around the neutral position of the chair, and one or more secondary radius' towards the ends of the curved portions. For example, the ends of the curved positions and rails 507 may have a radius larger than the radius of the front-to-back bearings 509 operating in the curved portions as shown in FIG. 36, thereby providing a gradually contoured and slowing stop as the bearing near the end of their range of motion. In addition, one end of the curved portions may have a larger radius to allow the seat to assume a reclined position when the seat is pivoted at or near the furthest backward position of the forward-to backward range of motion of the chair. Accordingly, the main front-to-back frame 502 may pivot forward and backwards along the curved portions relative to the front-to-back bearing mount throughout a defined range of motion of the bearings within the curved portions.

Side frame bearing covers 503 may be secured to the main front-to-back frame 502 as shown to cover and protect the front-to-back bearings 509 and engaging bearing rails 507. Frame to spine mounts 504 may be operably secured to the side frame bearing covers 503 to allow a spine frame 207 or the like of a seatback to be operably secured thereto. The shape of the spine mounts preferably operably engages mating shaped structures on the spine frame to allow the spine frame to be slideably positionable along the spine mounts thereby allowing the position of the seatback relative to the base to be adjusted as desired.

The side-to-side pivoting mechanism 610 may include side-to-side bearings 511 operably secured the upper portion of the main front-to-back frame operably engage curved side-to-side bearing rails 508 secured to a curved lower edge of side-to-side seat engaging frames 520 as shown. The upper portion of the seat engaging frames 520 includes structures for securing a seat 5 thereto. The curved lower edge of the seat engaging frames 520 are sized to allow the seat to move side-to-side about a pivot axis that is projected above the seat plane as previously described.

Preferably, a plurality of space-apart front-to-back locking slots 512 are provided at least one side of the lower curved portions of the main front-to-back frame 502. A front-to-back locking pin 515 extends from the front-to-back bearing mount 510 to operably engage the front-to-back locking slots 512 thereby allowing a user to select a desired fixed front-to-back position of the seat by placing the locking pin 515 in a desired slot 512.

A front-to-back biasing structure 505, such as an elongate resilient member such as a shock cord or the like, may be operably secured between the front-to-back bearing mount 510 and main front-to-back frame 502 to bias the main front-to-back frame in a neutral front-to-back position. The resilient member extends and retracts, applying tension on the trolley to counteract the weight of the seatback and return the seat to a neutral position. A roller bearing may be provided to minimize friction on the resilient member where it changes direction.

Exemplar Embodiment 6

Referring to FIGS. 44-48, an alternative possible glide mechanism 710 for the ergonomic motion chair 100"" may provide smooth side-to-side movement (FIGS. 44 & 45) about the first axis 7 (FIG. 5) and/or front-to-back movement (FIGS. 46 & 47) about the second axis 6 (FIG. 5) as shown.

Figure 44:
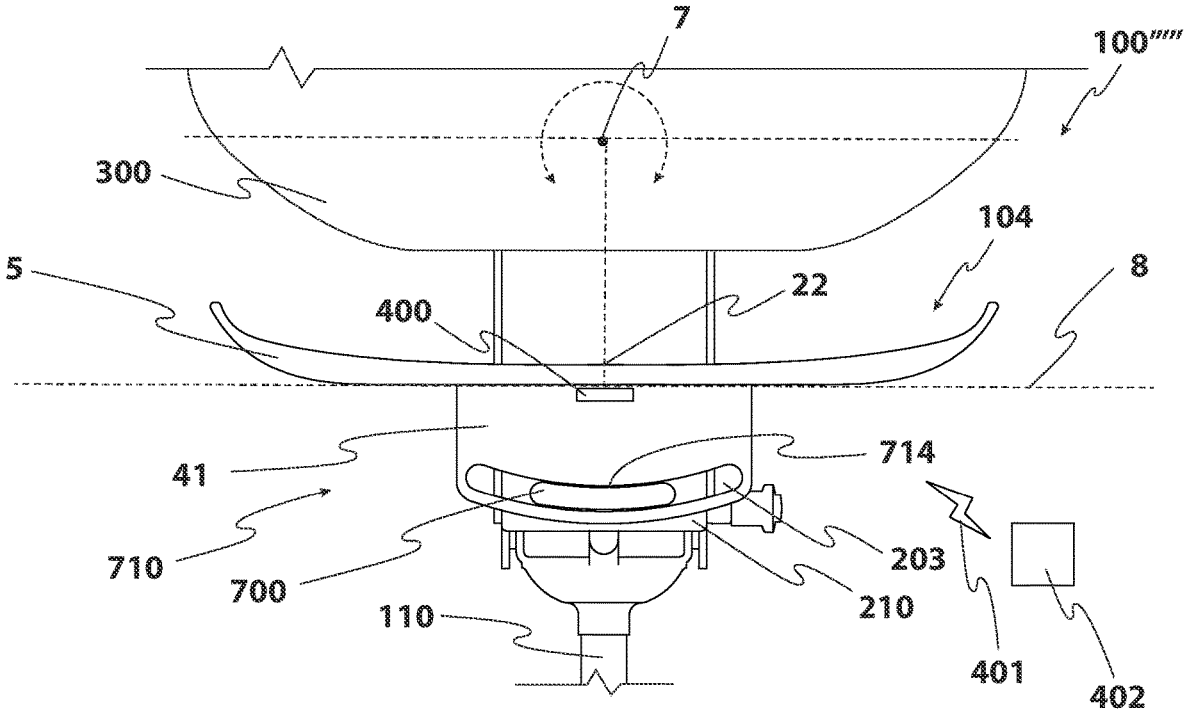
FIG. 44 is a partial front view of an ergonomic motion chair with an alternative possible side-to-side sliding movement mechanism shown in a possible side-to-side neutral position.
Figure 45:
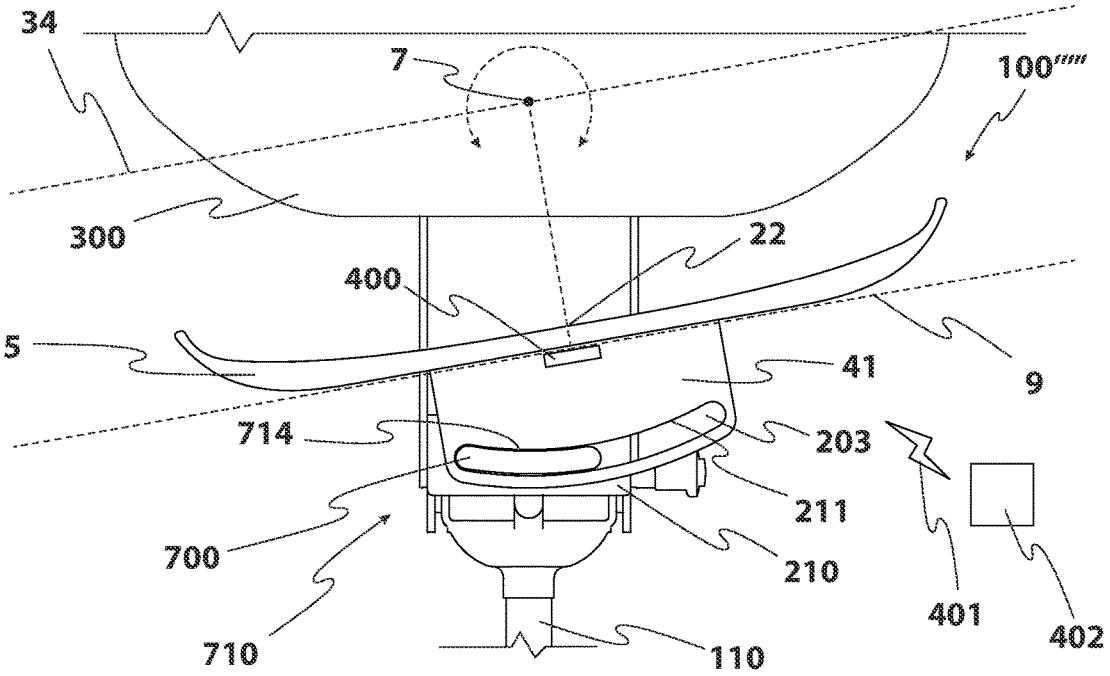
FIG. 45 is the partial front view of the ergonomic motion chair of FIG. 44 showing a possible left movement of the side-to-side sliding movement mechanism. A possible right movement of the side-to-side sliding movement mechanism is a mirror image thereof.

Referring to FIGS. 44 & 45, instead of front roller bearings 204 (FIG. 23) and rear roller bearings 204 (FIG. 23) extending from the chair frame 210 (FIG. 24 and FIGS. 44 & 45) to preferably engage the forward and back arcuate structures 203 (FIG. 24 and FIGS. 44 & 45) as previously described in Exemplar Embodiment 3, the chair frame may include a set of first curved elongated glides 700 protruding from the front and back portions of the chair frame 210 that operably engage the forward and back arcuate structures 203 as shown. The set of first glides are sized and contoured to glide smoothly along the races defined by the forward and back arcuate structures 203 without wobbling therein thereby allowing the ergonomic motion chair to move from a side-to-side neutral position shown in FIG. 44 to a possible left side tilt about axis 7 (FIG. 5) shown in FIG. 45. It can be appreciated that the forward and back arcuate structures 203 are sized to as to also allow movement of the set of first elongated glides 700 to allow a possible right-side tilt of the ergonomic motion chair about axis 7 (FIG. 5) simply by moving the chair in a right tilting direction about axis 7 (FIG. 5) as previously described with the other exemplar embodiments.

Figure 46:
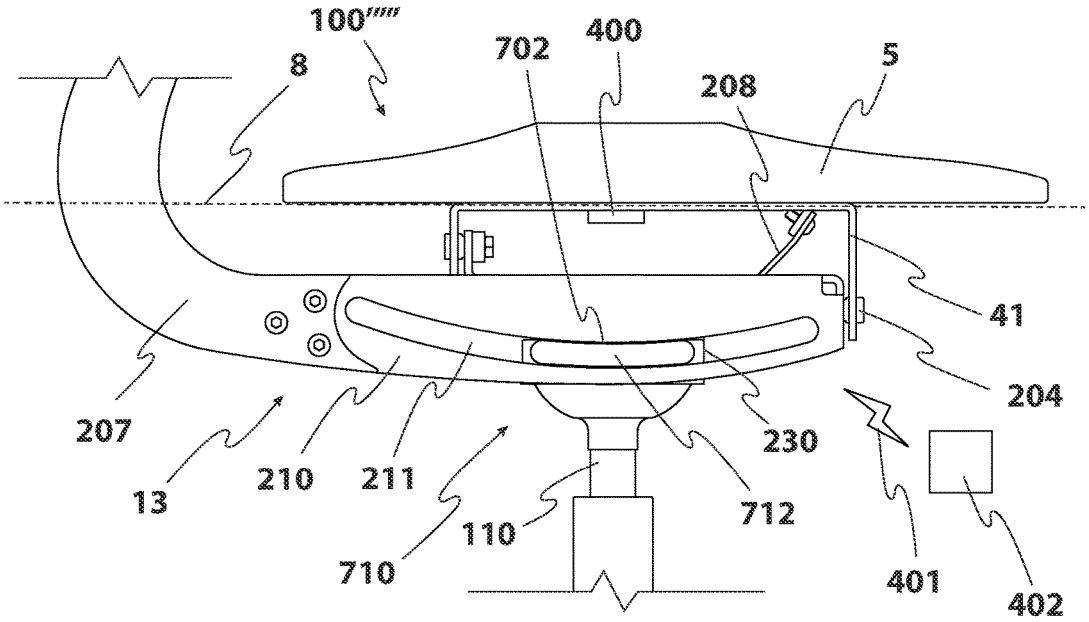
FIG. 46 is a partial left side view of an ergonomic motion chair with an alternative possible front-to-back sliding movement mechanism shown in a possible front-to-back neutral position. The partial right side view being a mirror image thereof.
Figure 47:
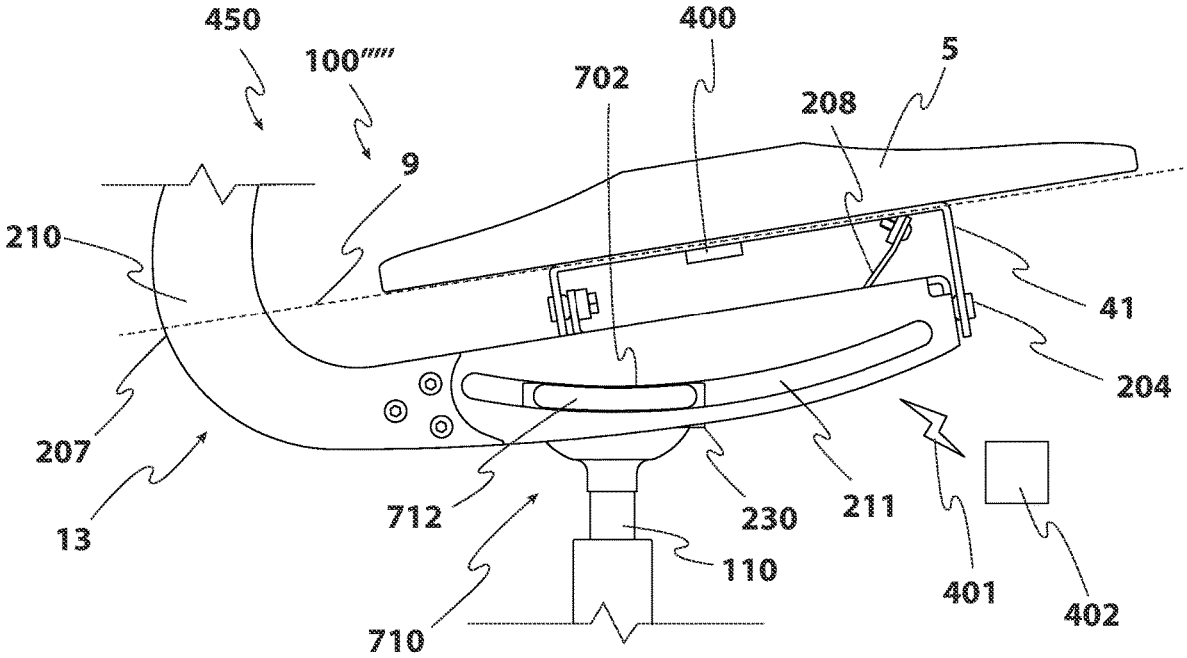
FIG. 47 is the partial left side view of the ergonomic motion chair of FIG. 46 showing a possible backward movement of the front-to-back sliding movement mechanism. A possible forward movement of the front-to-back sliding mechanism is also possible along the side arcuate structure 211 such as bearing slots.
Figure 48:
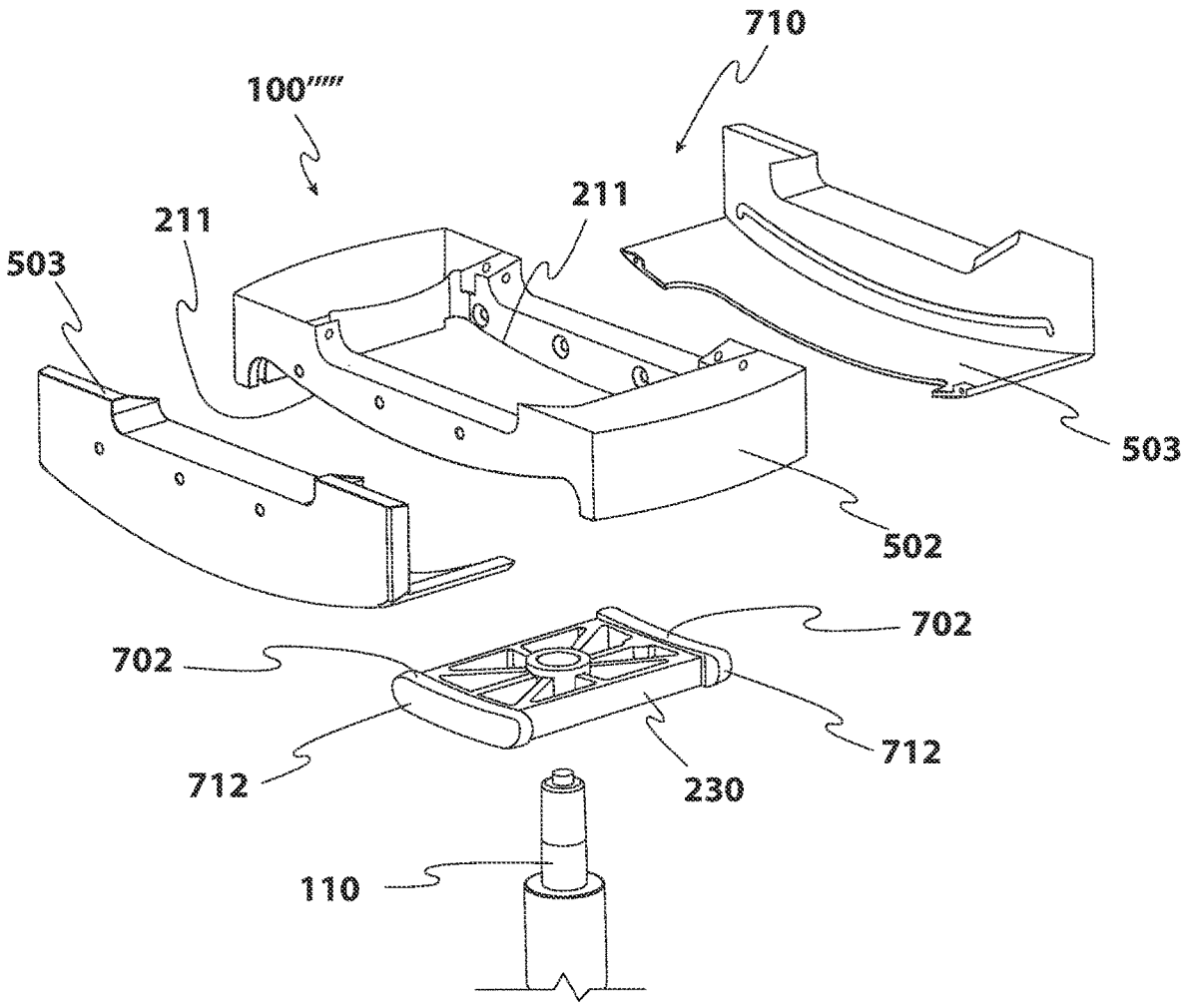
FIG. 48 is a partial isometric exploded view of the front-to-back sliding movement mechanism of FIG. 46.

Referring to FIGS. 46-48, instead of front-to-back roller bearings 212 (FIG. 23) extending from the pole mount 230 (FIG. 23) to operably engage the side arcuate structures 211 as previously described in Exemplar Embodiment 3, the pole mount 230 may include a second set of curved elongated glides 712 extending from its sides to operably engage the side arcuate structures 211. The second set of elongated glides 712 are sized and contoured to glide smoothly along the races defined by the arcuate structures 211 without wobbling therein, thereby allowing the ergonomic motion chair to move from a front-to-back neutral position shown in FIG. 46 to a backward position shown in FIG. 47. It can be appreciated that the arcuate structures 211 are sized to allow movement of the second set of elongated glides 712 to also allow a forward position of the ergonomic chair by moving the chair in a forward direction about axis 6 (FIG. 5) as previously described with the other exemplar embodiments.

The first and second set of elongated glides 700, 712 may include materials along their race engaging surfaces 702 for optimizing the smooth gliding performance of the glides 700, 712 within their respective arcuate structures 203, 211. These materials may include grease or other lubricants. Moreover, the glides and races can be formed with materials that provide optimal durability and friction resistance between themselves or in combination with other materials. Materials that have been shown to work particularly well in this application include Nylon and other polymers such as high-performance acetal resins, one of which is sold by the Dupont Corporation under the trademark DELRIN, and these in combinations with metal, such as stainless steel or aluminum.

In addition, the contour and shape of the arcuate structures 203, 211, glides 700, 712, and race engaging surfaces 702 can be optimized to provide a desired level of friction and movement between them. For example, the guides 700 and 712 can be different lengths and widths, made up of a multitude of segmented glides, have different shapes, and/or be an array of glides, or contain different textures and surface geometry to fine tune the desired friction between their respective arcuate structures 203, 211. Moreover, the arcuate structures 203, 211 can define different arcuate geometrical shapes along their paths. For example, they can define a large curve near the defined neutral position of the chair, and smaller curves toward the end of the range of movement of the chair. These different arcuate geometrical shapes can be optimized to provide different movements of the seat substantially about the axis 6, 7 at different locations within the range of movement of the seat.

As shown in FIGS. 44-47, a tilt meter 400 in communication with a computer system can provide electronic functionality as described with respect to other embodiments herein for the ergonomic motion chair 100" " of this embodiment. Moreover, the disclosed mechanical, electrical, computer and user interfaces of the other embodiments may be interchangeable with the features of this embodiment as desired.

Alternative Exemplar Biasing Structure

Figure 49:
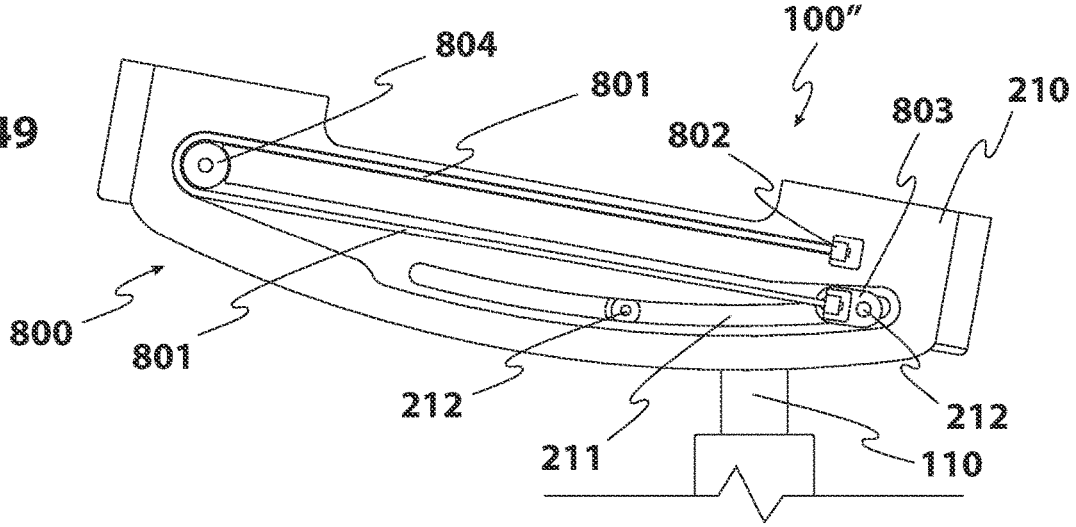
FIG. 49 is a partial left side view of the ergonomic motion chair of FIG. 34 showing a possible front-to-back biasing structure showing the chair is a possible forward position.
Figure 50:
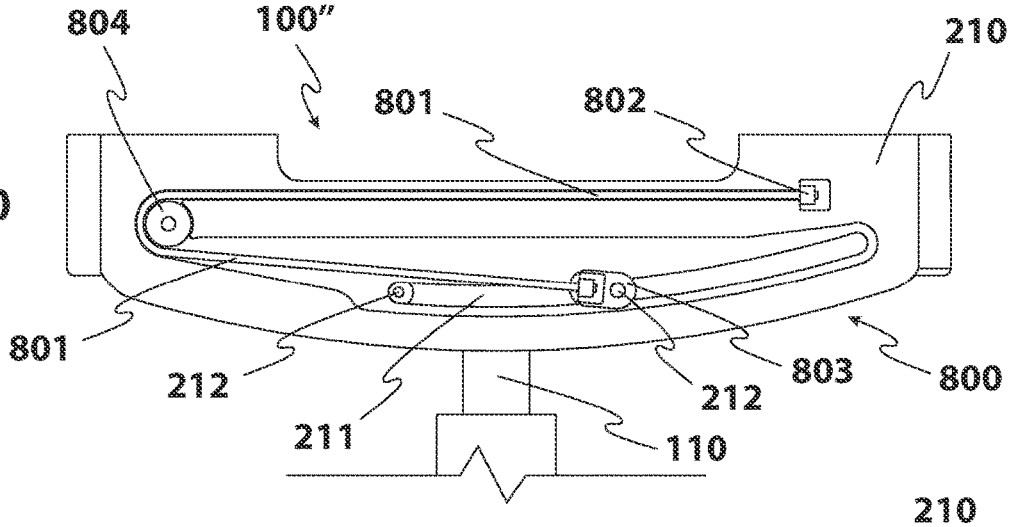
FIG. 50 is the partial left side view of the ergonomic motion chair of FIG. 49 showing a possible neutral position.
Figure 51:
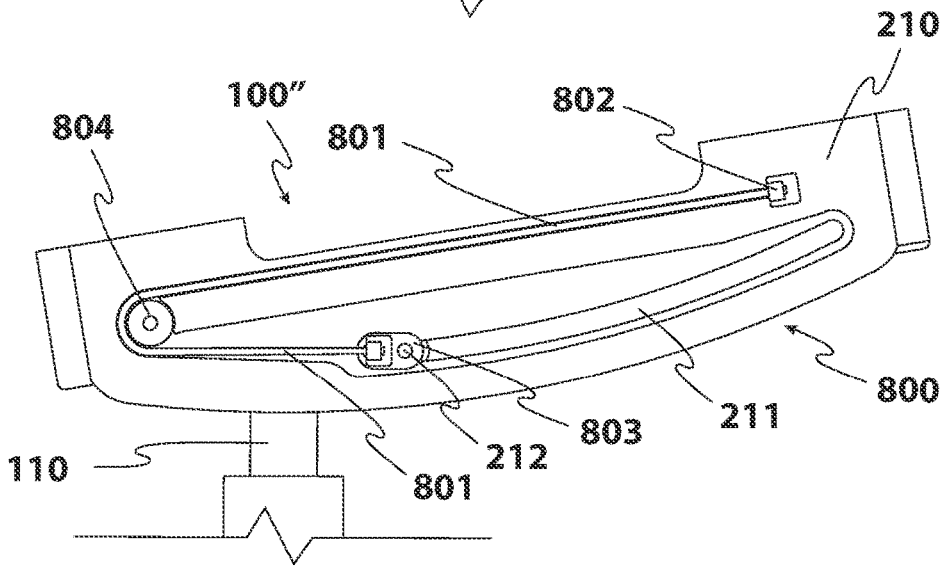
FIG. 51 is the partial left side view of the ergonomic motion chair of FIG. 48 showing a possible backward position.

Referring to FIGS. 49-51, an alternative possible biasing structure 800 is shown. The biasing structure 800 may provide biasing force along the entire range of forward-to-back motion of the chair by attaching one end of the resilient member 801 to the forward most front-to-back roller 212 with a first resilient member mount 803, extending the resilient member 801 around a roller 804, and mounting the distal end of the resilient member toward the front of the chair frame 210 as shown. Tension may be adjusted by changing the relaxed length of the resilient member 801 and/or installing the resilient member in a moderately tensioned state. Accordingly, the elongated resilient member 801 may be positioned as shown to be under moderate tension to bias the seat to a neutral level position as shown in FIG. 50. When the seat is moved to a tilted back position as shown in FIG. 49, the tension on the resilient member 801 increases to urge the seat to return to the neutral level position of FIG. 50. With the seat tilted forward as shown in FIG. 51, the tension on the resilient member 801 is low, allowing gravity and the weight of the seat back to urge the seat to return to the neutral level position of FIG. 50.

Alternatively, a frame portion containing a slider slot may be operably secured within at least one of the curved portions of the main front-to-back frame to allow the resilient member to apply tension when the seat is positioned toward the back of the forward-to-backward range of motion of the seat. The length of the slider slot may be sized to relieve tension on the resilient member when the seat is near the neutral position and tilted forward, thereby allowing free movement of the seat in the forward-to-back direction around the neutral position. However, when the seat is pivoted back, the pin moves the frame portion containing the slider slot in a direction to apply tension of the resilient member thereby urging the seat to move to the neutral position. Tension may be adjusted by changing the relaxed length of the resilient member and/or installing the resilient member in a moderately tensioned state and by changing the length of the frame portion.

Exemplar Ergonomic Motion Chair Interaction With Computer System

Figure 42:
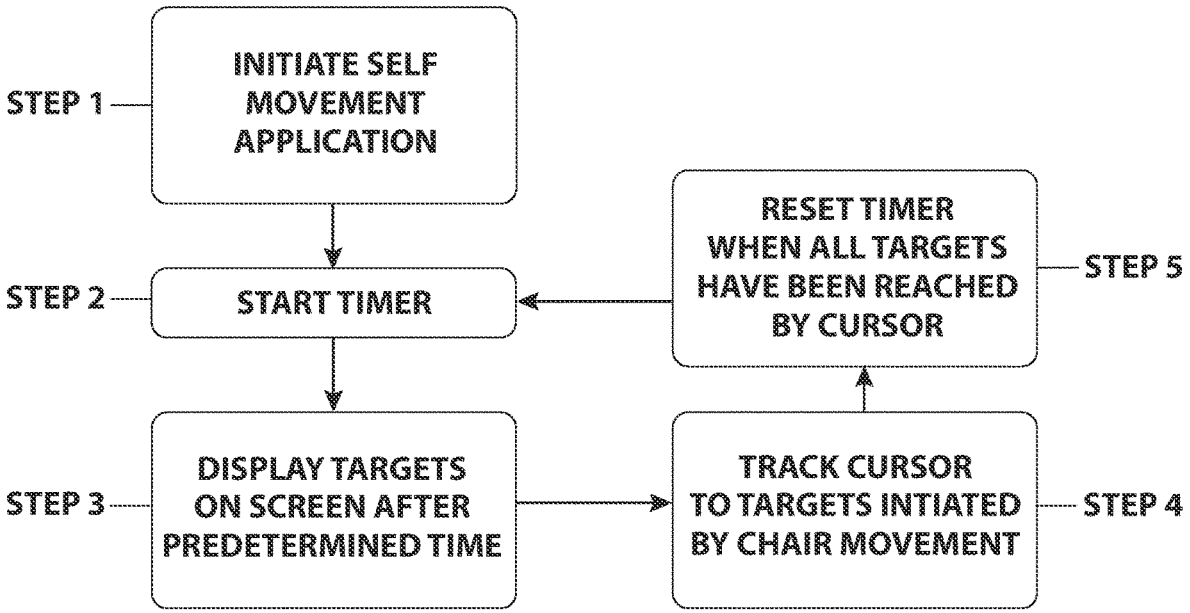
FIG. 42 is an exemplar flow chart showing a possible computer application for tracking and engaging a user to move the ergonomic motion chair of FIGS. 21-28 in response to displayed images on a computer screen.
Figure 43:
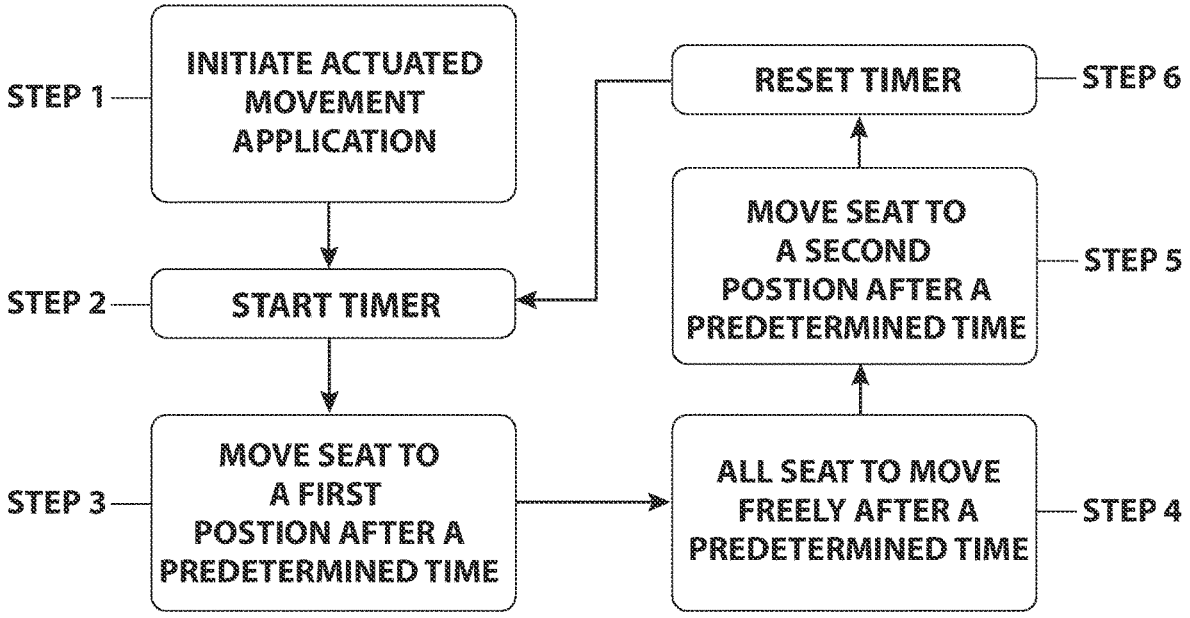
FIG. 43 is an exemplar flow chart showing a possible computer application for the computer system to control the actuation systems of FIG. 37 and/or FIG. 39 to move the ergonomic chair of FIG. 27 to predetermined locations.

Having fully described several mechanical embodiments of an ergonomic motion chair 100, exemplar user experiences using the unique movement of the ergonomic motion chair along with its imbedded tilt sensor 400 in communication with a computer system can be achieved. These user experiences can include passive experiences such as the user initiating movement of the seat of the chair to control a computer (FIG. 41), the computer monitoring and recording user-initiated seat movement, and/or the computer providing a user interface to encourage the user to move the seat to a desired position on a periodic basis to prevent a user from becoming too sedentary while sitting (FIG. 42). In addition, the user experiences can include active experiences whereby the computer system 402 of ergonomic chair 100 activates actuators that move the seat to a predetermined position and/or prevent the seat from being placed in a predetermined position in response to a preset, user, or health professional commanded application (FIG. 43) within the computer system 402. Examples of these types of user experiences are provided below.

Ergonomic Motion Chair Actuation System

Figure 37:
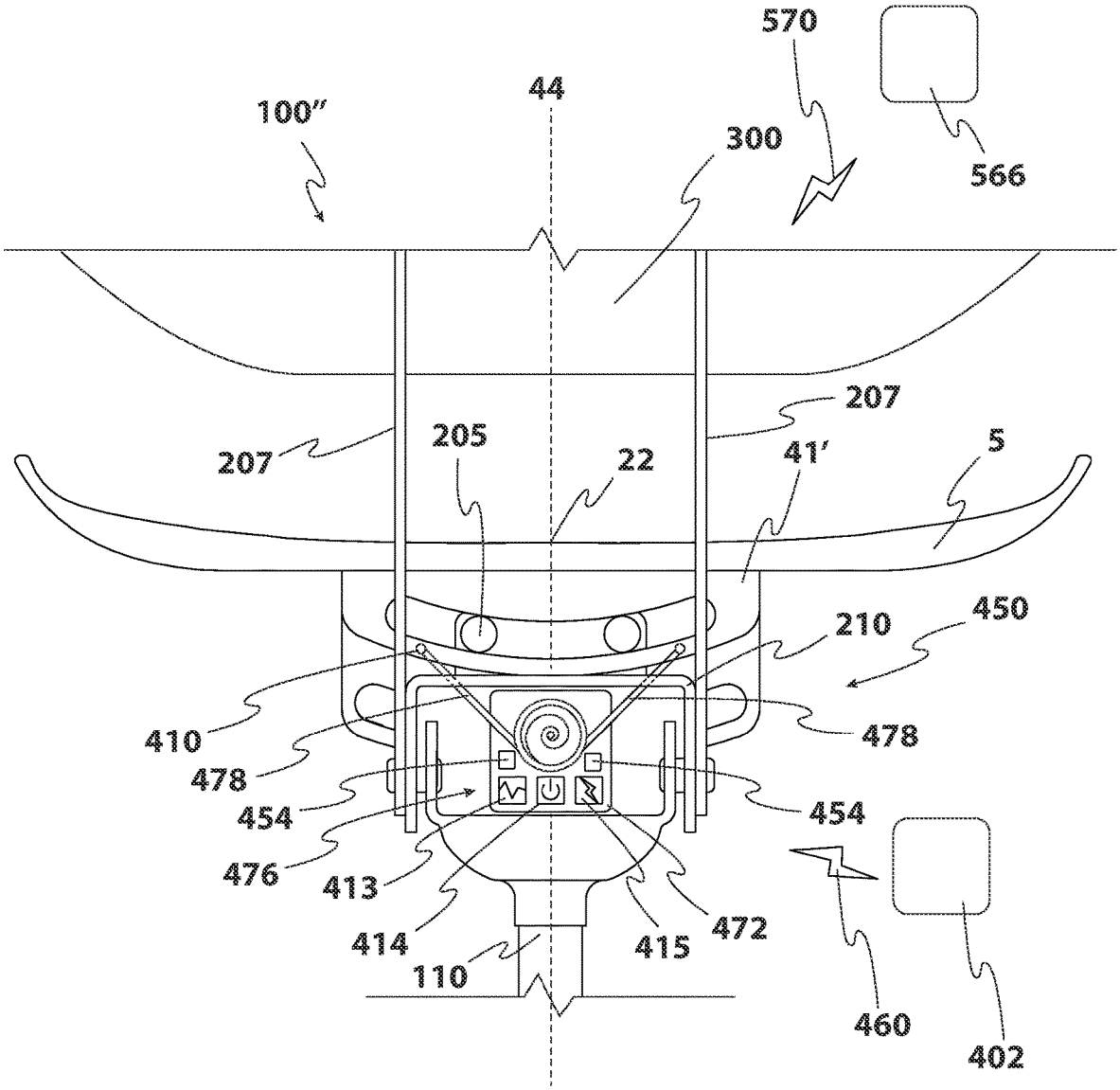
FIG. 37 is a partial rear view of a portion of the ergonomic motion chair of FIG. 34 showing a possible side-to-side actuation system operably secured thereto, with the seat positioned in a side-to-side neutral position.
Figure 38:
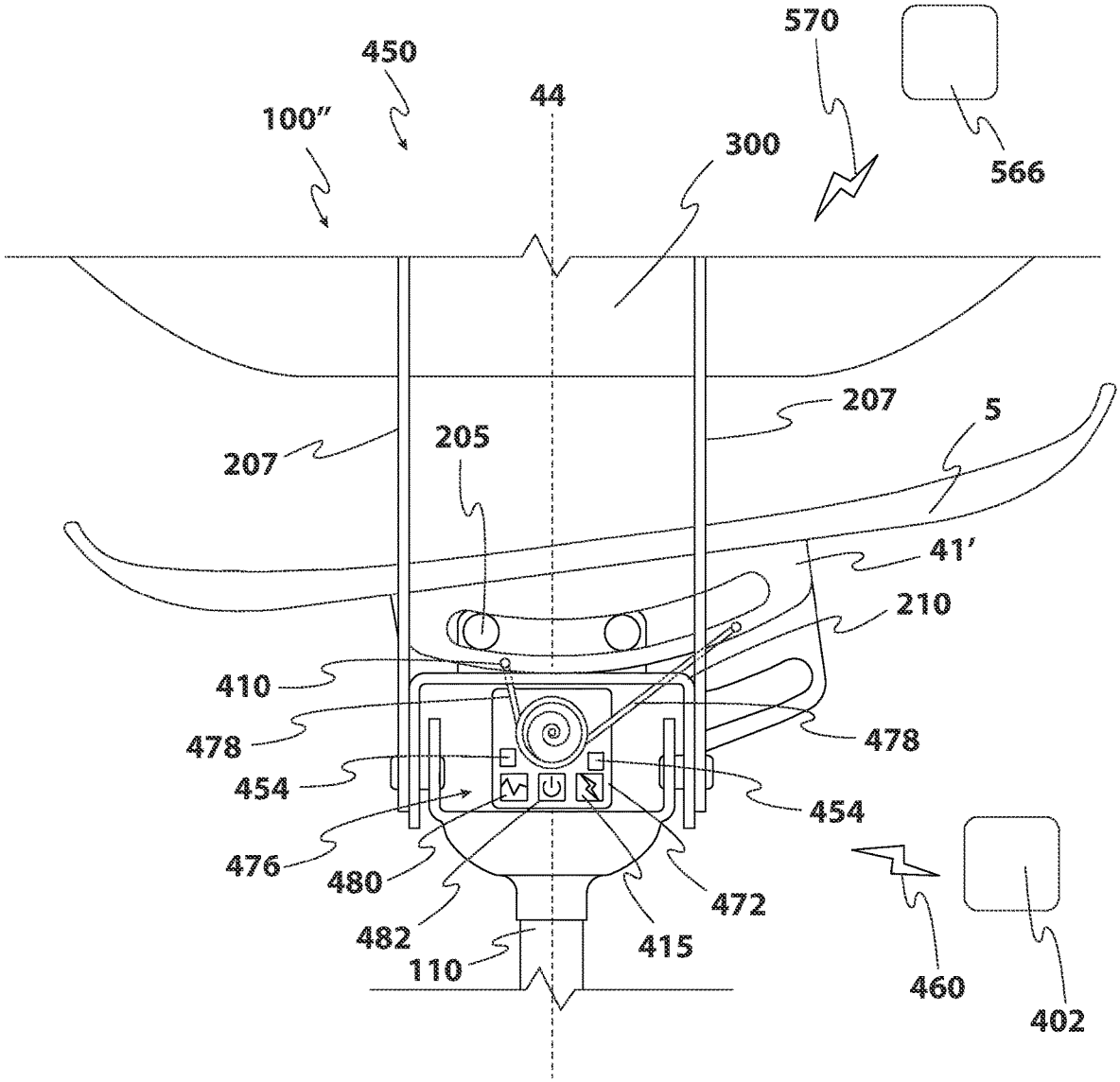
FIG. 38 is the partial real view of a portion of the ergonomic motion chair of FIG. 34 with the side-to-side actuation system of FIG. 37 operably secured thereto with the seat shown in a possible sideways tilted position.
Figure 39:
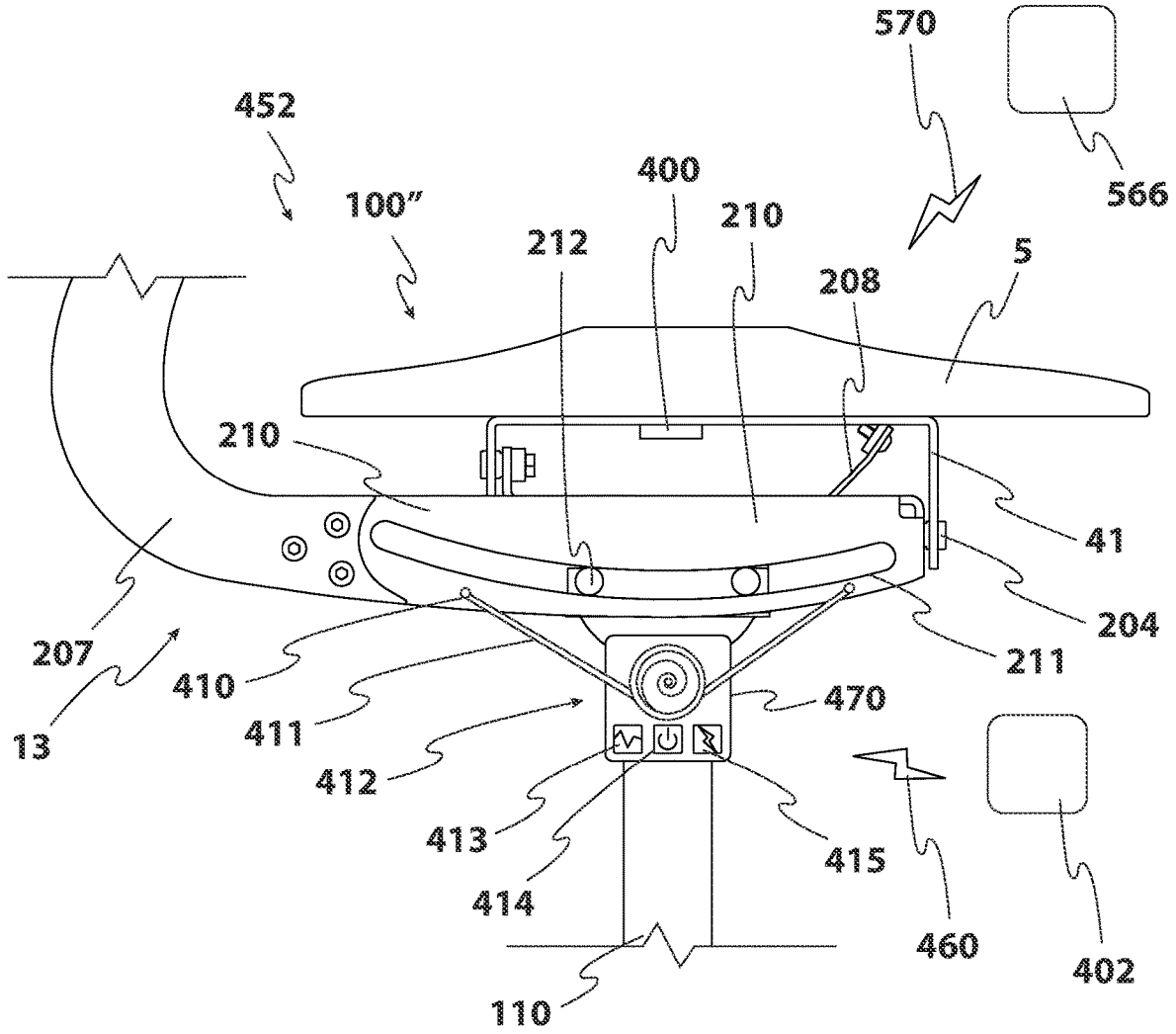
FIG. 39 is a partial, left, side view of a portion of the ergonomic motion chair of FIG. 34 showing a possible front-to-back actuation system operably secured thereto, with the seat positioned in a front-to-back neutral position.
Figure 40:
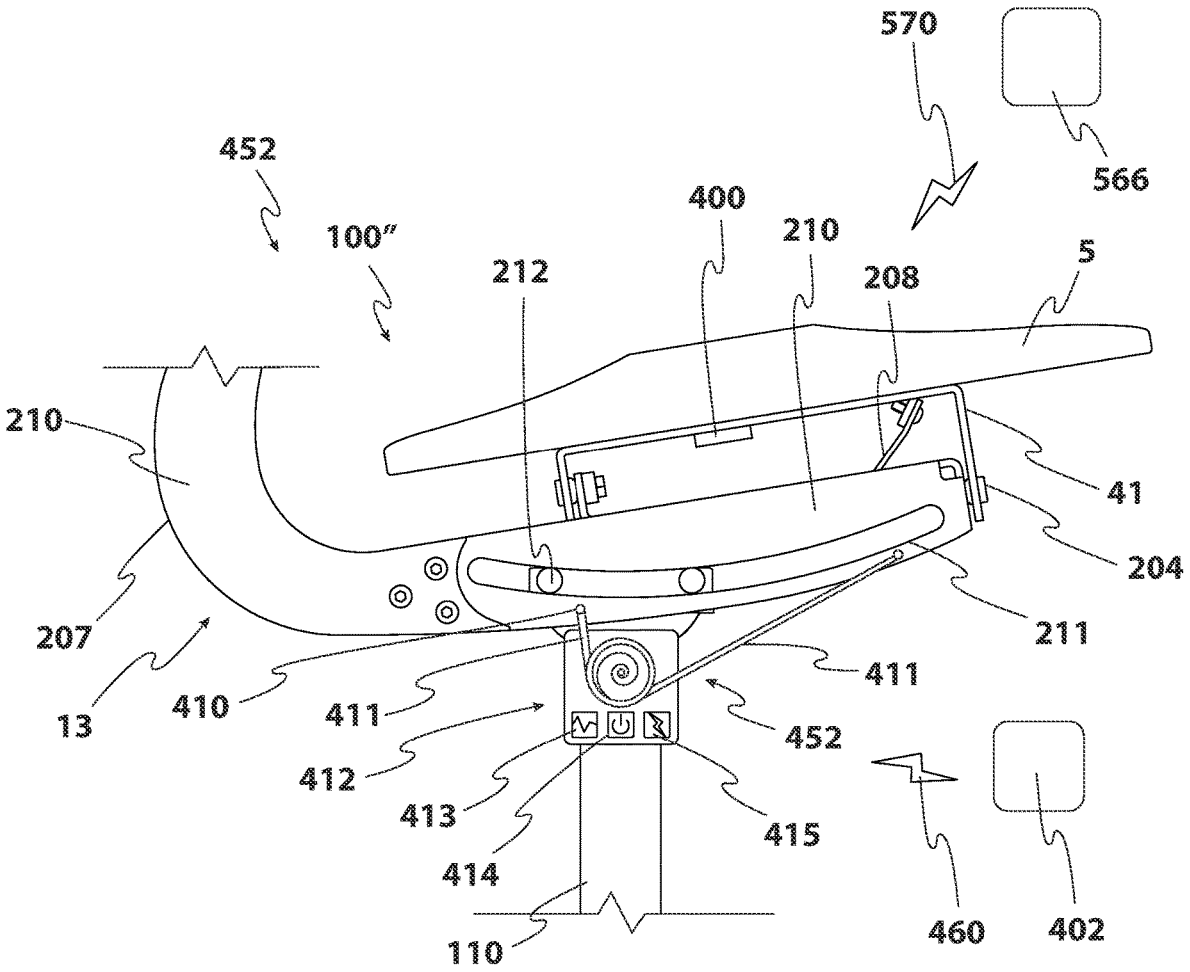
FIG. 40 is the partial, left, side view of a portion of the ergonomic motion chair of FIG. 34 showing the possible front-to-back actuation system of FIG. 39 with the seat positioned in a tilted back position.

An exemplar side-to-side movement actuation system 450 is shown in FIGS. 37 and 38, and an exemplar a front-to-back movement actuation system 452 is shown in FIGS. 39 and 40. Both actuation systems 450, 452 are in communication with the computer system 402 via signal 462. Both of these systems 450, 452 work together to allow the computer system 402 to command and move the seat to any position within the range of motion of the seat about the first and second pivot axes 7, 6 (FIG. 5). Moreover, one or more computer-activated vibration devices 454 may be operably secured to the chair and in communication with the computer system 402.

The front-to-back movement actuation system 450 preferably includes a first actuation mount 470 operably secured to pole 110. The first actuation mount 470 operably contains a first rotary motor 412 with a first actuator cable 411 operably extending therefrom as shown in FIG. 39. The ends of the cable 411 are secured to the chair frame 210 such that rotatory movement to the rotary motor urges the cable to pull in a commanded direction, thereby forcing the seat to move about second axis 6 (FIG. 5). Activating the first rotary motor 412 to rotate its rotary drive in a first direction will pull the first actuator cable 411 in a first direction to urge the seat to move from its neutral front-to-back position shown in FIG. 39 to a backward position about second axis 6 (FIG. 5) as shown in FIG. 40. It can be appreciated activating the first rotary motor 412 to rotate its rotary drive in an opposite second direction will pull the first actuator cable 411 in an opposite second direction to urge the seat to move from its neutral front-to-back position shown in FIG. 29 to a forward position about second axis 6 (FIG. 5).

The first actuation mount may include a sensor 413, power source 414, such as a battery or the like, communications module 415, such as a transceiver or the like, for transmitting and receiving messages from the computer system 414. Accordingly, the computer system 402 may transmit movement commends to the first rotary motor and receive real-time position and movement information from sensor 413.

The side-to-side movement actuation system 450 preferably includes a second actuation mount 472 operably secured to the chair frame 210. The second actuation mount 472 operably contains a second rotary motor 476 with a second actuator cable 478 operably extending therefrom as shown in FIG. 37. The ends of the cable 478 are secured to the seat plate 210 such that rotatory movement to the rotary motor urges the cable to pull in a commanded direction, thereby forcing the seat to move about first axis 7 (FIG. 5). Activating the second rotary motor 476 to rotate its rotary drive in a first direction will pull the second actuator cable 478 in a first direction to urge the seat to move from its neutral side-to-side position shown in FIG. 37 to a left side position about first axis 7 (FIG. 5) as shown in FIG. 38. It can be appreciated activating the second rotary motor 476 to rotate its rotary drive in an opposite second direction will pull the first actuator cable 478 in an opposite second direction to urge the seat to move from its neutral side-to-side position shown in FIG. 37 to a right side position about the first axis 7 (FIG. 5).

The second actuation mount may include a sensor 480, power source 482, such as a battery or the like, communications module 484, such as a transceiver or the like, for transmitting and receiving messages from the computer system 402. Accordingly, the computer system 402 may transmit movement commends to the second rotary motor and receive real-time position and movement information from sensor 480.

The first and second rotary motors 412, 476 may be spring loaded or free turning when not under powered control.

They can be hydraulic actuated by magnetic motor so allow the seat to move freely when not under powered control by the computer system. Moreover, the computer system 402 may activate and control both rotary motors 412, 476 simultaneously so as to allow the seat to be positioned and held by the computer system 402 in any desired position within the range of motion of the seat. The computers systems can also regulate and control the rate of change of movement of the rotary motors so as to allow the position of the seat to move between desired commanded positions at a desired rate.

In addition, the sensors, rotary motors and computer system can be used to define, adjust and detect a desired front-to-back neutral position and side-to-side neutral position of the seat and apply defined urging force to return the seat to these neutral positions when a user manually moves the seat out of them.

Exemplar Passive User Interfaces

As shown in FIG. 41, the tilt sensor 400 in communication with the computer system 402 can allow the position of the seat to be used to be displayed on a monitor 444 to produce a simulated center of gravity line on the display using computer graphics. Moreover, a simulated seat angle 448 and a captured angle of change 441 can be displayed and processed by the computer system 402 based on the user physically moving the seat 5 as shown.

As a result, as shown in FIG. 42, the computer can be programmed to use this information in many ways. For example, the computer can periodically initiate a self-movement application (Step 1) that encourages the user to move after a predetermined amount of sitting in the chair by first starting a timer (Step 2). After a predetermined amount of time the computer system displays a series of targets on the monitor (Step 3) that the user must move their chair as shown in FIG. 41 to move a cursor to hit the targets. The computer system monitors the cursor to targets initiated by the chair movement (Step 4), and resets the timer when all target have been reached by the cursor (Step 5).

It can be appreciated that much more sophisticated passive activation computer applications may be programmed to as to provide further benefits. For example, movement data collected by the computer system can be transmitted to a health care provider to the user to help track and monitory movement. Moreover, a user can use movement of seat to control a program such as a video game or the like.

Exemplar Active User Interfaces

The actuation system in communication with the computer system of the ergonomic motion chair 100 also allows the computer system to actively move the seat of the chair in response to predetermined criteria. An exemplar computer application is shown in FIG. 42. In this example, the computer or a user can initiate the computer activated movement application (Step 1) that moves the seat of the chair to predetermined locations. In step 2 it starts a timer to track the time interval of the predetermined movements, and moves the seat to a first predetermined position (Step 3). It then allows the seat to move freely after a predetermined time interval has passed (Step 4), then moves the seat to a second predetermined position after another predetermined time has passed (Step 5). It then resets the timer (Step 6) and restarts the application until a predetermined time for running the application has passed or the user cancels the application.

It can be appreciated that much more sophisticated computer applications involving computer activated movement of the seat can be programmed to provide additional benefits. For example, the computer application can operably connect to a computer/video game and move the seat of the chair to correlate with actions arising during the game appearing on a display. The computer system 402 can activate also activate the one or more vibration devices 454 on the ergonomic motion chair 100 in response to predetermined criteria.

In addition, computer applications aimed at improving or correcting specific physical discomforts and injuries, such as a sore lower back and the like, can include a specific computer actuated seat movement routine aimed at exercising the portion of the user's lower back or statically positioning the seat to an optimal position for providing optimum comfort. In addition, areas of movement of the chair that cause pain to a particular user can be mapped out and the computer application can be programmed to prevent movement of the seat into those areas, while still allowing the seat to move freely in other areas within the range of movement of the seat.

A remote monitor of the ergonomic motion chair 100, such as a health care professional or the like, can also remotely program and/or monitor the ergonomic motion chair 100 as desired for diagnosis purposes, treatment purposes and/or to collect and view user seat movement and use of a patient.

Having fully described the additional features and benefits of the present invention, it can be appreciated that each disclosed feature need not be included in every embodiment. For example, the side-to-side pivoting mechanism 610 may include side-to-side bearings 511 operably secured the upper portion of the main front-to-back frame operably engage curved side-to-side bearing rails 508 secured to a curved lower edge of side-to-side bearing guides 501 as shown. The upper portion of the bearing guides 501 includes structures for securing a seat 5 thereto. The curved lower edge of the side-to-side bearing guides 502 are sized to allow the seat to move side-to-side about a pivot axis that is projected above the seat plane as previously described.

Also, a plurality of space-apart side-to-side locking slots 513 may be provided along at least one side of the upper portion of the main front-to-back frame 502. A side-to-side locking pin 514 extends from a side-to-side bearing guide 501 to operably engage the side-to-side locking slots 513 thereby allowing a user to select a desired fixed side-to-side position of the seat by placing the locking pin 514 in a desired slot 513. A side-to-side biasing structure 506, such as an elongate resilient member or the like, may be operably secured between the side-to-side bearing guide 501 and main front-to-back frame 502 bias the side-to-side bearing guide 501 in a neutral side-to-side position.

In addition, the seatback 300 of the exemplar third embodiment 100", can be installed on the exemplar first embodiment 100, the second embodiment 100', the exemplar fourth embodiment 100''', or added to any other existing chair design. Also, a plurality of different seatbacks may be detachably secured to the frame to spine mount 504 of the mechanism frame 502 and a plurality of different seats 5 may be detachably secured to the seat engaging frames 520 in the fifth embodiment, thereby allowing the overall look of the chair to be easily modified while still providing the benefits of the basic dual axis movement of the seat.

Moreover, the disclosed engaging sliding structures such as the forward and back arcuate structures 203 and side arcuate structures 211 relative to their respective first and second elongated slides 700, 712 may be secured in reverse or to alternative enabling structures. Also, the rotary motors 412, 476 can contain a gear that engages a linear gear rail operably secured to the seat to achieve the same effects on the motion control, thereby eliminating the need for cables 411, 478 and the like.

It is appreciated that the mechanism functionality can also be delivered by a combination of rollers and glides within or about an arcuate structure in one axis or both axes.

Accordingly, the disclosed embodiments have been provided to fully disclose and describe the invention, but they should not be considered as limiting the invention beyond the scope of the claims.

The invention claimed is:

1. A chair having:

a frame:

a seat defining a seat plane, the seat having a front side, a back side, a left side a right side, and a left-to-right center;

the seat substantially pivotable about an axis of rotation, the axis of rotation positioned above the seat plane;

a sensor operably secured to the chair and in communication with a computer system, the computer system having an application that uses the sensor to track movement of the seat during use of the chair by a user, and the application allows a user of the chair to interact with the computer system to encourage movement of the seat while the user is sitting in the chair.

2. The chair of claim 1, wherein the application is selected from the group consisting of a computer game, a video game, a fitness tracker, a health monitor, physical therapy, wellness therapy, and an activity monitor.

3. The chair of claim 1, wherein the seat is substantially pivotable about a second axis of rotation such that movement of the seat about the axis of rotation and the second axis of rotation defines a range of motion of the seat.

4. The chair of claim 3, wherein the axis of rotation and second axis of rotation are offset from each other.

5. The chair of claim 3, wherein the second axis of rotation is above the seat plane.

6. The chair of claim 3, wherein the seat is simultaneously moveable side-to-side about the axis of rotation and front-to-back about the second axis of rotation.

7. The chair of claim 3, further including an actuation system operably secured to the chair and in communication with the computer system such that the computer system can activate the actuation system to position the seat at a defined position within the range of motion based on predetermined criteria.

8. The chair of claim 7, further including a biasing structure for urging the seat to return to a defined neutral position.

9. A chair having:

a frame:

a seat defining a seat plane, the seat having a front side, a back side, a left side a right side, and a left-to-right center:

the seat substantially pivotable about an axis of rotation, the axis of rotation positioned above the seat plane;

a sensor operably secured to the chair and in communication with a computer system;

the computer system including an application that uses the sensor to track the movement of the seat during use of the chair by a user; and an actuation system operably secured to the chair and in communication with the computer system such that the computer system can activate the actuation system to move the seat to a defined position about the axis of rotation based on predetermined criteria.

10. The chair of claim 9, wherein the computer system allows a user to map regions of the seat within its defined range of motion and command areas within that defined range of motion for the seat to avoid and/or engage more frequently with.

11. A chair having:

a frame:

a seat defining a seat plane, the seat having a front side, a back side, a left side a right side, and a left-to-right center:

the seat substantially pivotable about an axis of rotation, the axis of rotation positioned above the seat plane:

a sensor operably secured to the chair and in communication with a computer system, and, a mechanism operably connecting the seat to the frame for moving the seat about the axis of rotation, the mechanism including a first arcuate structure with a first elongated glide operably engaged within the first arcuate structure such that movement of the first elongated glide against the first arcuate structure allows the seat to move about the axis of rotation.

12. The chair of claim 11, wherein the sensor controls the computer system such that a user's movement of the seat about the axis of rotation controls at least one aspect of the computer.

13. The chair of claim 11, wherein the computer system includes an application that uses the sensor to track the movement of the seat during use of the chair by a user.

14. The chair of claim 11, wherein the computer system includes an application that uses the sensor to track the movement of the seat about the range of motion of the seat during use of the chair by a user.

15. The chair of claim 14, wherein the application allows a user of the chair to interact with the computer system to encourage movement of the seat throughout the range of motion of the seat while the user is sitting in the chair.

16. The chair of claim 11, wherein the seat is substantially pivotable about a second axis of rotation such that movement of the seat about the axis of rotation and the second axis of rotation defines a range of motion of the seat; and, the mechanism has a second arcuate structure with a second elongated glide operably engaged within the second arcuate structure such that movement of the second elongated glide against the second arcuate structure allows the seat to move about the second axis of rotation.

17. The chair of claim 11, wherein;

the first arcuate glide has an arcuate structure engaging surface;

the arcuate structure has a first glide engaging surface; and, the arcuate structure engaging surface and the first glide engaging surface are formed from materials selected from the group consisting of lubricant, polymer, polymer additives, nylon, acetal resin, stainless steel and aluminum.

18. The chair of claim 11, wherein the glide is formed from a plurality of structures.

19. The chair of claim 11, further including at least one roller operably secured to the mechanism.

20. The chair of claim 11, further including a biasing structure for urging the seat to return to a defined neutral position.

* * * * *